US012546134B2

(12) United States Patent
Espinosa

(10) Patent No.: US 12,546,134 B2
(45) Date of Patent: Feb. 10, 2026

(54) REINFORCED TIE ROD AND A BUILDING WALL USING THE SAME

(71) Applicant: CETRES HOLDINGS, LLC, Jackson, WY (US)

(72) Inventor: Thomas M. Espinosa, Snohomish, WA (US)

(73) Assignee: CETRES HOLDINGS, LLC, Jackson, WY (US)

( * ) Notice: Subject to any disclaimer, the term of this patent is extended or adjusted under 35 U.S.C. 154(b) by 260 days.

(21) Appl. No.: 17/221,172

(22) Filed: Apr. 2, 2021

(65) Prior Publication Data

US 2021/0310267 A1 Oct. 7, 2021

Related U.S. Application Data

(60) Provisional application No. 63/004,569, filed on Apr. 3, 2020.

(51) Int. Cl.

| | |
|---|---|
| ***E02D 27/04*** | (2006.01) |
| ***E04B 2/70*** | (2006.01) |
| ***E04H 9/02*** | (2006.01) |
| ***E04H 9/14*** | (2006.01) |
| *E02D 27/34* | (2006.01) |
| *E04B 1/26* | (2006.01) |
| *E04C 5/16* | (2006.01) |

(52) U.S. Cl.

CPC ..... *E04H 9/021* (2013.01); *E04B 2/706* (2013.01); *E04H 9/14* (2013.01); *E02D 27/34* (2013.01); *E04B 1/26* (2013.01); *E04B 2/70* (2013.01); *E04C 5/16* (2013.01)

(58) Field of Classification Search

CPC .. E04H 9/021; E04H 9/14; E04H 9/02; E04B 2/706; E04B 2001/2684; E04B 2001/3583; E04B 1/2604; E04B 2/707; Y02A 50/00

See application file for complete search history.

(56) References Cited

U.S. PATENT DOCUMENTS 2,625,815 A * 1/1953 Black ..... E04H 12/2261 52/707
3,657,849 A * 4/1972 Garton ..... E04B 1/0007 52/630
4,875,314 A * 10/1989 Boilen ..... E04H 9/14 52/236.7

(Continued)

OTHER PUBLICATIONS

Notification of Transmittal of the International Search Report and the Written Opinion of the International Searching Authority, or the Declaration dated Aug. 17, 2021, PCT/US21/25519.

*Primary Examiner* — Phi D A
(74) *Attorney, Agent, or Firm* — FRESH IP PLC

(57) ABSTRACT

A building wall includes a bottom plate and a top plate; a first stud and a second stud extending between the bottom plate and the top plate, the first stud and the second stud are spaced apart and next to each other; a tie rod including a first end portion operably anchored to a foundation and a second end operably attached to the building wall; a sheathing attached to the bottom plate, the top plate, the first stud and the second stud; a longitudinal member including a longitudinal hole, the tie rod extending through the hole; and the longitudinal member is operably attached to the sheathing.

29 Claims, 80 Drawing Sheets

(56) References Cited

U.S. PATENT DOCUMENTS 5,384,993 A * 1/1995 Phillips ..... E04B 1/34347 52/223.6
5,570,549 A * 11/1996 Lung ..... E04G 21/12 52/92.1
5,664,389 A * 9/1997 Williams ..... E04H 9/14 52/712
5,782,048 A * 7/1998 Ramirez ..... E04H 9/14 52/741.1
6,151,844 A * 11/2000 Kovachevich ..... E04H 9/14 52/223.6
6,256,960 B1 * 7/2001 Babcock ..... E04B 7/22 52/592.1
6,308,469 B1 * 10/2001 Leung ..... E04B 1/10 52/693
6,494,654 B2 * 12/2002 Espinosa ..... F16D 41/064 411/517
6,560,940 B2 * 5/2003 Mueller ..... E04B 1/2604 411/536
9,097,000 B2 * 8/2015 Espinosa ..... E04B 1/08
9,097,001 B2 * 8/2015 Espinosa ..... E04B 1/2604
10,267,053 B2 * 4/2019 Blomgren ..... E04B 2/56
2002/0095896 A1 * 7/2002 Commins ..... E04B 1/10 52/483.1
2003/0230032 A1 * 12/2003 Shahnazarian ..... E04H 9/14 52/223.13
2007/0028542 A1 * 2/2007 Lafferty ..... E04C 2/384 52/293.3
2007/0110513 A1 * 5/2007 Fujihashi ..... E04B 1/2403 403/364
2008/0277560 A1 11/2008 Simonsen
2009/0107082 A1 * 4/2009 Commins ..... E04H 9/14 52/745.12
2010/0115866 A1 5/2010 Espinosa
2010/0146893 A1 * 6/2010 Dickinson ..... E04F 17/00 52/302.3
2013/0032690 A1 2/2013 Long, Sr.
2013/0081343 A1 * 4/2013 Chadwick ..... E04B 2/702 52/843
2019/0003197 A1 1/2019 Lymberis
2019/0345710 A1 11/2019 Espinosa

* cited by examiner

REINFORCED TIE ROD AND A BUILDING WALL USING THE SAME

RELATED APPLICATION

This is a nonprovisional application claiming the priority benefit of Provisional Application Ser. No. 63/004,569, filed on Apr. 3, 2020, hereby incorporated by reference.

FIELD OF THE INVENTION

The present invention is generally directed to building walls and specifically to reinforced building walls designed to resist static and dynamic compression and tension forces.

BACKGROUND OF THE INVENTION

Reinforced building walls using threaded rods anchored to the foundation are disclosed in the prior art. For example, see U.S. Pat. Nos. 6,951,078, 7,762,030, 8,136,318, 8,943,777, 9,097,000, 9,097,001, 9,416,530 and 9,874,009, hereby incorporated herein by reference. These walls are designed to hold the walls against tension loads or forces caused by earthquakes and/or high winds.

SUMMARY OF THE INVENTION

The present invention provides a building wall, comprising a bottom plate and a top plate; a first stud and a second stud extending between the bottom plate and the top plate, the first stud and the second stud are spaced apart and next to each other; a tie rod including a first end portion operably anchored to a foundation and a second end operably attached to the building wall; a sheathing attached to the bottom plate, the top plate, the first stud and the second stud; a longitudinal member including a longitudinal hole, the tie rod extending through the hole; and the longitudinal member is operably attached to the sheathing.

The present invention also provides a building wall, comprising a bottom plate and a top plate; a first stud and a second stud extending between the bottom plate and the top plate, the first stud and the second stud are spaced apart and next to each other; a tie rod including a first end portion operably anchored to a foundation and a second end operably attached to the building wall; a sheathing attached to the bottom plate, the top plate, the first stud and the second stud; a first member and a second member disposed laterally of the tie rod to position the tie rod between the first member and the second member; the first member and the second member including respective top ends and bottom ends; a first bearing plate operably attached to the tie rod and disposed on the top ends; a second bearing plate operably attached to the tie rod and disposed on the bottom ends; and the first member and the second member are operably attached to the sheathing.

The present invention further provides a building wall, comprising a bottom plate and a top plate; a first stud and a second stud extending between the bottom plate and the top plate, the first stud and the second stud are spaced apart and next to each other; a tie rod including a first end portion operably anchored to a foundation and a second end operably attached to the building wall; a sheathing attached to the bottom plate, the top plate, the first stud and the second stud; a first member and a second member disposed laterally of the tie rod to position the tie rod between the first member and the second member, the first member and the second member are spaced from the first stud and the second stud; the first member and the second member including respective top ends and bottom ends; a first bearing plate operably attached to the tie rod and disposed on the top ends; the bottom ends bearing on the bottom plate; and the first member and the second member are operably attached to the sheathing.

The present invention also provides a building wall, comprising a bottom plate and a top plate; a first stud and a second stud extending between the bottom plate and the top plate, the first stud and the second stud are spaced apart and next to each other; a tie rod including a first end portion operably anchored to a foundation and a second end operably attached to the building wall; a sheathing attached to the bottom plate, the top plate, the first stud and the second stud; a first member and a second member disposed laterally of the tie rod to position the tie rod between the first member and the second member, the first member and the second member are spaced from the first stud and the second stud; the first member and the second member including respective top ends and bottom ends; a first bearing plate operably attached to the tie rod and disposed on the bottom ends; the top ends operably bearing onto an underside of the top plate; and the first member and the second member are operably attached to the sheathing.

The present invention further provides a building wall, comprising a bottom plate and a top plate; a first stud and a second stud extending between the bottom plate and the top plate, the first stud and the second stud are spaced apart and next to each other; a sheathing attached to the bottom plate, the top plate, the first stud and the second stud; a longitudinal member including a bottom end, the longitudinal member is operably attached to the sheathing; a bearing plate disposed on the bottom end, the bearing plate including a threaded opening; and a rod threaded to the threaded opening, the rod including an end portion anchored in a foundation.

The present invention also provides a coupler, comprising a cylindrical body having a first end a second end including a respective first cavity and a second cavity; a first split nut disposed in the first cavity to allow a threaded rod to move axially relative to the cylindrical body in a first direction but prevents the threaded rod to move in a second direction opposite to the first direction; and a second split nut disposed in the second cavity to allow the threaded rod to move axially relative to the cylindrical body in the first direction but prevents the threaded rod to move in the second direction opposite to the first direction.

The present invention also provides a coupler, comprising a cylindrical body having a first end a second end including a respective first cavity and a second cavity; a first split nut disposed in the first cavity to allow a threaded rod to move axially relative to the cylindrical body in a first direction but prevents the threaded rod to move in a second direction opposite to the first direction; and a second split nut disposed in the second cavity to allow the threaded rod to move axially relative to the cylindrical body in the second direction but prevents the threaded rod to move in the first direction.

The present invention further provides a reinforced rod for being anchored in a foundation and attached to a building wall, comprising a rod including a first end portion for being operably anchored to a foundation; a longitudinal member for being attached to the building wall, the member including a top end; the rod extending through the member; and a bearing member operably attached to the rod to bear on the top end.

BRIEF DESCRIPTION OF THE DRAWINGS

FIGS. 22A-24B show various ways of attaching a bearing plate to the tie rod.

DETAILED DESCRIPTION OF THE INVENTION

Figure 1:
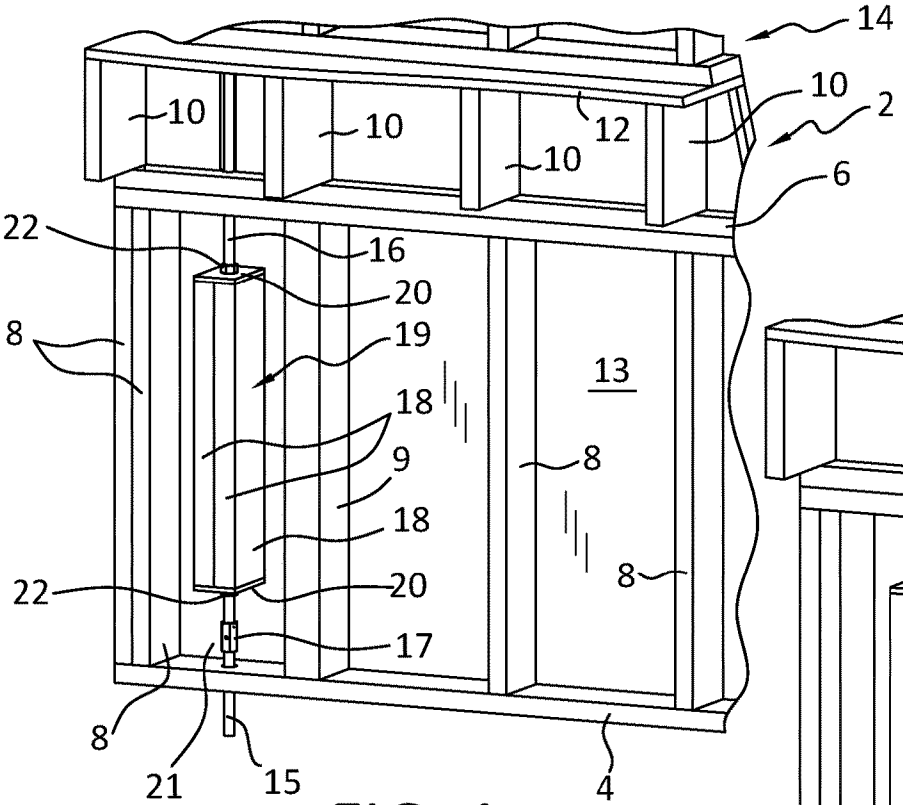

Referring to FIG. 1, a reinforced building wall 2 is disclosed, including a bottom plate 4 supported on a foundation 38 (see FIG. 11), a top plate 6, studs 8 extending between the bottom plate 4 and top plate 6, floor joists 10 supported on the top plate 6, and a sub-floor 12 supported on the floor joists 10. The studs 8 may be doubled up for added strength. The studs 8, single or doubled up, are spaced apart from the next stud. A one-piece wood post 9 (see also FIG. 13A) of sufficient cross-sectional area may be used in lieu of double studs 8. Wall sheathing 13 is operably attached with nails and/or screws and/or adhesives to the base plate 4, the top plate 6 and the studs 8. Another wall 14 may be supported on the wall 2. The wall 14 is built in the same way as the wall 2.

An anchor rod 15 extends through the bottom plate 4 and joins a tie rod 16 via a coupler 17. The tie rod 16 extends within a standard stud bay 21 through the top plate 6 and through the upper wall 14. The tie rod 16 is anchored in the foundation (see FIG. 12A) and operably attached to the upper wall 14.

A portion of the tie rod 16 is encased with two reinforcement members 18 joined together along their faces with the tie rod 16 extending in between. The members 18 are longitudinal (longer than its depth or width). The two reinforcement members 18, preferably made of wood, become one unitary block 19 of wood when joined to each other with screws, nails or other standard means. The block 19 advantageously provides additional rigidity to the tie rod 16 when subjected to compression loading, reducing bending or bowing and thus allowing the tie rod 16 greater compression load capacity than without the block 19. The block 19 effectively makes the tie rod 16 to function as a post to transfer compression loading to the concrete foundation 38. The reinforcement members 18 are operably attached to the sheathing 13 with nails or screws (see FIG. 25B) or other standard means. Bearing plates 20 are disposed on the respective top and bottom edges of the reinforcement members 18. The bearing plates 20 are preferably made of metal. Nuts 22 securely attach the reinforcement members 18 to the tie rod 16. The reinforcement members 18 may be made of other suitable materials such as engineered lumber, plastic, metal, etc.

The reinforced building walls 2 and 14 are shown as shear walls but may be used in other types of walls, such as interior walls. The embodiments of the present invention are advantageously located near the end of the shear walls where maximum uplift occurs from overturning moment due to in-plane lateral load applied at the top of the wall from wind and seismic loads.

Figure 2:
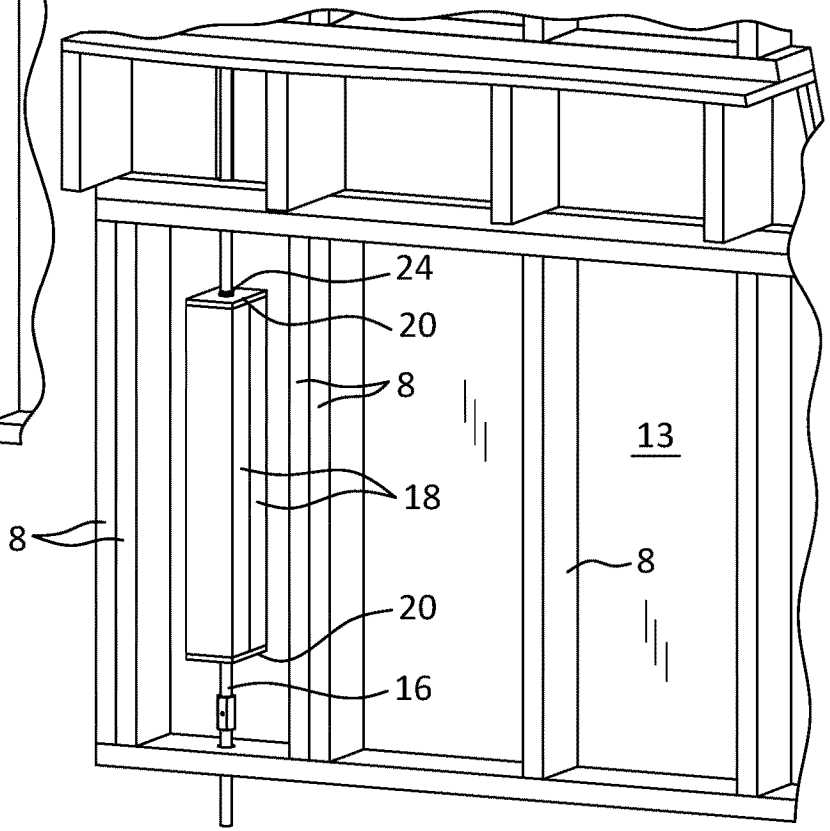
FIGS. 1-2 show a reinforced building wall embodying the present invention.

Referring to FIG. 2, the bearing plates include threaded holes 24 that are threaded to the tie rod 16. Nuts 22 are advantageously not used in this embodiment. The reinforcement members 18 are turned 90° so that the larger faces are parallel to the sheathing 13. The inner reinforcement member 18 next to the sheathing 13 is operably attached to the sheathing 13 with screws and/or nails and/or adhesives and/or other standard means. The reinforcement members 18 are joined together into a unit with nails and/or nails and/or adhesives and/or other standard means. The wood post 9 shown in FIG. 1 is replaced with double wood studs 8.

Figure 3:
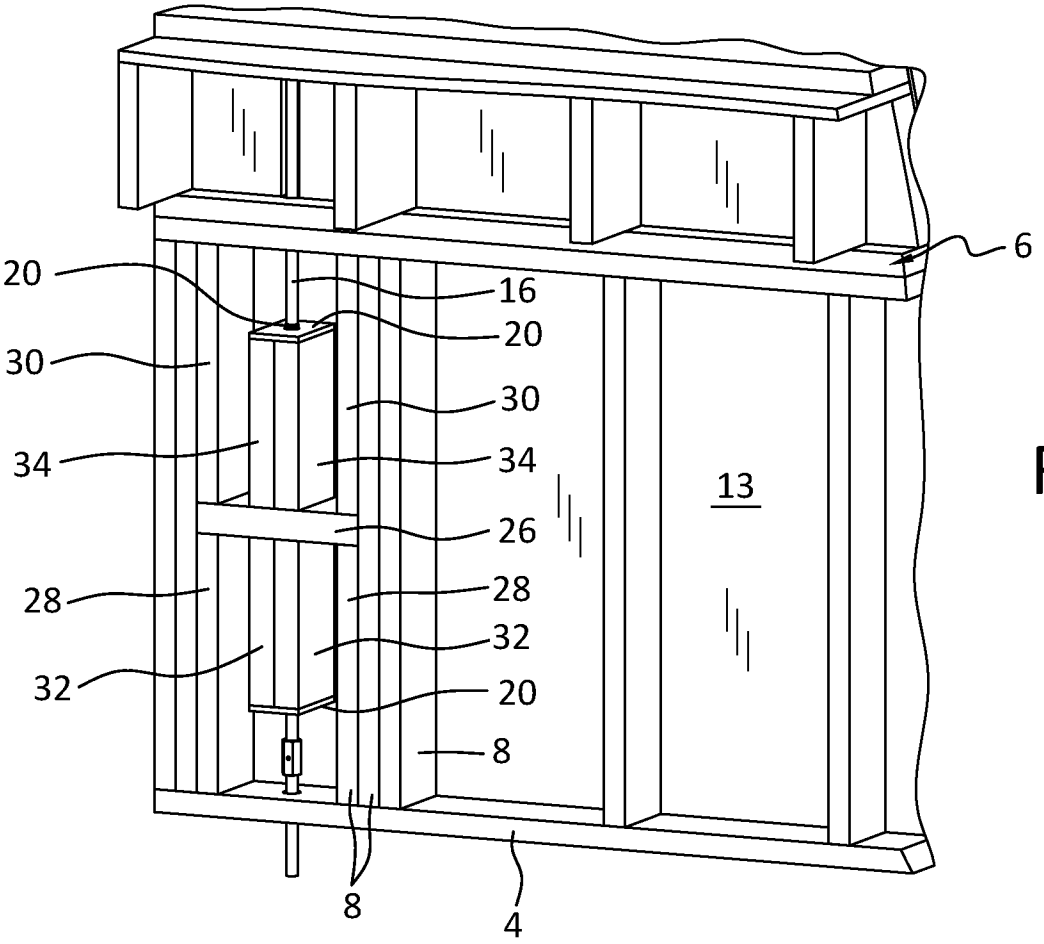
FIG. 3 shows a modification of the configuration shown in FIGS. 1 and 2.

Referring to FIG. 3, a cross-member 26 is disposed between lower reinforcement studs 28 and upper reinforcement studs 30. The lower reinforcement studs extend from the base plate 4 to the cross-member 26. The upper reinforcement studs extend from the cross-member 26 to the top plate 6. The cross-member 26 is operably sandwiched between the top ends of the lower reinforcement studs 28 and the bottom ends of the upper reinforcement studs 30. The reinforcement members 18 are divided into lower reinforcement members 32 and upper reinforcement members 34. The reinforcement members 32 are joined together with nails and/or screws and/or adhesives and/or other standard means to form a unitary block. The reinforcement member 34 are likewise joined together. The reinforcement members 32 and 34 are operably attached to the sheathing 13 with nails and/or screws and/or adhesives and/or other standard means. The tie rod 16 extends through the reinforcement members 32 and 34 and through the cross-member 26. The bearing plates 20 are shown operably attached to the tie rod 16 with the threaded openings 20, although the nuts 22 shown in FIG. 1 may also be used.

Compressive loading on the tie rod 16 is operably transferred via the bearing plates 20 to the reinforcement members 32 and 34. The reinforcement members 32 and 34 and the cross-member 26 advantageously provide additional rigidity to the tie rod 16 under compressive loading. The cross-member 26 may be made of wood, solid metal or hollow metal, such as disclosed in U.S. Pat. No. 9,097,000, hereby incorporated by reference.

It should be understood the addition of the cross-member 26 is also applicable to the configuration shown in FIG. 2.

Figure 5:
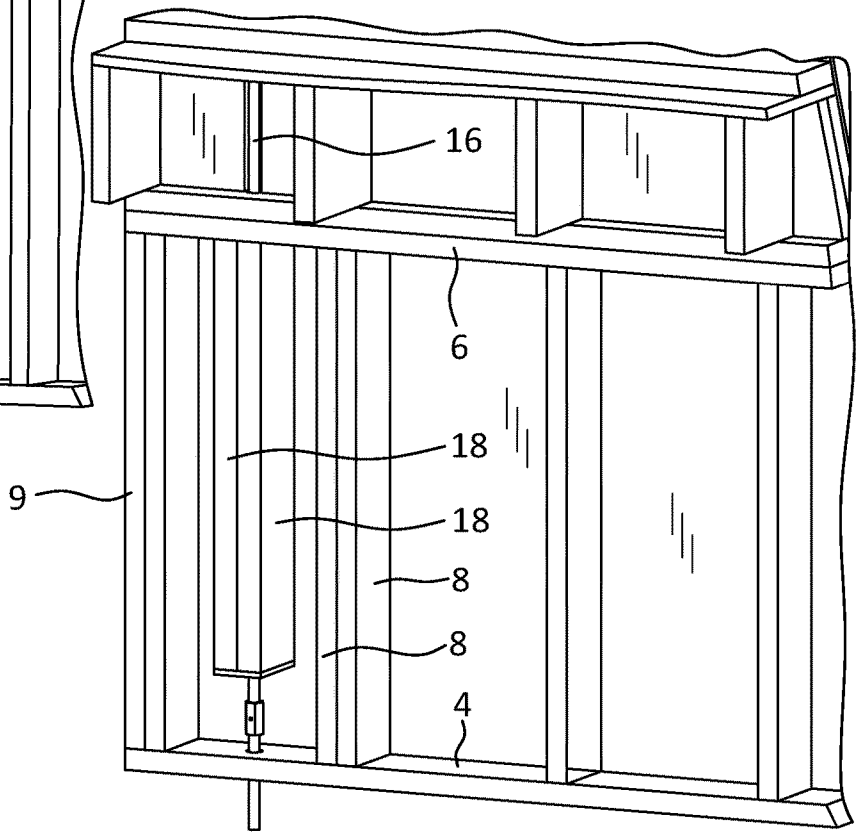
FIGS. 4-19 show modifications of the reinforced building wall shown in FIGS. 1 and 2.
Figure 4:
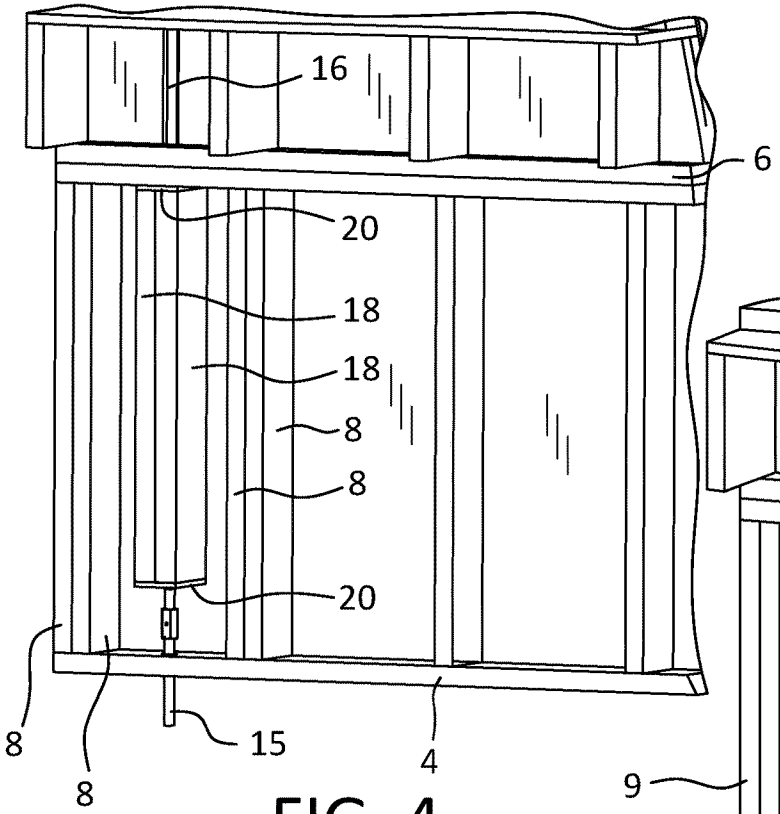

Referring to FIGS. 4 and 5, the reinforcement members 18 extend to the top plate 16. The bearing plates 20 are threaded to the tie rod 16. The upper bearing plate 20 may be used to distribute the load from the tie rod 16 to the reinforcement members 18.

The upper bearing plate 20 may be omitted as shown in FIG. 5 where the top ends of the reinforcement members 18 engage the bottom side of the top plate 6. Compression loading on the tie rod 16 is transferred directly to the anchor and the foundation (see FIG. 11). The members 18 advantageously provide lateral support to the tie rod 16, thus providing additional compression loading capacity for the tie rod without bowing or bending. Compression loading from the upper wall is transferred to the members 18 and to the lower bearing plate 20 and to the tie rod 16. The double studs 8 shown in FIG. 4 may be replaced with a wood post 9.

Figure 7:
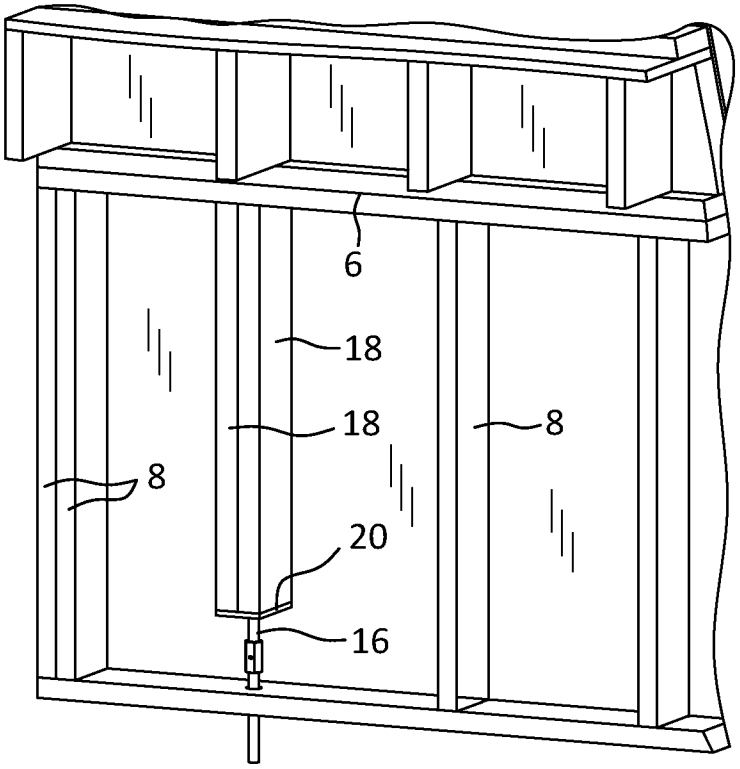
Figure 6:
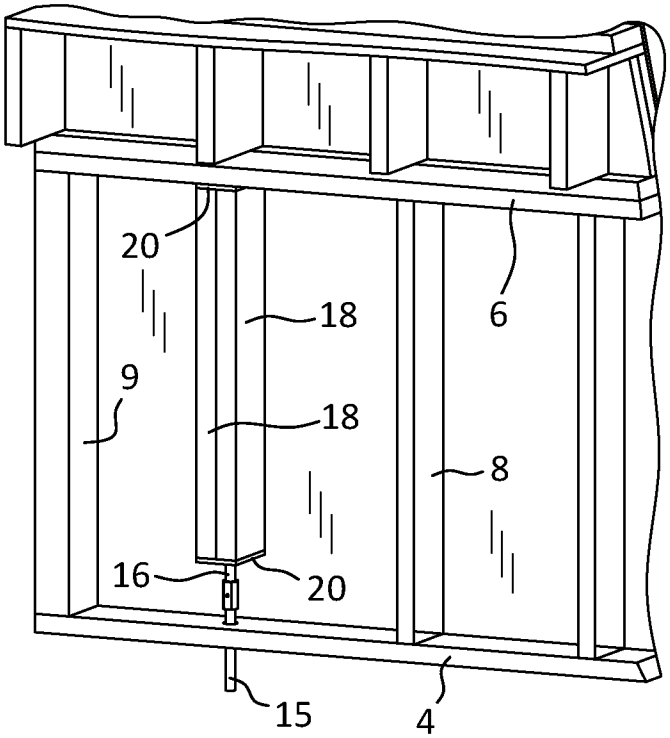

Referring to FIGS. 6 and 7, the reinforcement members 18 are disposed in place of the double studs 8 shown in FIGS. 4 and 5. The tie rod 16 extends through top plate 6 and continues on to the wall above (see FIG. 17B).

Figure 9:
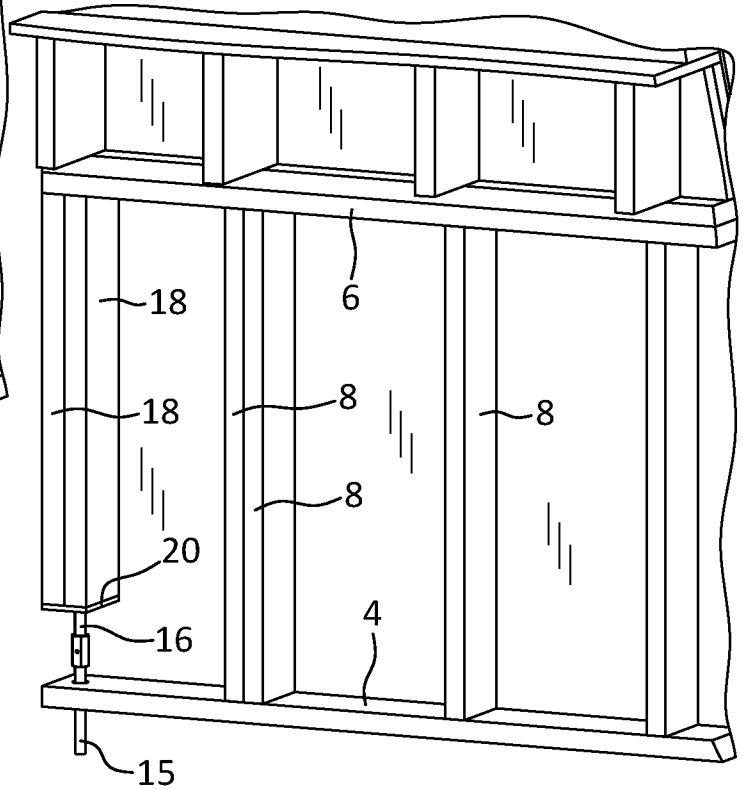
Figure 8:
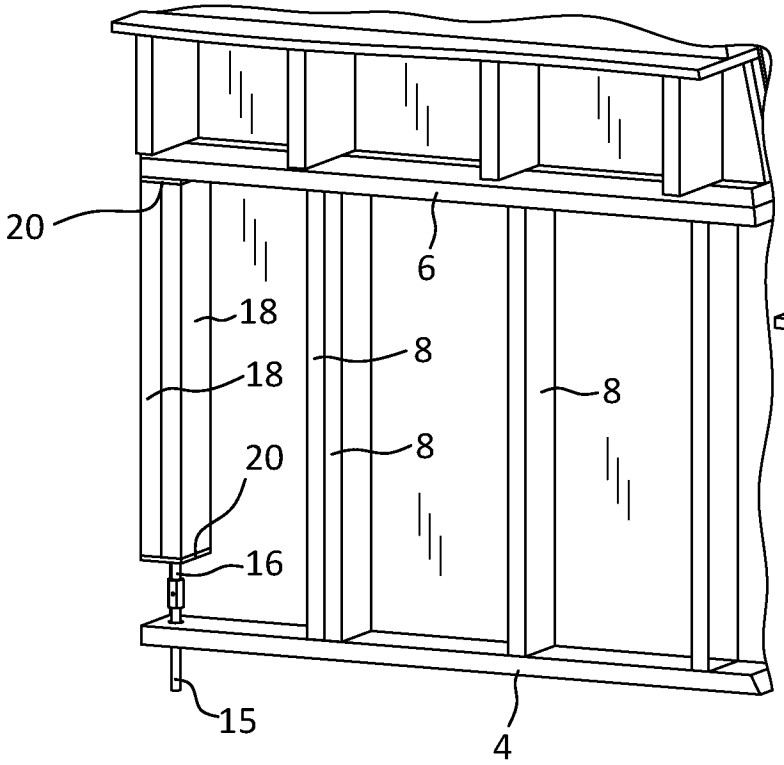

Referring to FIGS. 8 and 9, the reinforcement members 18 replace the post 9 shown in FIG. 6 and the double studs 8 shown in FIG. 7. The tie rod 16 extends through top plate 6 and continues on to the wall above (see FIG. 17B). An upper bearing plate 20 is used in FIG. 8, as in FIGS. 4 and 6.

Figure 10:
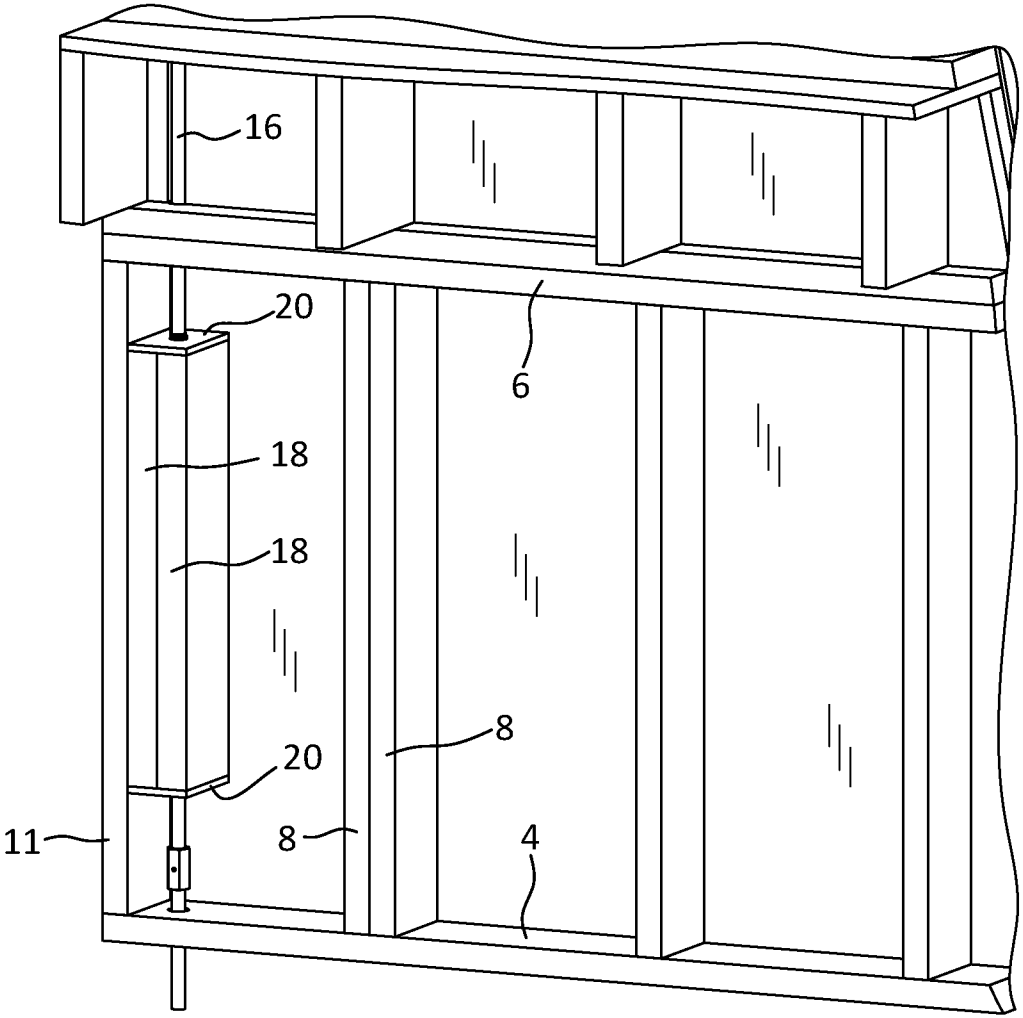

Referring to FIG. 10, the reinforcement members 18 are operably attached to an adjacent stud 11 and the wall sheathing 13. Instead of having double studs 8 as shown in FIG. 4, a single stud 8 may be used. The reinforcement members 18 together with the tie rod 16 advantageously provide additional load bearing capacity to the single stud 8. Compression loading on the stud 11 is advantageously transferred to the members 18 and the tie rod 16 through the lower bearing plate 20.

Figure 11:
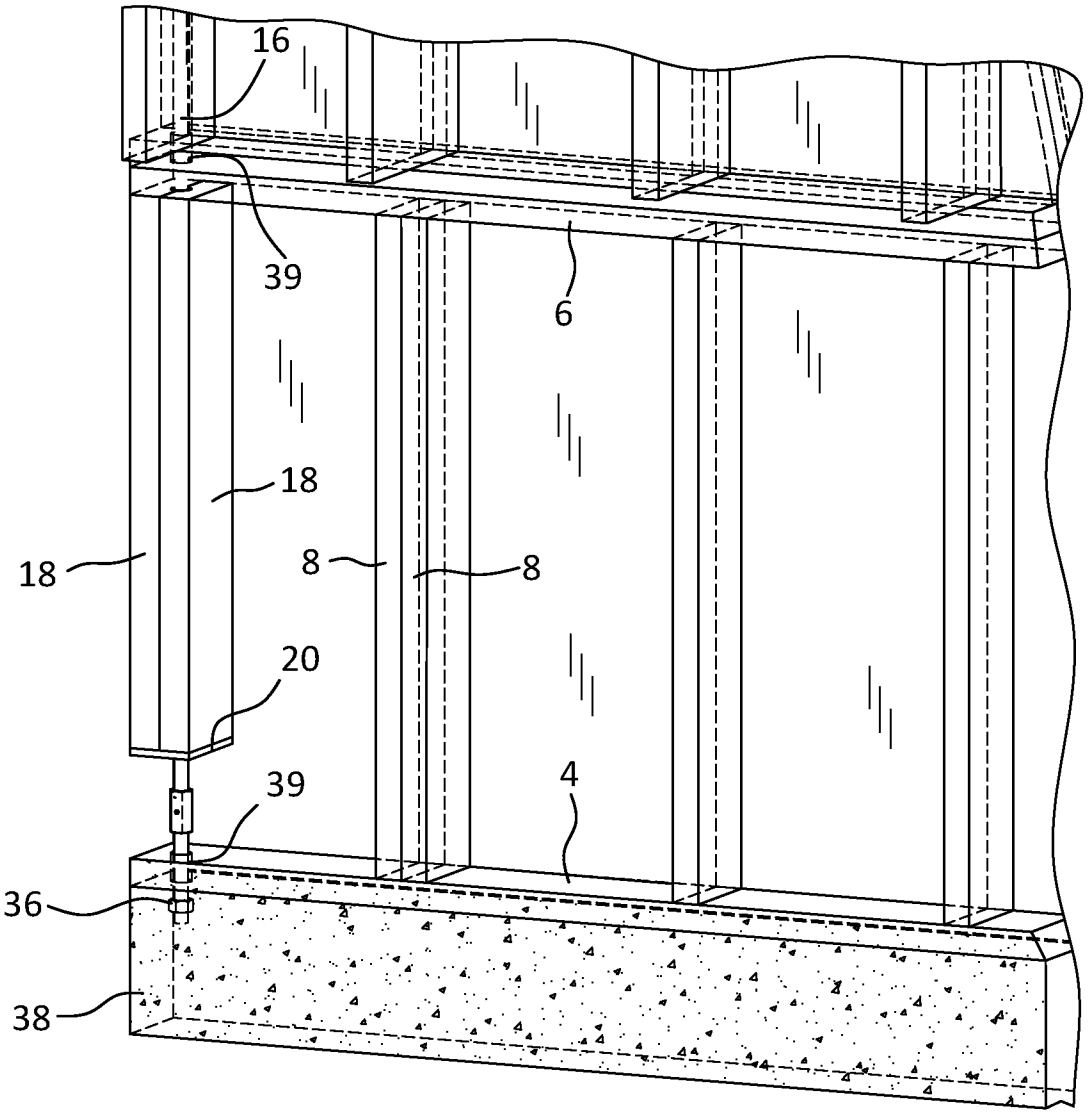

Referring to FIG. 11, the reinforcement members 18 replace the wood post 9 or the double studs 8 shown in FIGS. 6 and 7. An anchor 36 embedded in the concrete foundation 38 transfers compression loading from the top plate 6 to the foundation 38. Compression forces from the top plate 6 transfer to the reinforcement members 18, to the bearing plate 20, to the tie rod 16, to the anchor 36 and finally to the foundation 38. The anchor 36 may be an ordinary nut or any of the anchor bodies disclosed in U.S. Pat. No. 9,416,530, hereby incorporated herein by reference. The anchor 36 is advantageously disposed in an upper portion of the concrete foundation 38 so as to allow the anchor 36 to generate a larger shear cone when placed under compression loading, as discussed in PCT Publication WO 2019/222660, hereby incorporated herein by reference. Holes 39 in the bottom plate 4 and the top plate 6 are preferably oversized for the diameter of the tie rod 16 to allow the compression loading on the tie rod to bypass the top plate 6 and bottom plate 4.

Figure 12B:
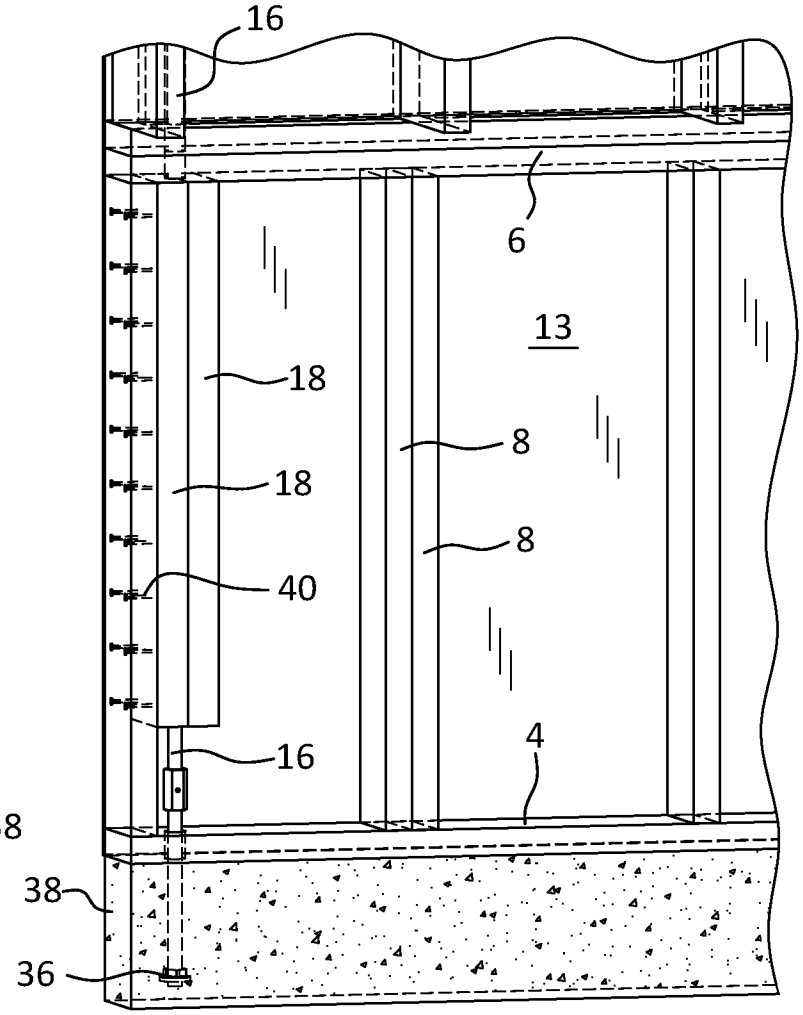
Figure 12A:
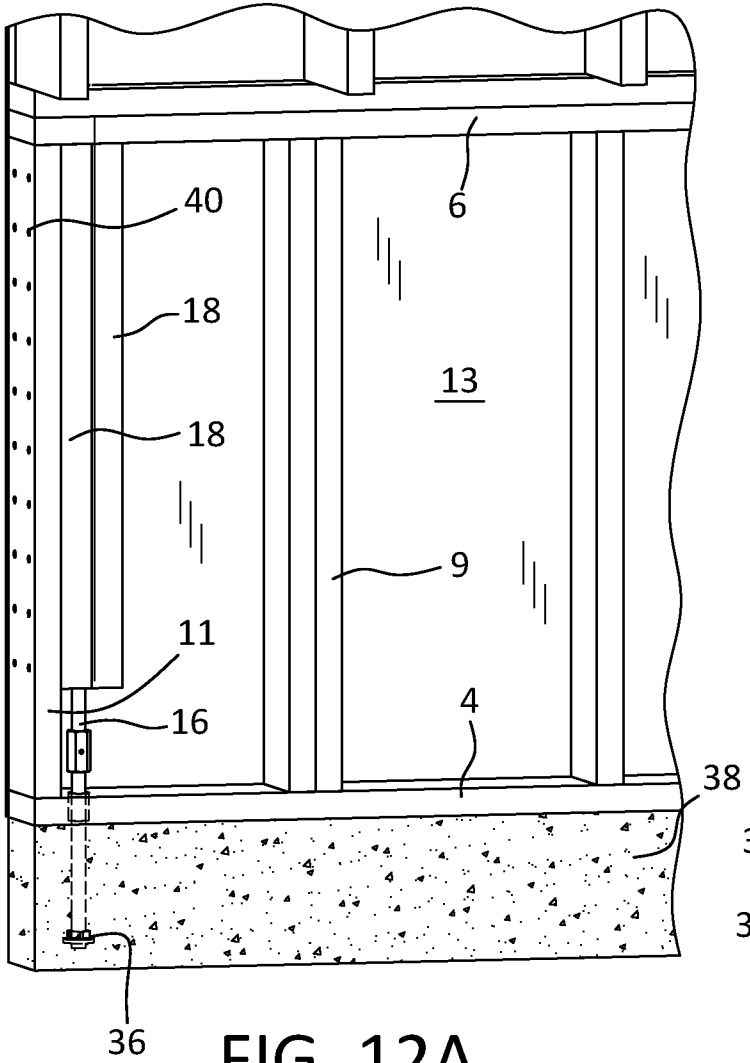

Referring to FIGS. 12A and 12B, the reinforcement members 18 are attached to the adjacent wood stud 11 and the wall sheathing 13 with nails and/or screws 40 and/or adhesives and/or other standard means. The number of studs 8 at the end of the wall is advantageously reduced due to the attachment of the reinforcement members 18. Compression forces from the top plate 6 are transferred to the reinforcement members 18, to the end stud 8 through the nails and/or screws 40, to the base plate 4 and to the concrete foundation 38.

Compression or tension loading on the tie rod 16 is not transferred to the reinforcement members 18 since the tie rod 16 is not axially fixed to the reinforcement members 18. Accordingly, the tie rod 16 is used to transfer tension loading from the upper floor connections to the concrete foundation 38 via the anchor 36. Similarly, the upper floor compression loading may be transferred directly to the concrete foundation 38 without passing through the first floor.

Figure 13B:
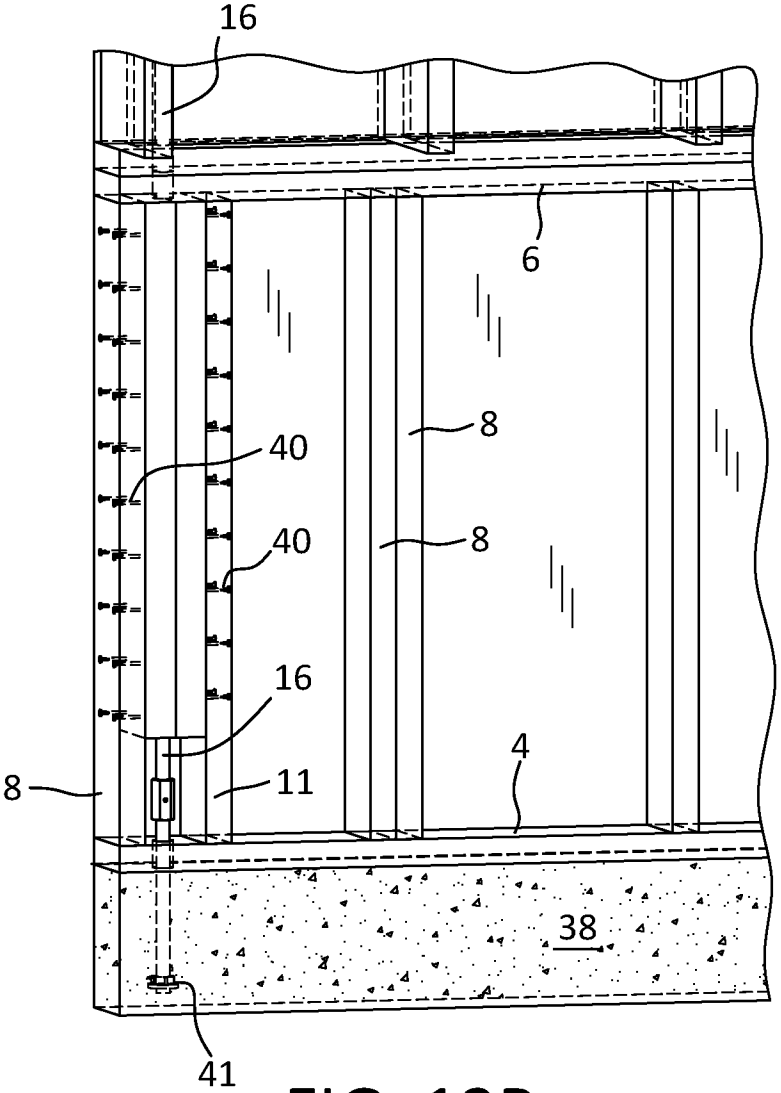
Figure 13A:
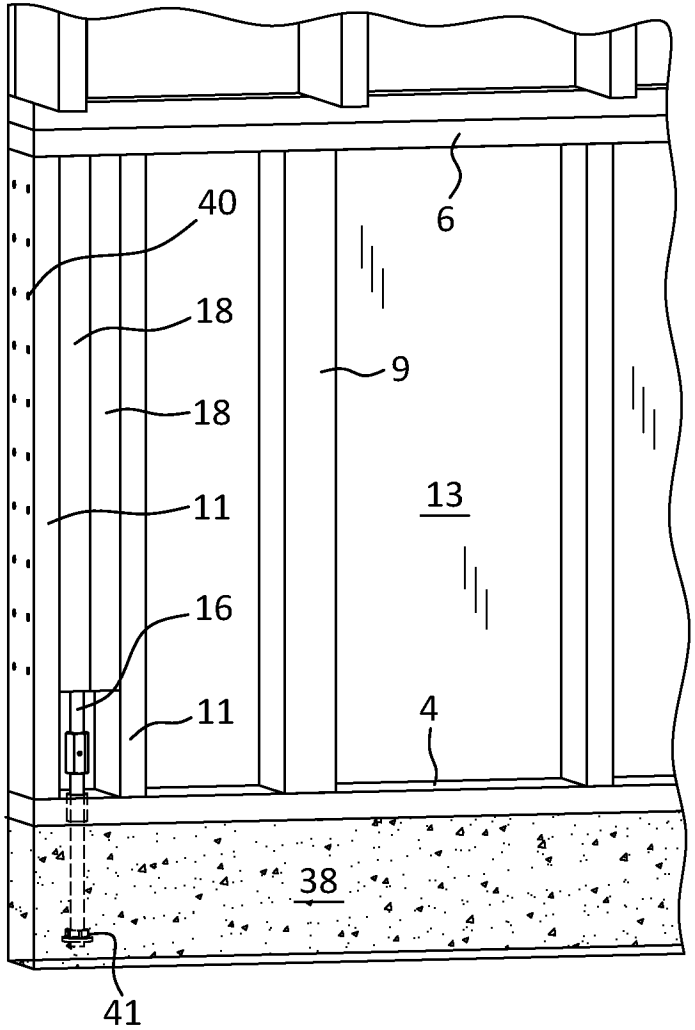

Referring to FIGS. 13A and 13B, the reinforcement members 18 are attached to two adjacent and opposing studs 11 and the wall sheathing 13 with nails and/or screws 40 and/or adhesives and/or other standard means. The tie rod 16 acts independently of the reinforcement members 18 since the tie rod 16 is not axially fixed to the reinforcement members 18. Compression or tension loading on the tie rod 16 is not transferred to the reinforcement members 18 since the bearing plates 20 are not used. Similarly, compression loading on the reinforcement members 18 from the top plate 6 is not transferred to the tie rod 16. The reinforcement members 18 advantageously provide rigidity to the tie rod 16 during compression load, preventing the tie rod 16 from bending or bowing, effectively making the tie rod 16 act as a post to transfer compression loading to the concrete foundation 38 via the anchor 41 made in the same way as the anchor 36. The anchor 41 is preferably disposed deeper into the concrete foundation 38 to advantageously handle tension loading on the tie rod 16. Tension loading generates an inverted shear cone in the concrete foundation so that a larger shear is generated when the anchor 41 is deeper inside the foundation. The anchor 41 may also handle compression loading where the concrete foundation 38 is deep enough to enable the anchor 41 to generate a sufficiently sized upright shear cone in the concrete foundation.

Figure 14B:
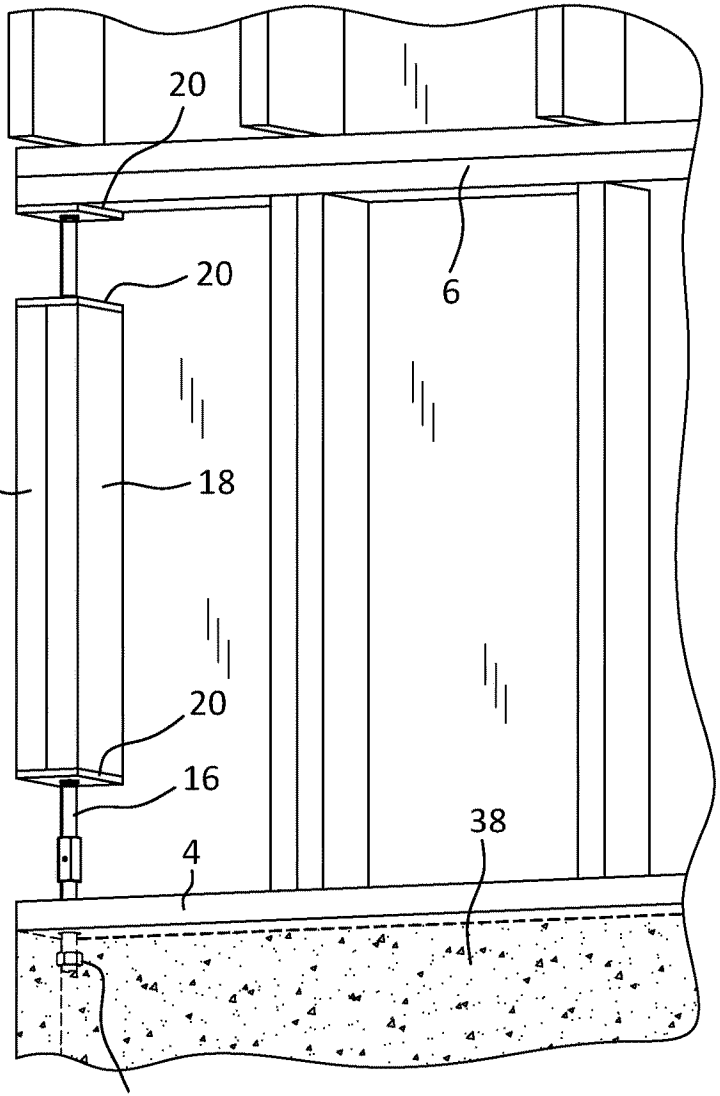
Figure 14A:
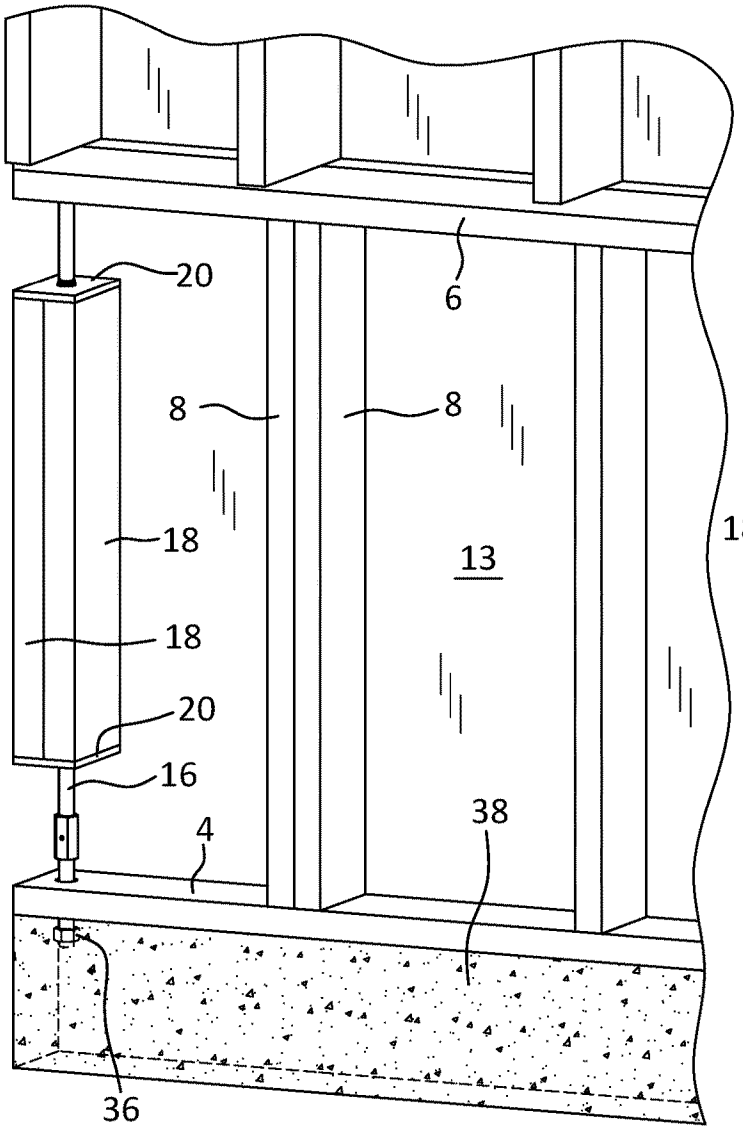

Referring to FIGS. 14A and 14B, the members 18 are not attached to adjacent studs (see FIGS. 13A and 13B) and do not extend to the top plate 6. The members 18 are sandwiched between upper and lower bearing plates 20 that are threaded to the tie rod 16. Compression loading on the tie rod 16 is transferred to the upper bearing plate 20, which distributes the load to the members 18 and the lower bearing plate 20 and thence to the lower portion of the tie rod 16 and the foundation 38 via the anchor 36, which may be a standard nut. The anchor 36 is advantageously located in an upper portion of the foundation to generate a larger shear cone into the concrete foundation. The members 18 are operably attached to the wall sheathing 13 with screws and/or screws 40 and/or adhesives and/or other standard means in a similar manner as shown in FIGS. 13A and 13B for attaching the members 18 to the adjacent studs 11. Attachment to the wall sheathing 13 advantageously distributes some of the compression loading on the tie rod 16 to the wall sheathing.

Figure 15B:
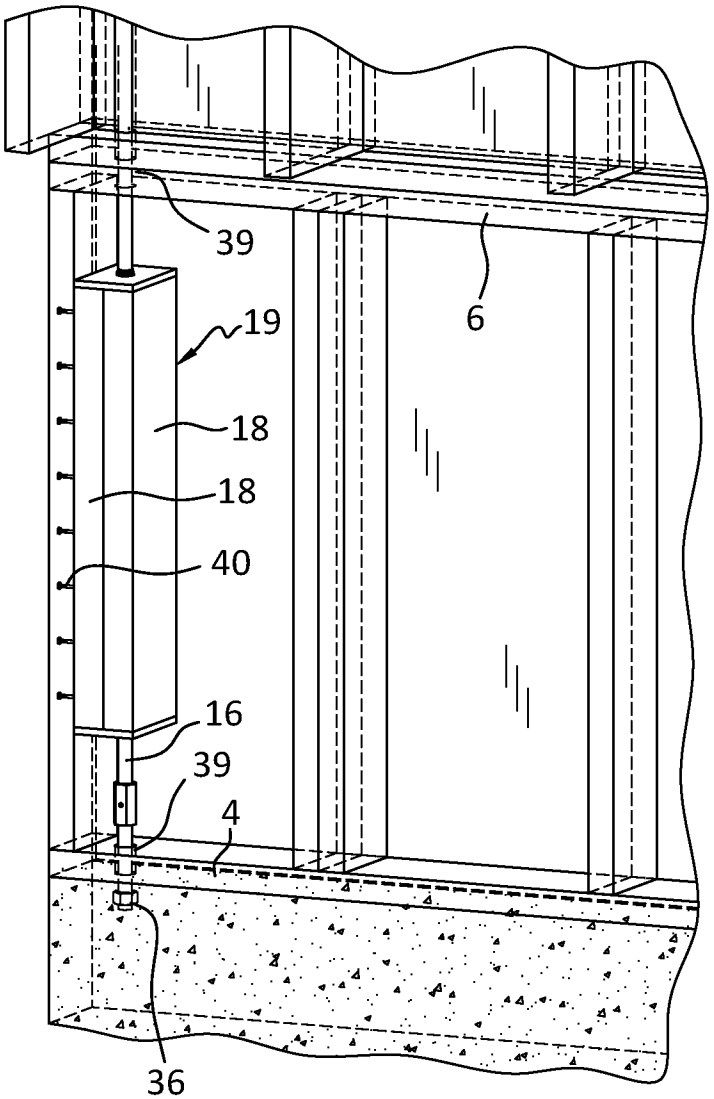
Figure 15A:
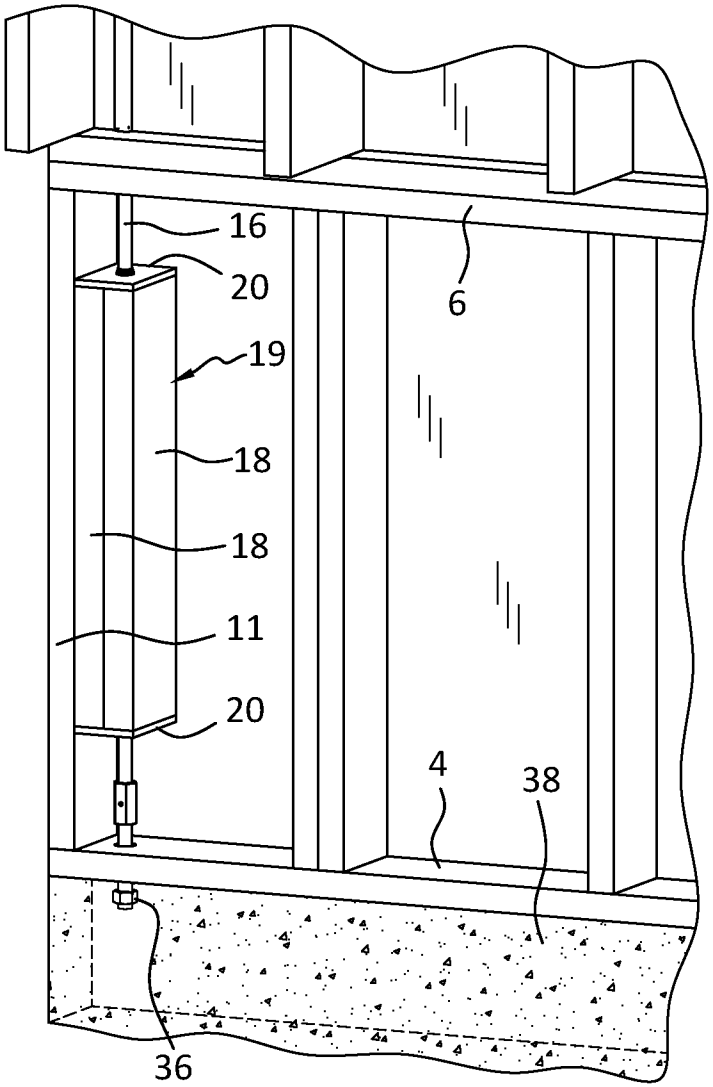

Referring to FIGS. 15A and 15B, the configuration shown in FIGS. 14A and 14B is modified with the members 18 being operably attached to an adjacent stud 11 and the wall sheathing 13 with nails and/or screws 40 and/or adhesives and/or other standard means. Compression loading on the end stud 11 is advantageously transferred to the members 18 and the tie rod 16 to the foundation 38 via the anchor 36. Compression loading from the upper floors are advantageously distributed through the upper bearing plate 20, the members 18 and the adjacent stud 11, through the lower bearing plate 20, to the lower portion of the tie rod 16 and finally to the foundation 38 via the anchor 36. The tie rod portions that passes through the top plate 16 and the bottom plate 4 are preferably smooth and the openings 39 in the bottom plate 4 and the top plate 6 are preferably oversized so that compression loading from the upper floors is not imposed on the top plate 6 and the bottom plate 4.

Figure 16B:
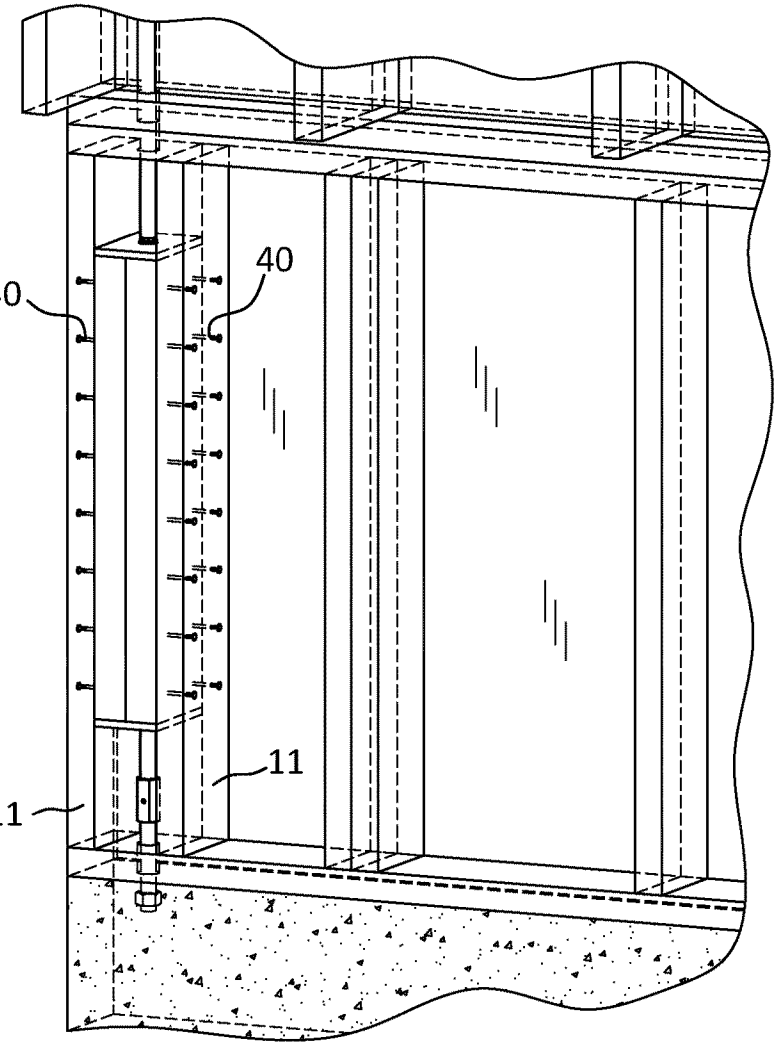
Figure 16A:
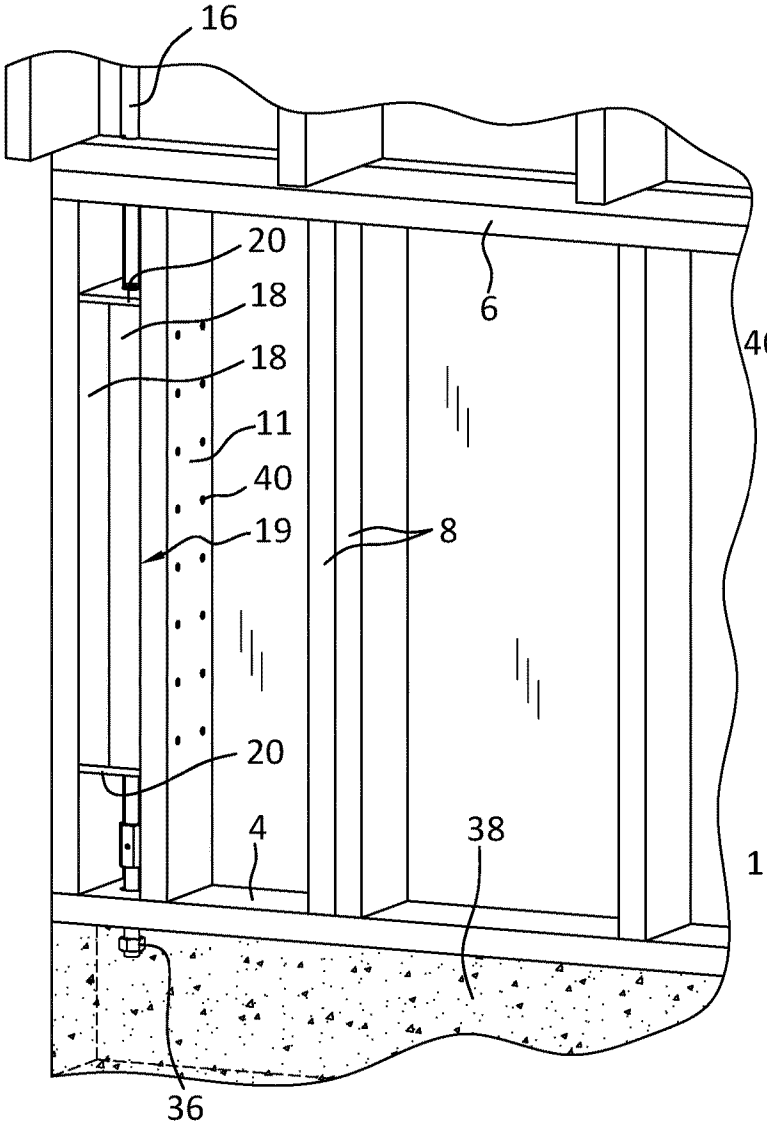

Referring to FIGS. 16A and 16B, the configuration shown in FIGS. 15A and 15B is modified by attaching another adjacent stud 11 to the other side of the block 19, which is made up of the reinforcement members 18. The reinforcement members 18 are operably attached with nails and/or screws 40 and/or adhesives and/or other standard means to the two adjacent studs 11. Compression loading from the top plate 6 is shared with the reinforcement members 18 and transferred to the tie rod 16 through the lower bearing plate 20. Similarly, compression loading on the tie rod 16 from the upper floor is distributed to the reinforcement members 18 via the upper bearing plate 20 and then shared with the adjacent studs 11. Compression loading on the reinforcement members 18 is transferred to the tie rod 16 via the lower bearing plate 20.

Figure 17B:
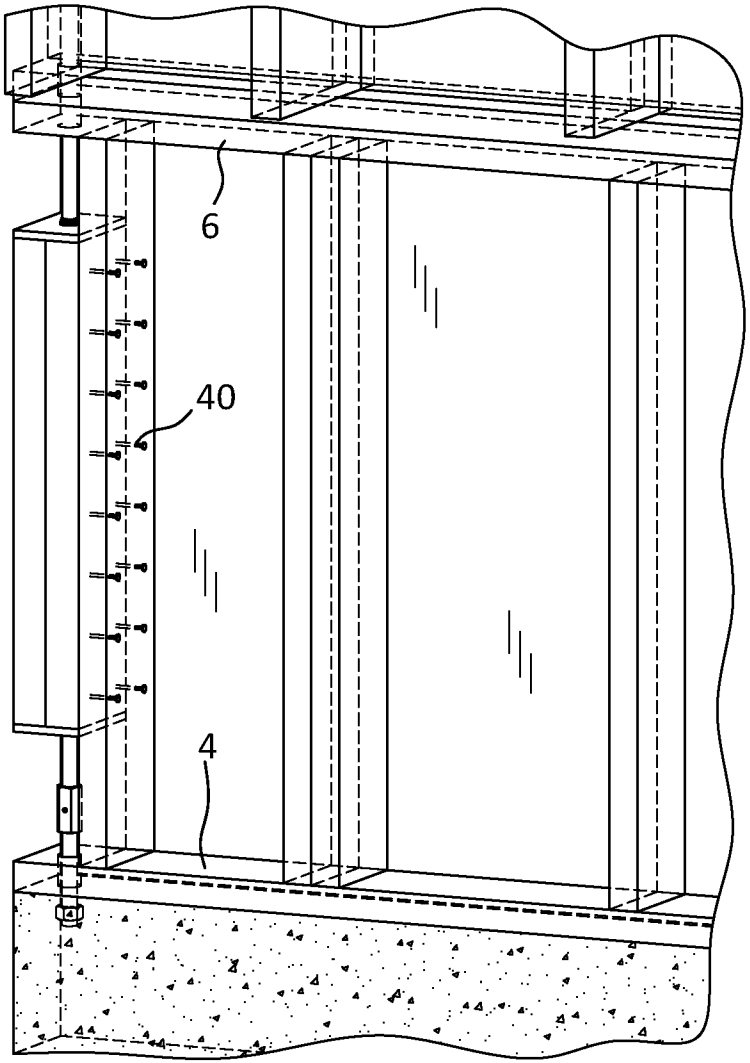
Figure 17A:
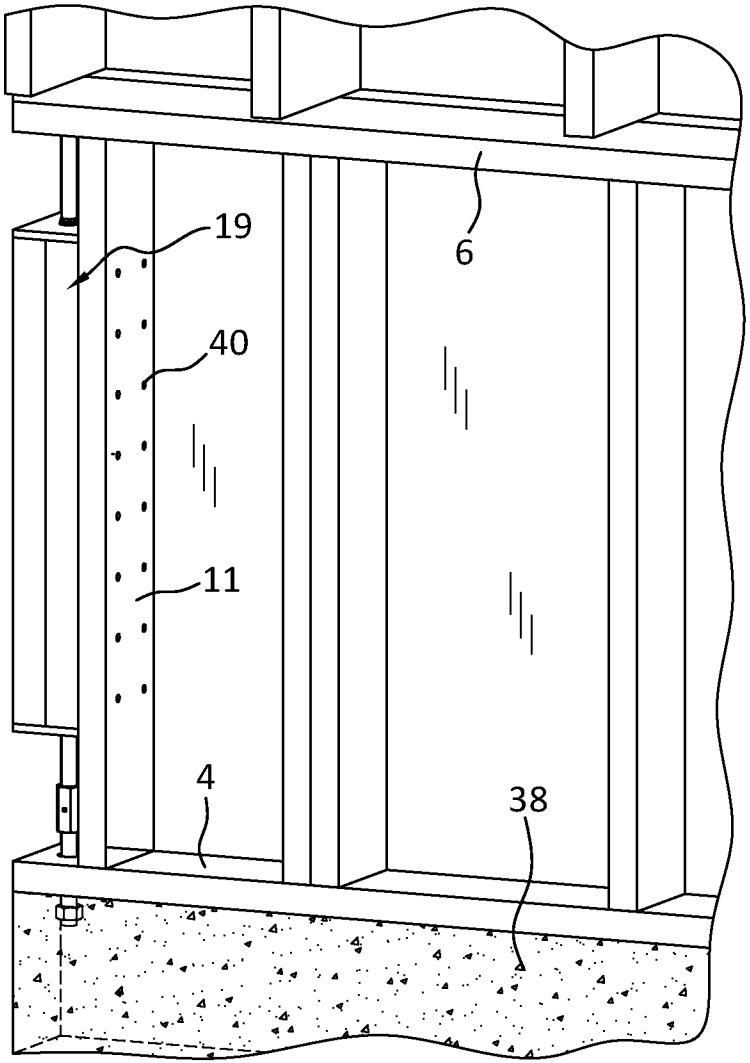

Referring to FIGS. 17A and 17B, the configuration shown in FIGS. 15A and 15B is modified by relocating the adjacent stud 11 to the other side of the block 19. Screws and/or screws 40 and/or adhesives and/or other standard means operably attach the adjacent stud 11 to the reinforcement members 18. The configuration of FIGS. 17A and 17B works in the same way as the configuration of FIGS. 15A and 15B.

Figure 17C:
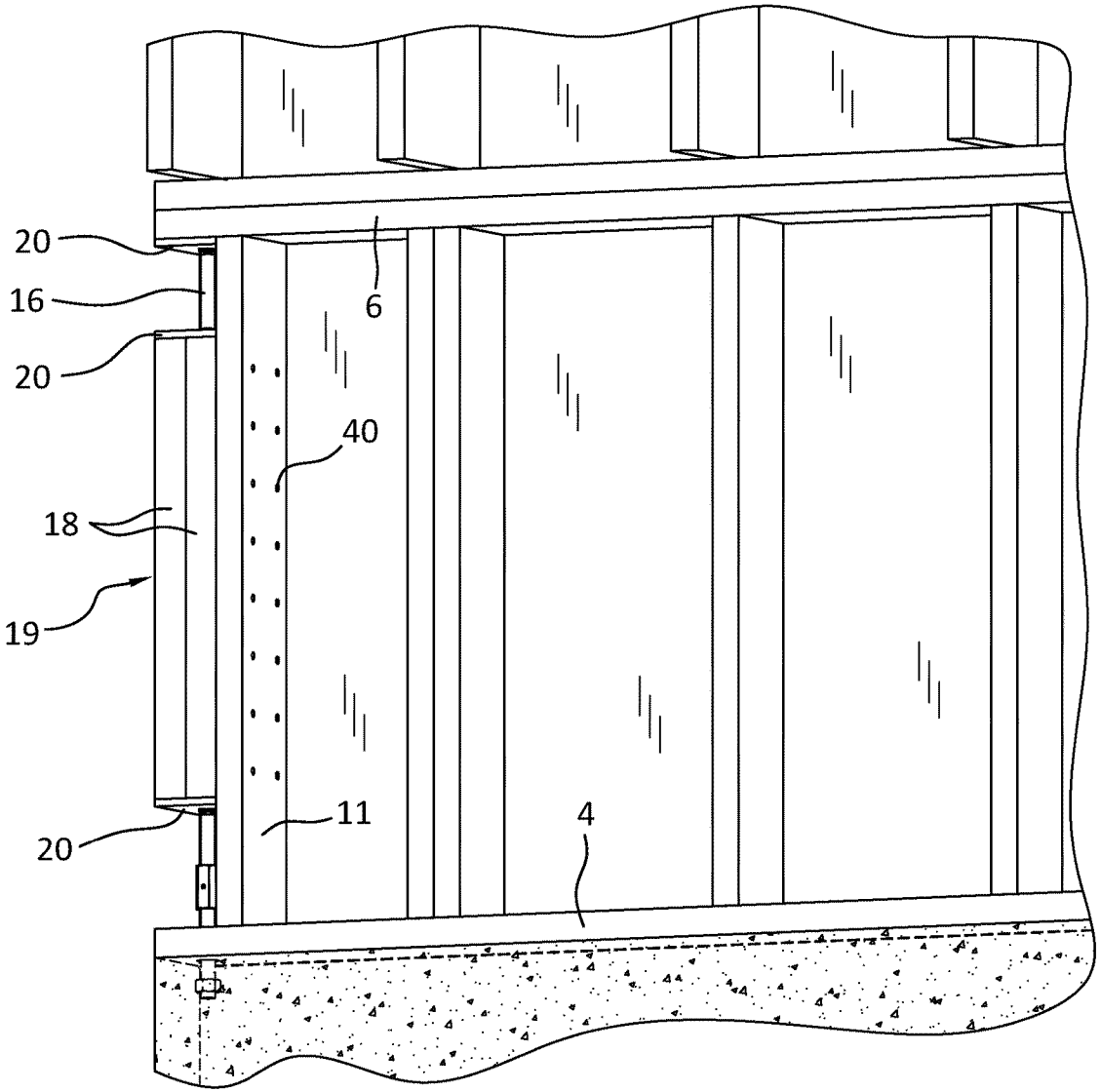

Referring to FIG. 17C, another bearing plate 20, which is threaded to the tie rod 16, may be provided underneath the top plate 6 to advantageously transfer compression loading from the top plate 6 to the tie rod 16.

Figure 18B:
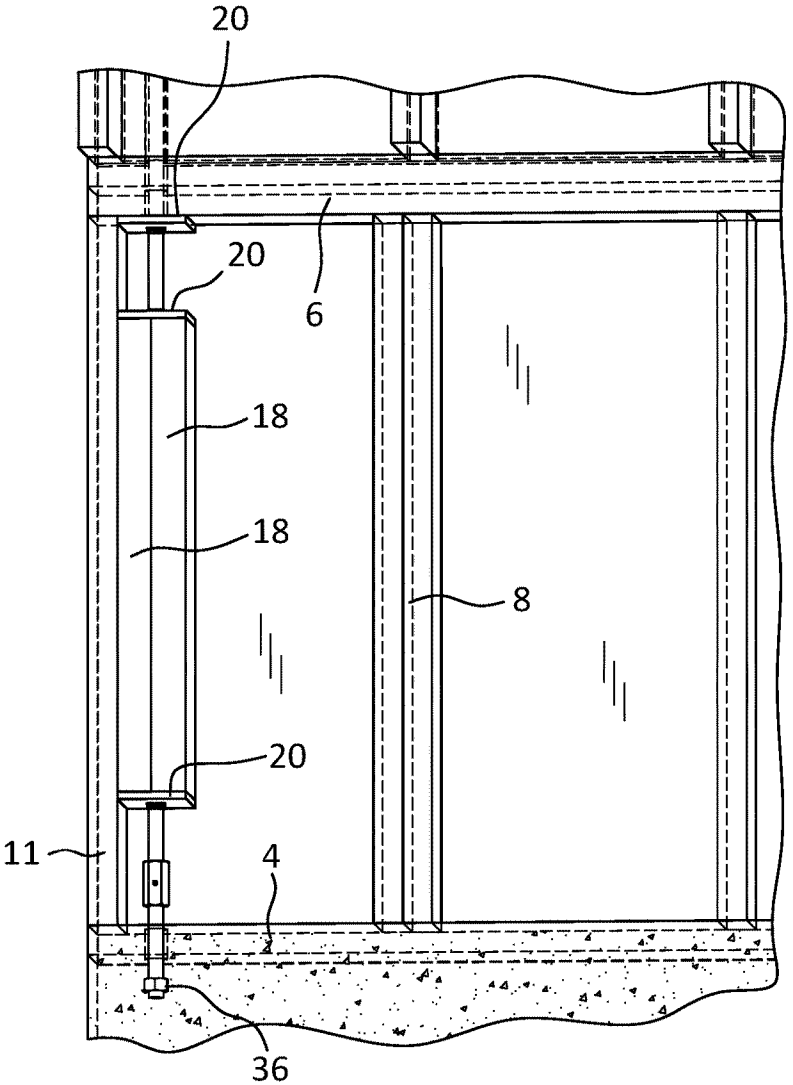
Figure 18A:
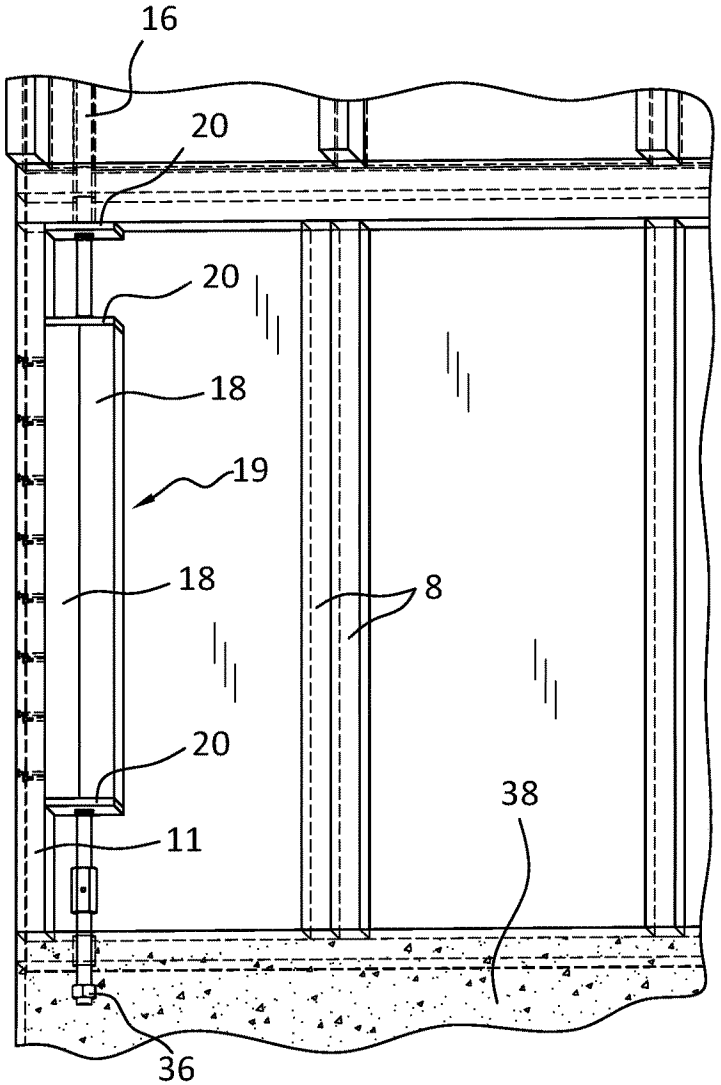

Referring to FIG. 18A, the configuration shown in FIG. 17C is modified by moving the adjacent stud 11 to the other side of the members 18. Nails and/or screws 40 and/or adhesives and/or other standard means operably attach the block 19 to the adjacent stud 11. The attachment advantageously aids in sharing compression loading between the members 18 and the adjacent stud 11.

Referring to FIG. 18B, the members 18 are not attached to the adjacent stud 11. Compression loading is not shared between the adjacent stud 11 and the members 18. Compression loading from the top plate 6 is transferred to the top bearing plate 20 directly underneath the top plate 6 and thence to the tie rod 16 and then distributed to the upper bearing plate 20 on top of the members 18, the members 18, and the tie rod inside the members 18 and then collected at the lower bearing plate 20 and transferred to the lower portion of tie rod 16.

Figure 19:
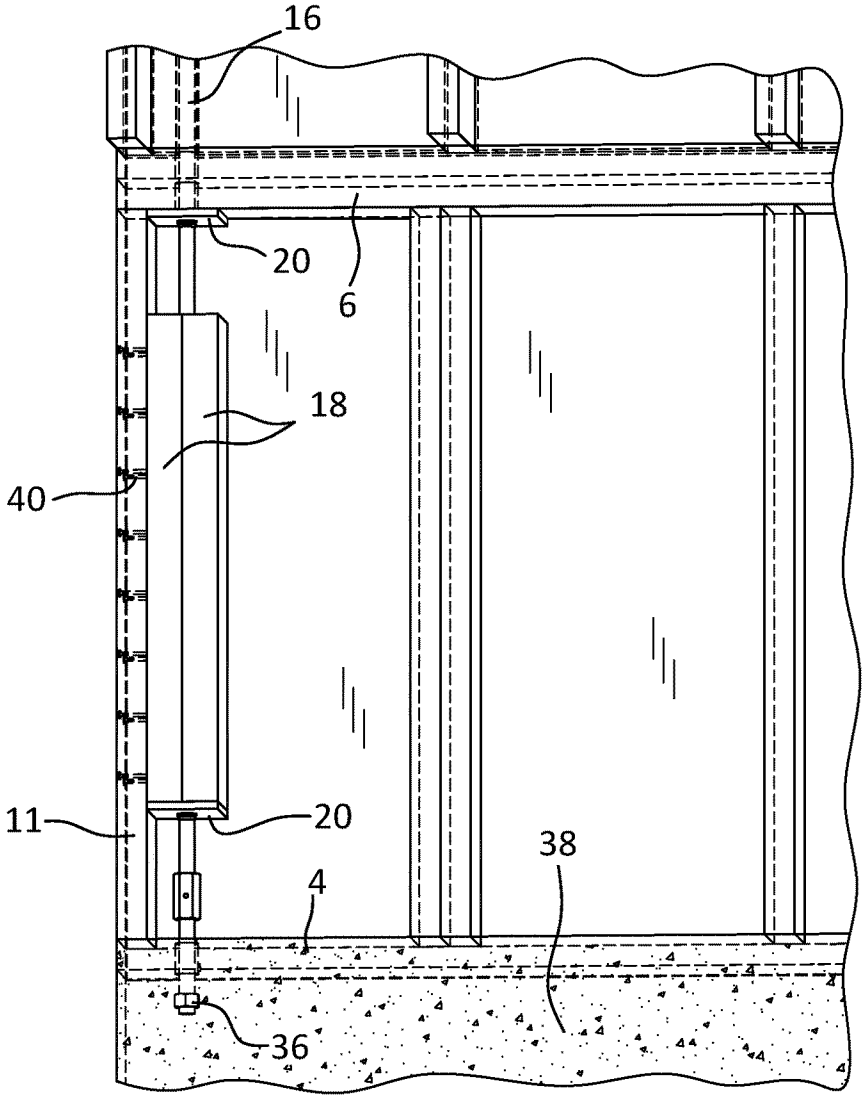

Referring to FIG. 19, the upper bearing plate 20 shown in FIG. 18A disposed on the top ends of the members 18 is not used. Compression loading from the top plate 6 is transferred directly from the upper bearing plate 20 to the tie rod 16 and to the foundation via the anchor 36. Compression loading on the adjacent stud 11 is shared with the members 18 and the tie rod 16 via the lower bearing plate 20.

It should be understood that the block 19 in various positions shown above, may include a bearing plate 20 on the top end of the block 19, or a bearing plate at the bottom of the block 19 or an upper bearing plate and a lower bearing plate on the top end and the bottom end of the block 19, respectively.

Figure 20A:
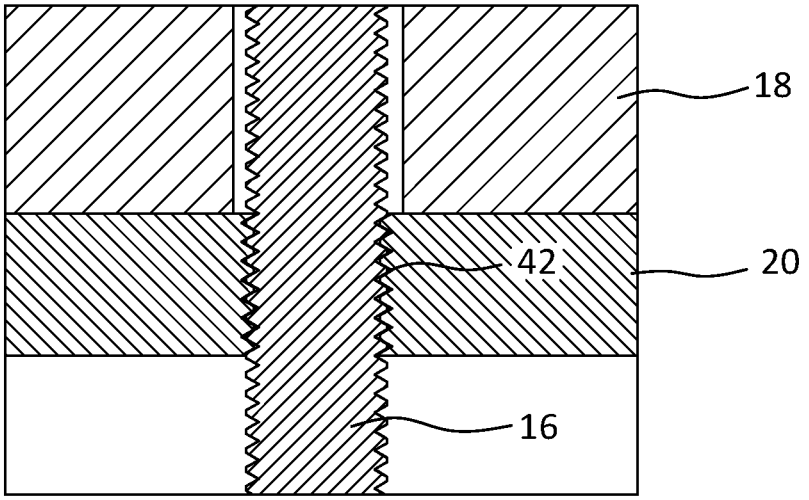
FIGS. 20A-20C show various ways of attaching a bearing plate to tie rod.
Figure 20B:
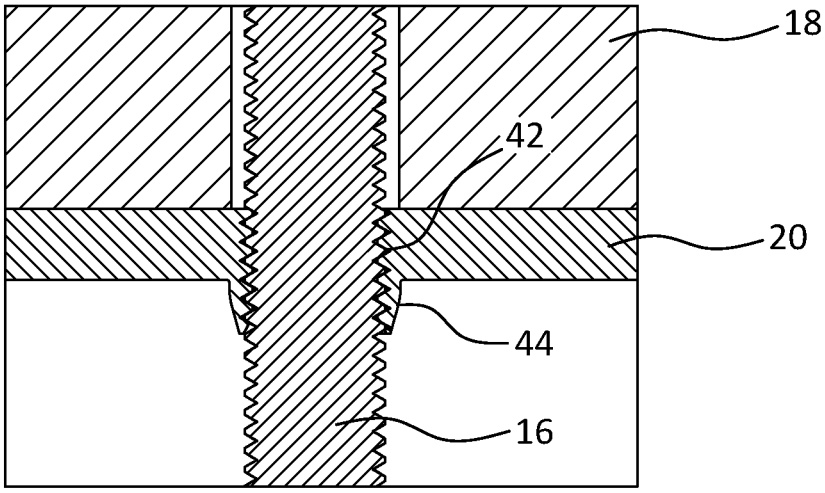
Figure 20C:
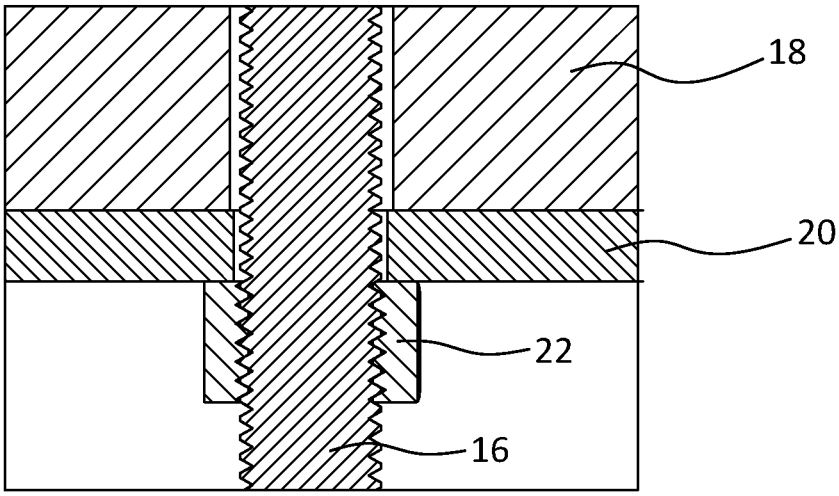

Referring to FIGS. 20A, 20B and 20C, the bearing plate 20 shown attached to the tie rod 16 at the top and bottom of the members 18 and underneath the top plate 6 may be attached in different ways. Referring to FIG. 20A, the bearing plate 20 has a threaded opening 42 for threaded engagement to the threaded portion of the tie rod 16. Referring to FIG. 20B, the threaded opening 42 has a threaded boss extension 44 to advantageously provide additional thread engagement with the tie rod 16. Threaded openings with threaded boss extensions are disclosed in U.S. Pat. No. 10,538,910, hereby incorporated herein by reference. Referring to FIG. 20C, a nut 22 secures the bearing plate 20 to the tie rod 16. Other ways of attaching the bearing plate 20 to the tie rod 16 may be used, such as welding the tie rod to the bearing plate and bonding the tie road to the bearing plate with epoxy or glue. The tie rod 16 may be smooth or threaded where it is welded or bonded to the bearing plate. The tie rod 16 may also be a standard rebar. Although the bearing plate 20 is shown at the bottom of the members 18, it should be understood that the attachment methods shown are equally applicable to attaching the upper bearing plate 20 to the tie rod 16 when the bearing plate is disposed on the top ends of the members 18.

Figure 21A:
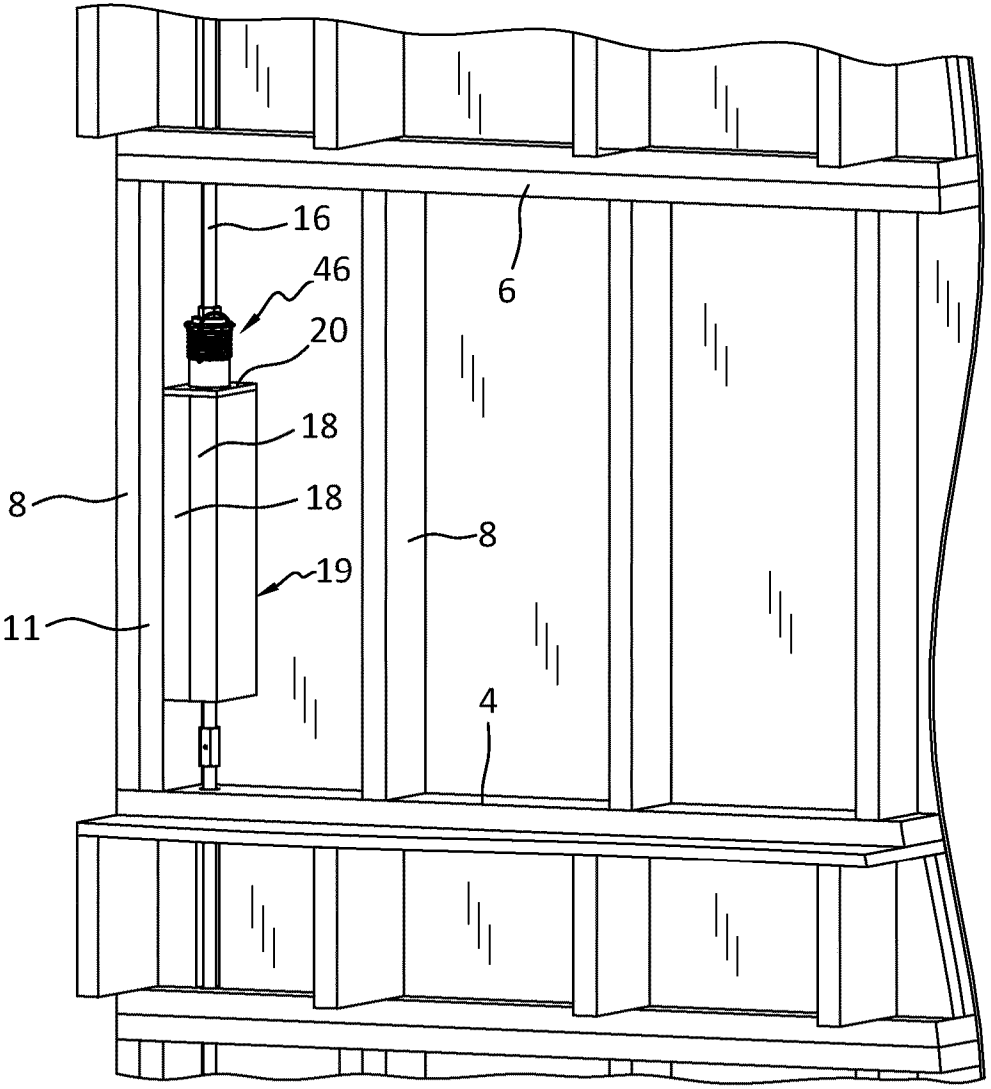
FIGS. 21A-21C show an expandable connector and nailing or screwing pattern for attaching the reinforcement members encasing the tie rod to the wall structure.

Referring to FIG. 21A, an expandable connector 46 is used to secure the upper bearing plate 20 to the members 18. The connector 46 will expand when slack develops in the tie rod 16 to maintain pressure on the bearing plate 20. Slack develops from wall shrinkage due to wall settlement, wood drying up or the weight of the upper walls pressing on the lower walls. The connector 46 is well known in the art. For example, U.S. Pat. Nos. 8,136,318, 8,186,924, 6,161,350, US 2005/0055897 and U.S. Pat. No. 6,585,469 disclose expandable connectors and are hereby incorporated by reference.

The members 18 are operably attached with nails and/or screws and/or adhesives and/or other standard means to the adjacent stud 11, which may be reinforced with another stud 8. Compression loading on the tie rod 16 is transferred to the bearing plate 20 via the connector 46. The load is then shared with the studs 8 and 11, advantageously decreasing the downstream load on the tie rod 16. Lesser compression loading on the tie rod advantageously allows the use of a smaller size tie rod and reduces bending or bowing.

Figure 21C:
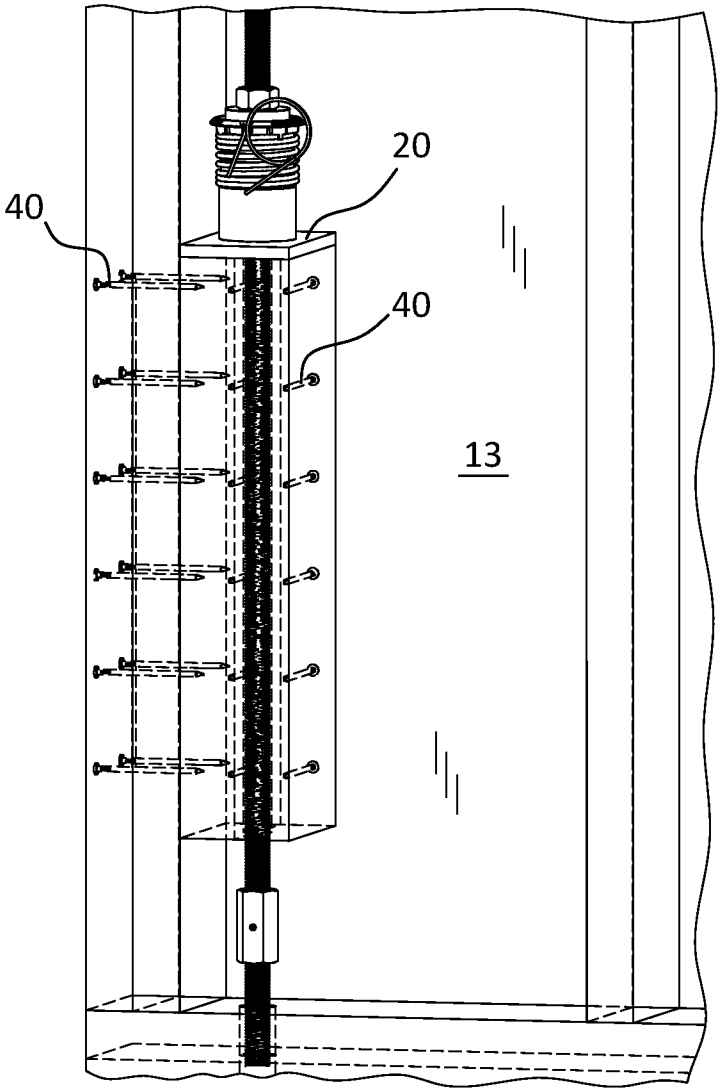
Figure 21B:
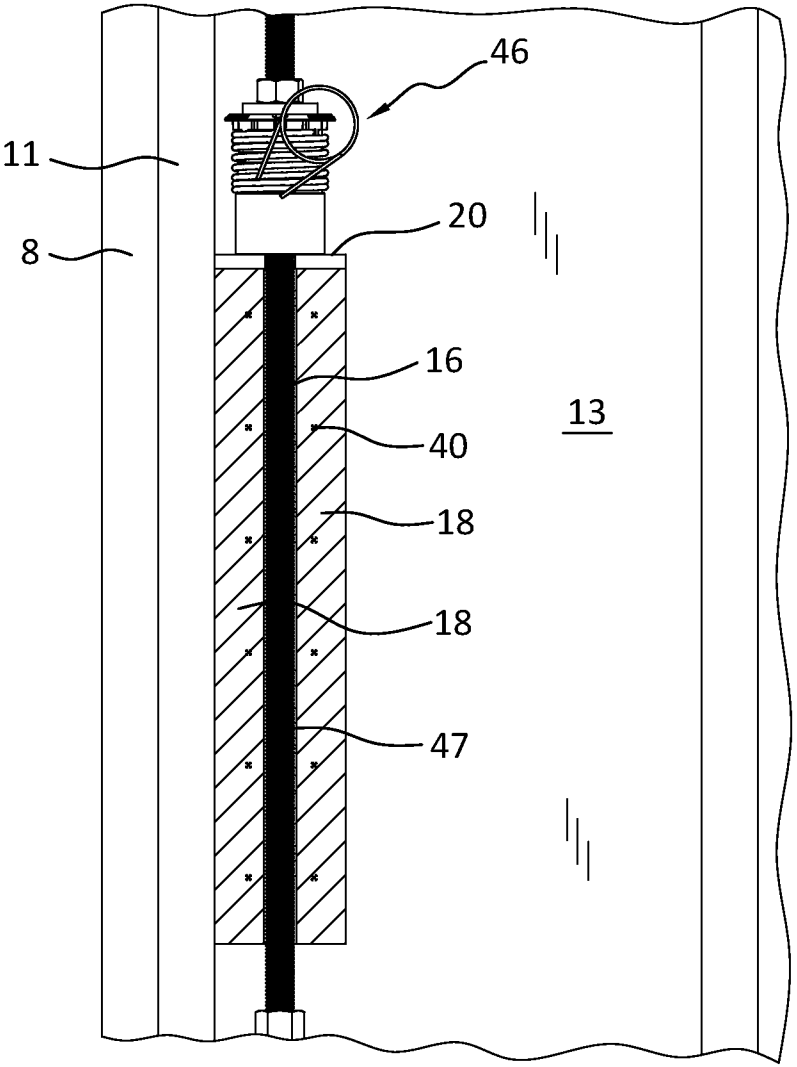

Referring to FIGS. 21B and 21C, the tie rod 16 is not attached to the bearing plate 20, allowing the tie rod to move relative to the members 18 in response to the wall shrinkage. The members 18 are operably attached with nails and/or screws 40 and/or adhesives and/or standard means to the adjacent stud 11 and the reinforcement stud 8. The members 18 are also attached with nails and/or screws 40 and/or adhesives and/or other standard means to the wall sheathing 13. The opening 47 through the block 19 is preferably sized to allow the tie rod 16 to move relative to the block 19 in response to the expansion of the expandable connector 46.

Figures 22A, 22B, 22C:
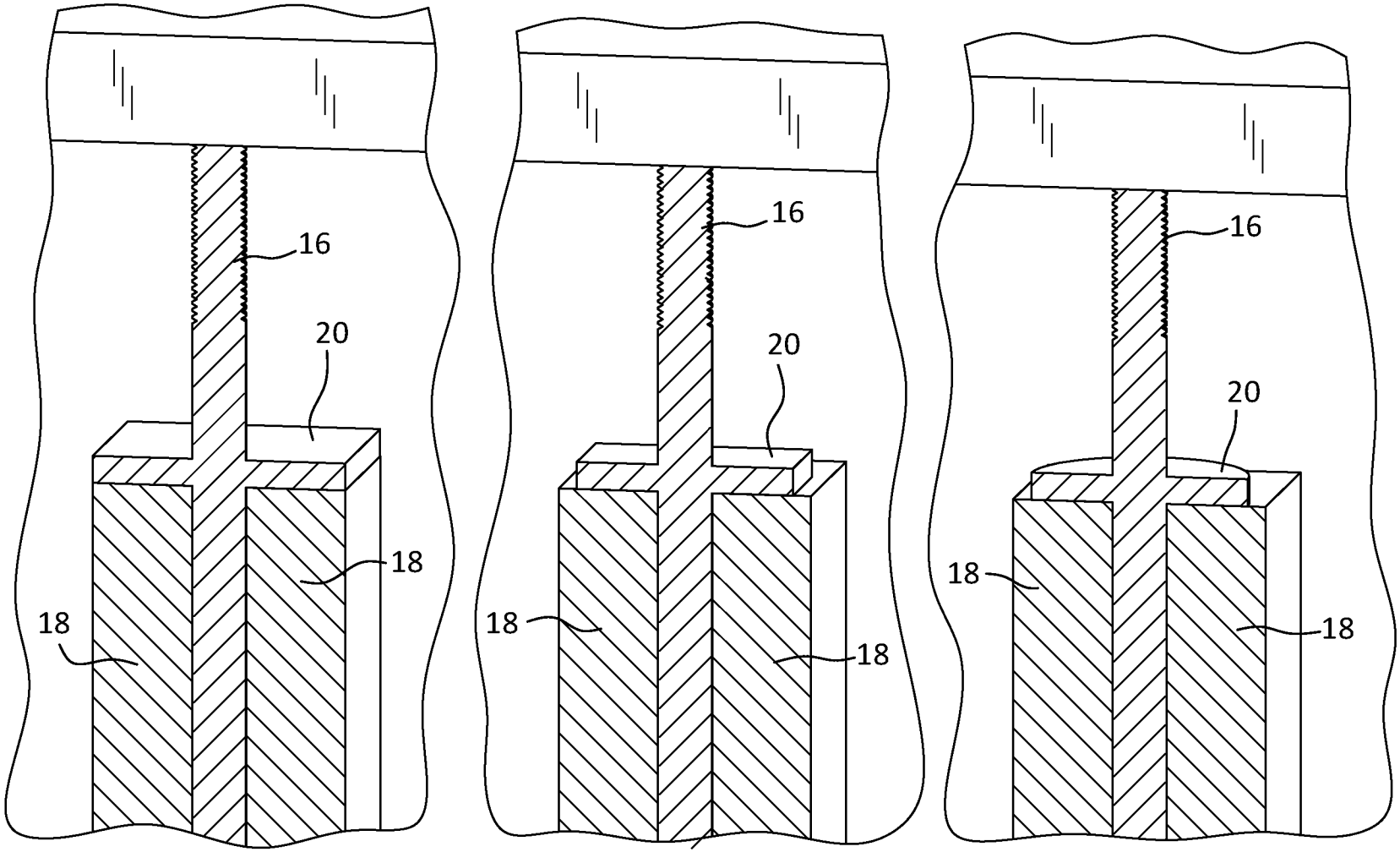

Referring to FIGS. 22A, 22B and 22C, the bearing plate 20 may be integral with the tie rod 16. The bearing plate 20 and the tie rod 16 are made as one piece, thereby eliminating the need to attach the bearing plate to the tie rod during installation. The bearing plate 20 may have the same rectangular shape and size as the ends of the members 18, as shown in FIG. 22A. The bearing plate 20 may be a smaller rectangular size than the ends of the members 18, as shown in FIG. 22B. The bearing plate 20 may be circular, as shown in FIG. 22C. The different shapes and sizes of the bearing plate 20 depend on the expected compression loading and the need to distribute the load over the ends of the members 18 without crushing the members 18.

Figure 23B:
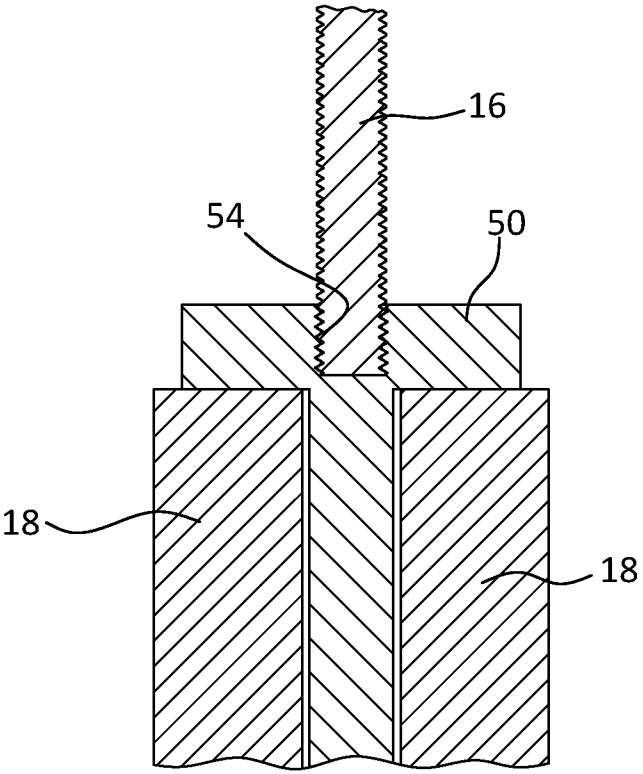
Figure 23A:
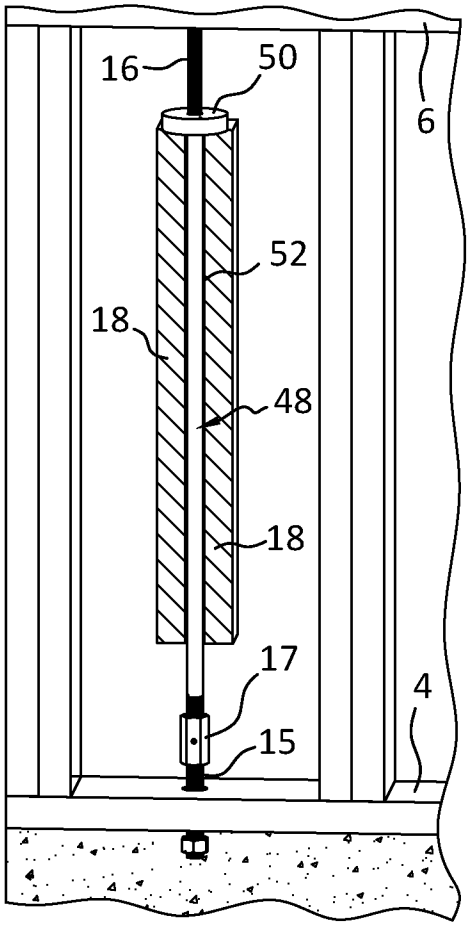

Referring to FIGS. 23A and 23B, the bearing plate 20 is integrated into a threaded rod 48 with a head portion 50 and a rod portion 52. The rod portion 52 is encased in the members 18 and is attached to the anchor rod 15 with the coupler 17. The head portion 50 includes a threaded bore 54 into which a tie rod 16 is threaded.

Figure 24B:
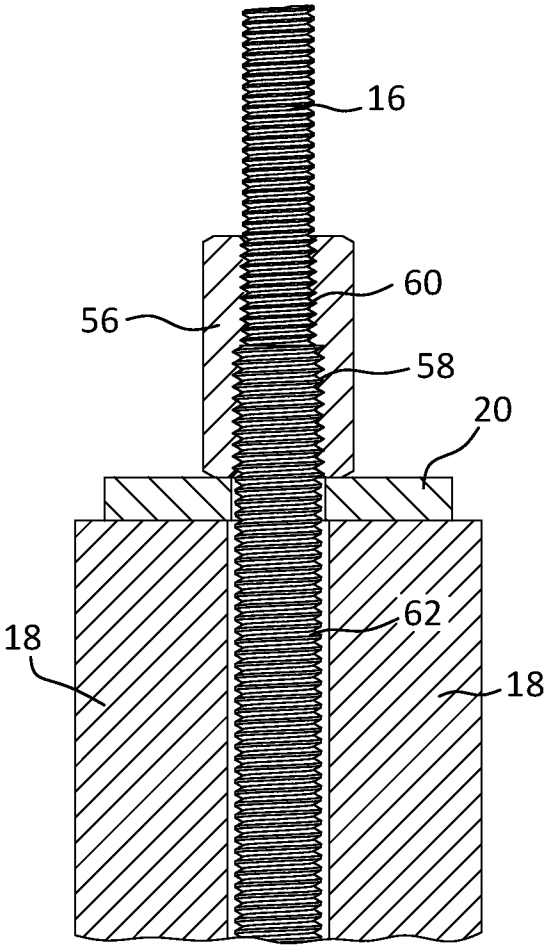
Figure 24A:
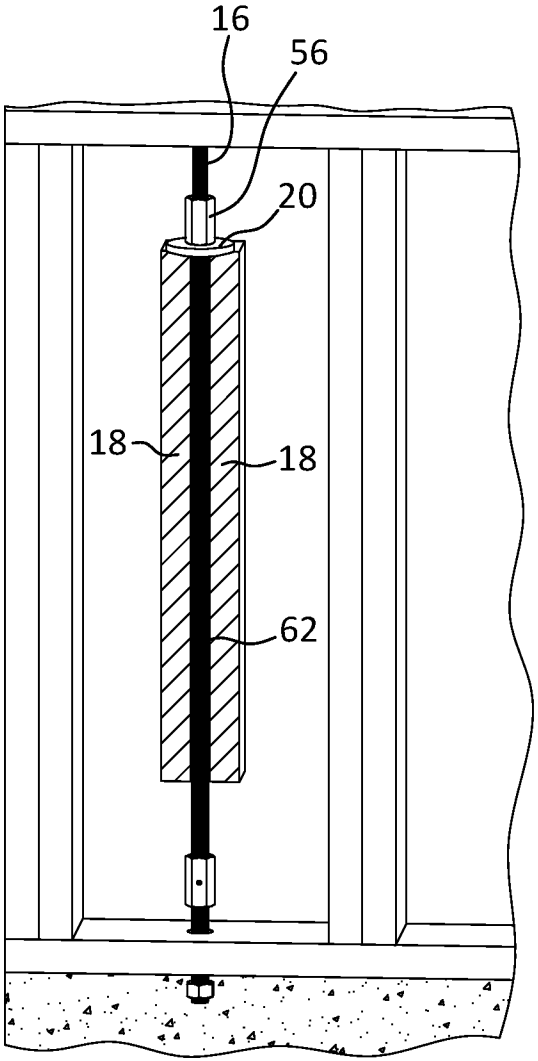

Referring to FIGS. 24A and 24B, a coupler 56 is used to attach the bearing plate 20 to the tie rod 16. The coupler 56 includes a threaded opening 58 and another threaded opening 60, which is smaller in diameter than the threaded opening 58. The coupler 56 advantageously permits the use of a smaller diameter tie rod 16 from the shorter tie rod 61, depending on the expected load on the tie rod 16. The bearing plate 20 is preferably not threaded to the tie rod 61 in this particular embodiment due to the use of the coupler 56. The bearing plate 20 is shown as circular but it may take on other shapes, such as rectangular, square, hexagonal, etc.

Figure 25A:
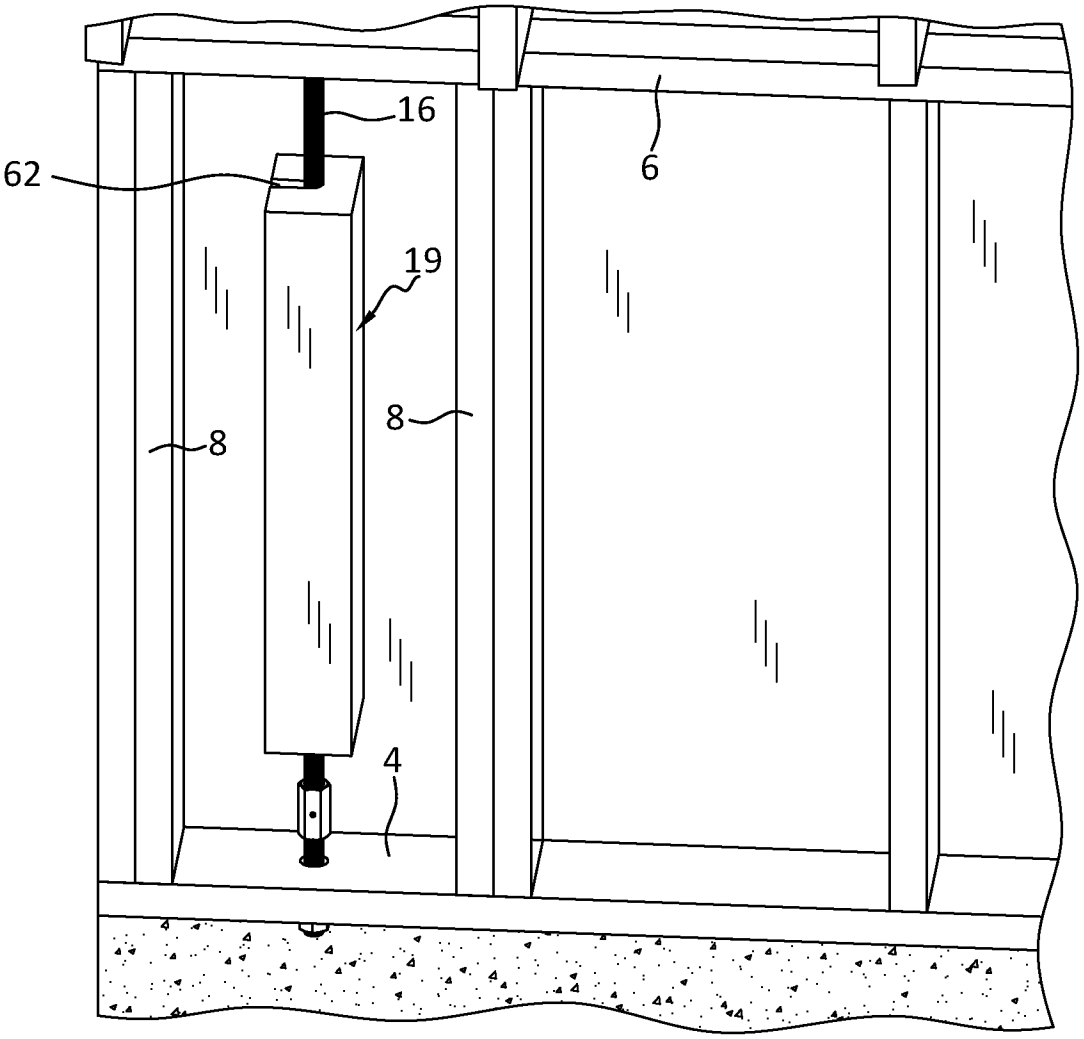
FIGS. 25A-27B show a reinforced building wall using a one-piece reinforcement member for providing increasing the rigidity to the tie rod.
Figure 25B:
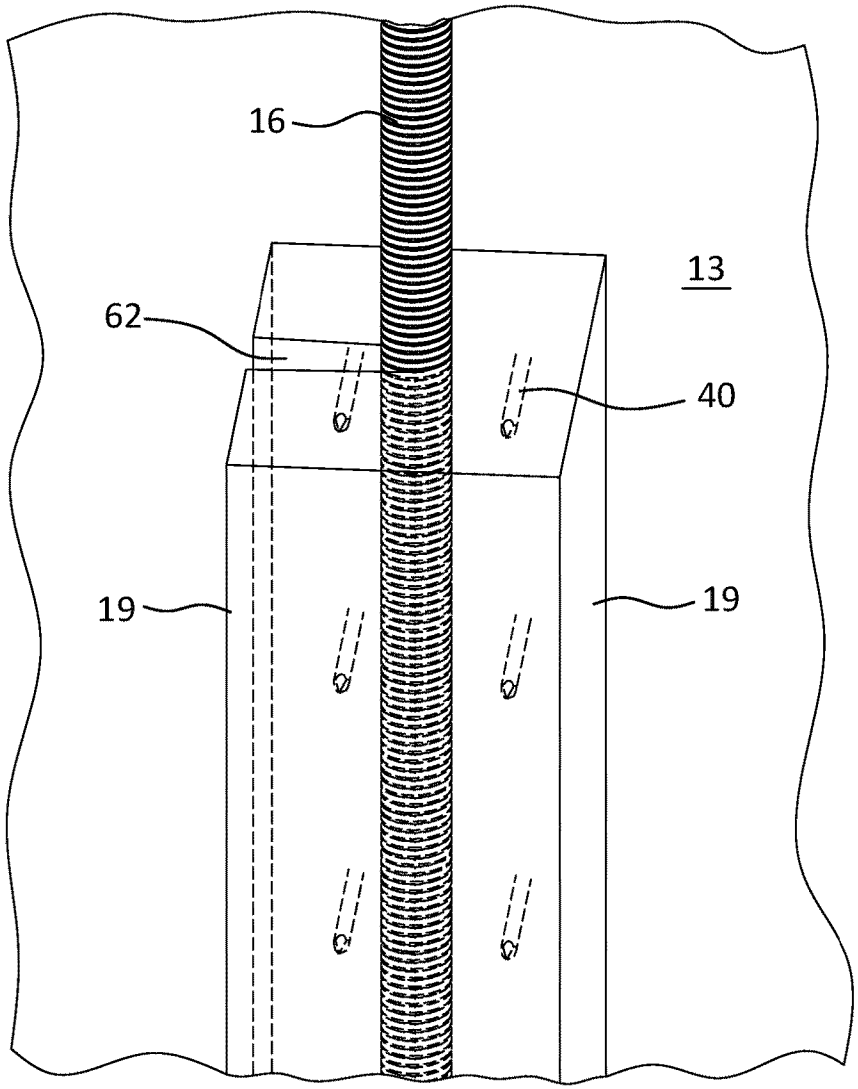
Figure 25C:
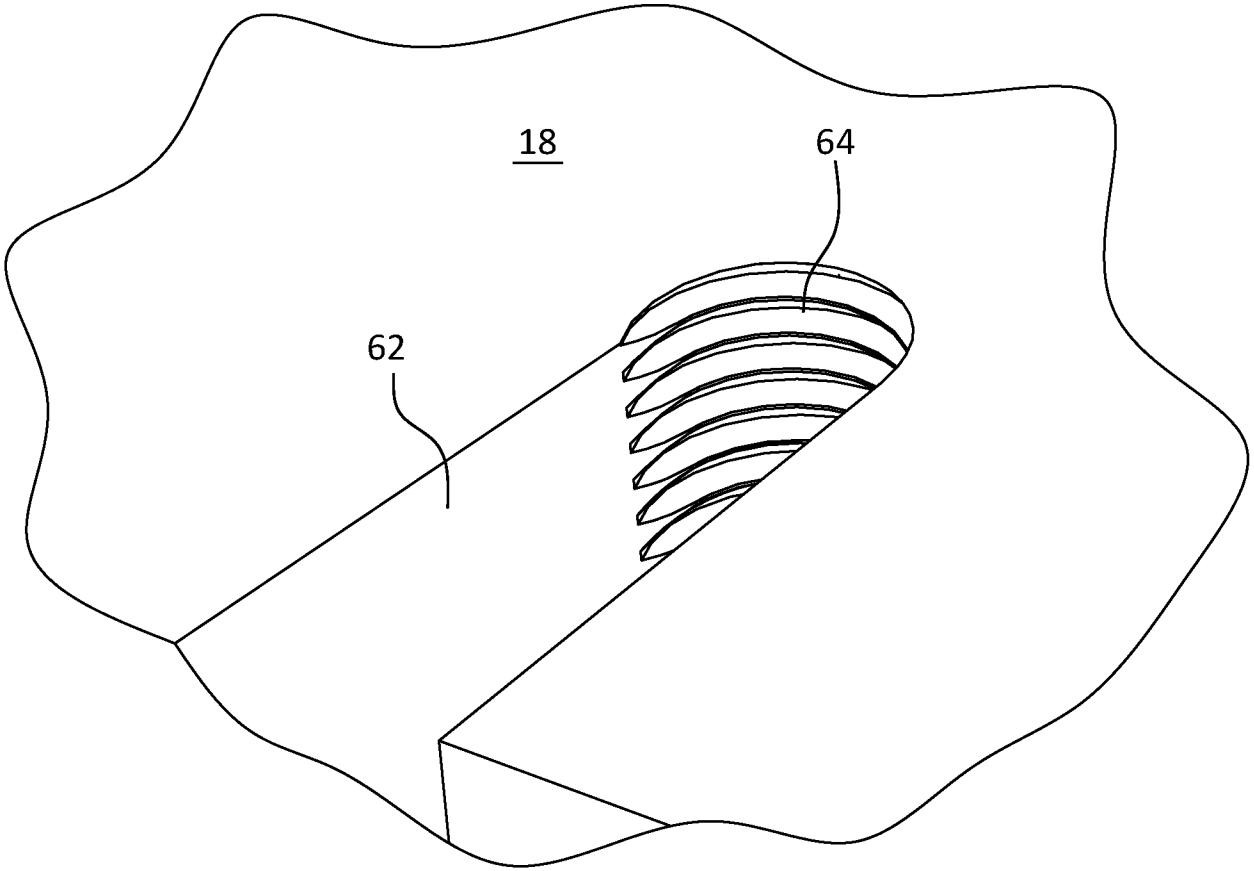

Referring to FIGS. 25A-25C, the block 19 is made of one piece of lumber. A longitudinal slot 62 runs along the length of the block 19. Nails and/or screws 40 and/or adhesives and/or other standard means are used to attach the block 19 to the wall sheathing 13. The nails or screws 40 are preferably arrayed in two vertical columns along the length of the block 19 (see also FIGS. 21B and 21C). The nails or screws in one column cross the slot 62, advantageously trapping the tie rod 16 inside the slot 62. The slot 62 is preferably sized for interference fit with the tie rod 16. The tie rod 16 is preferably pressed into the end of the slot 62 to generate an impression 64 of the thread of the tie rod 16 in the wood block 19. The interference fit of the tie rod 16 in the slot 62 and the mating of the tie rod thread in the thread impression 64 advantageously hold the tie rod in place. Adhesive may be used to bond the tie rod to the thread impression 64.

Figure 26A:
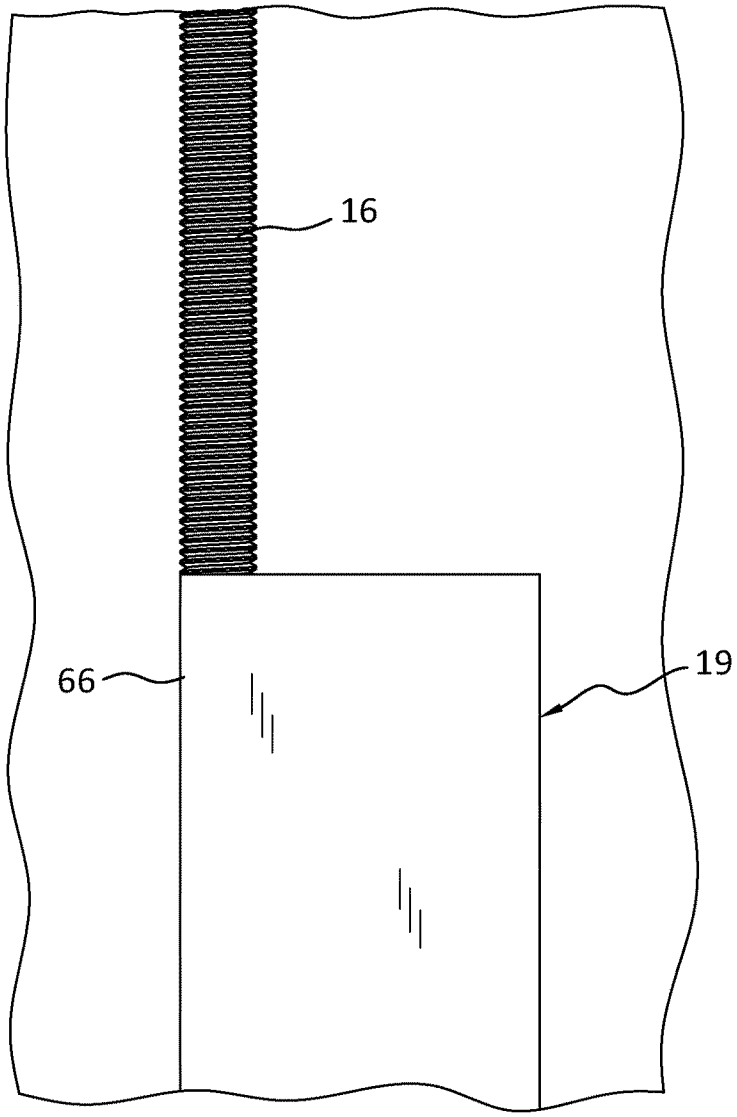
Figure 26B:
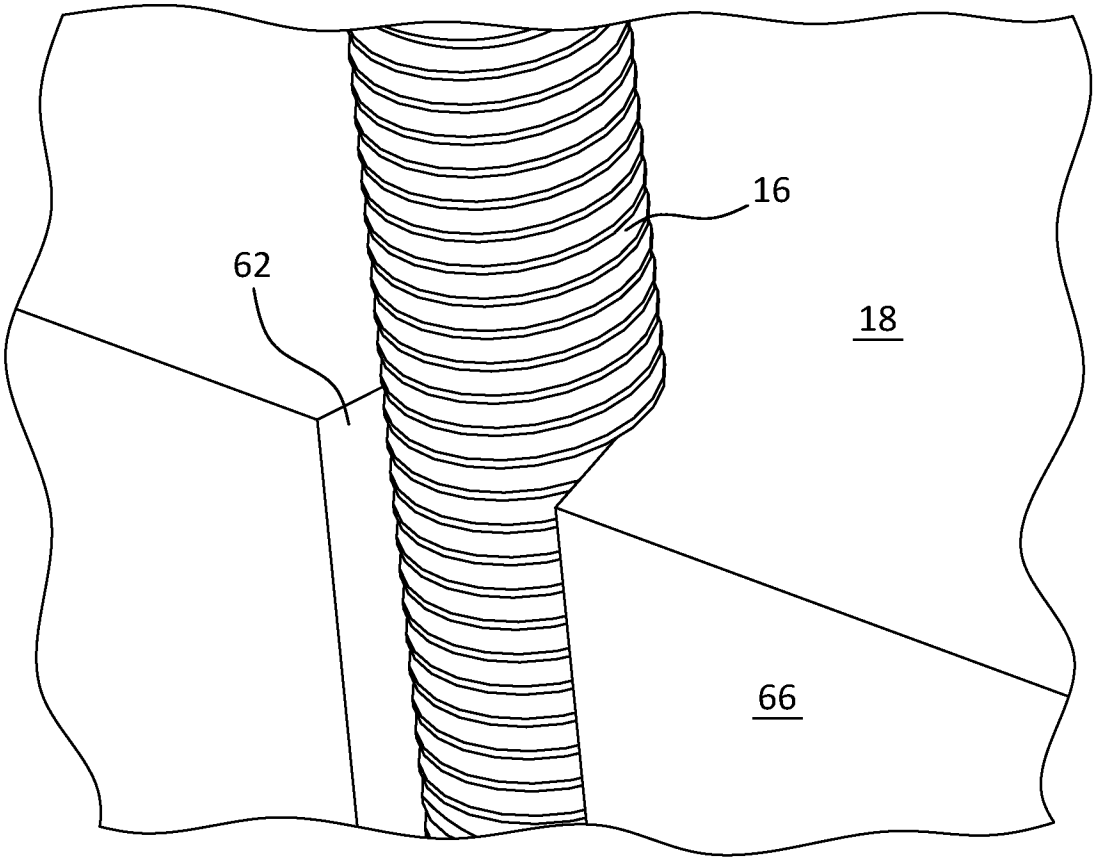

Referring to FIGS. 26A and 26B, the block 19 may be of one piece of lumber or two reinforcement members 18 joined together. The slot 62 is of sufficient depth so that when the tie rod 16 is pressed into the slot 62 to create the thread impression 64 in the reinforcement member 18, the outer diameter of the tie rod 16 will be flush with vertical surface or face 66 of the member 18. The slot 62 is sized for interference fit with the tie rod 16. The interference fit of the tie rod 16 in the slot 62 and the mating of the tie rod thread in the thread impression 64 advantageously hold the tie rod in place. Adhesives may be used to bond the tie rod to the block 19.

Figure 27A:
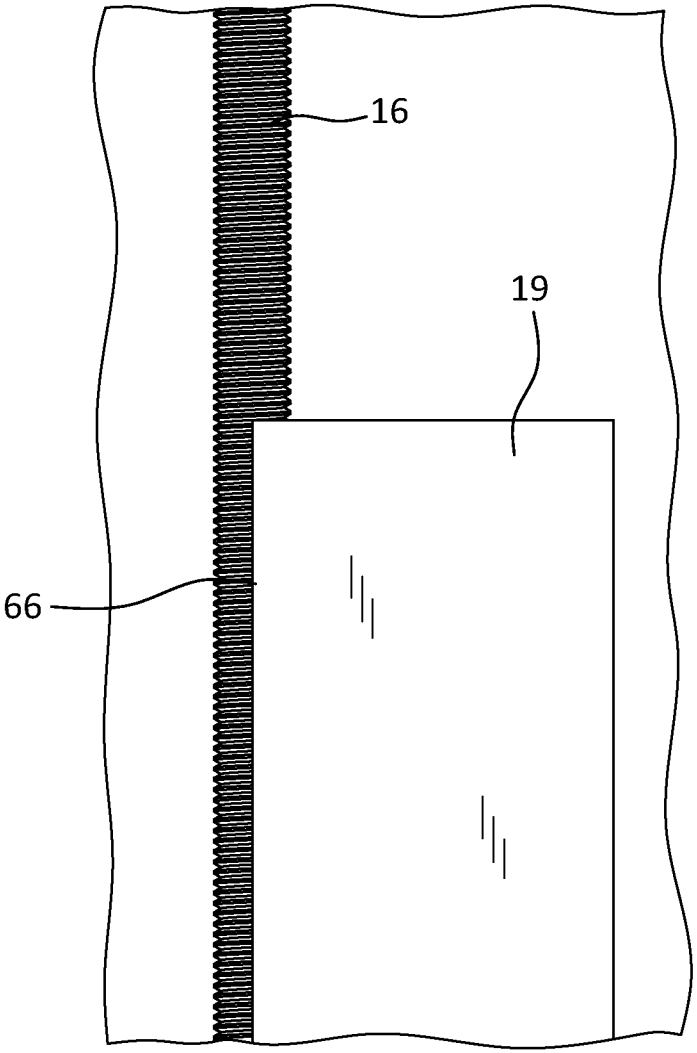
Figure 27B:
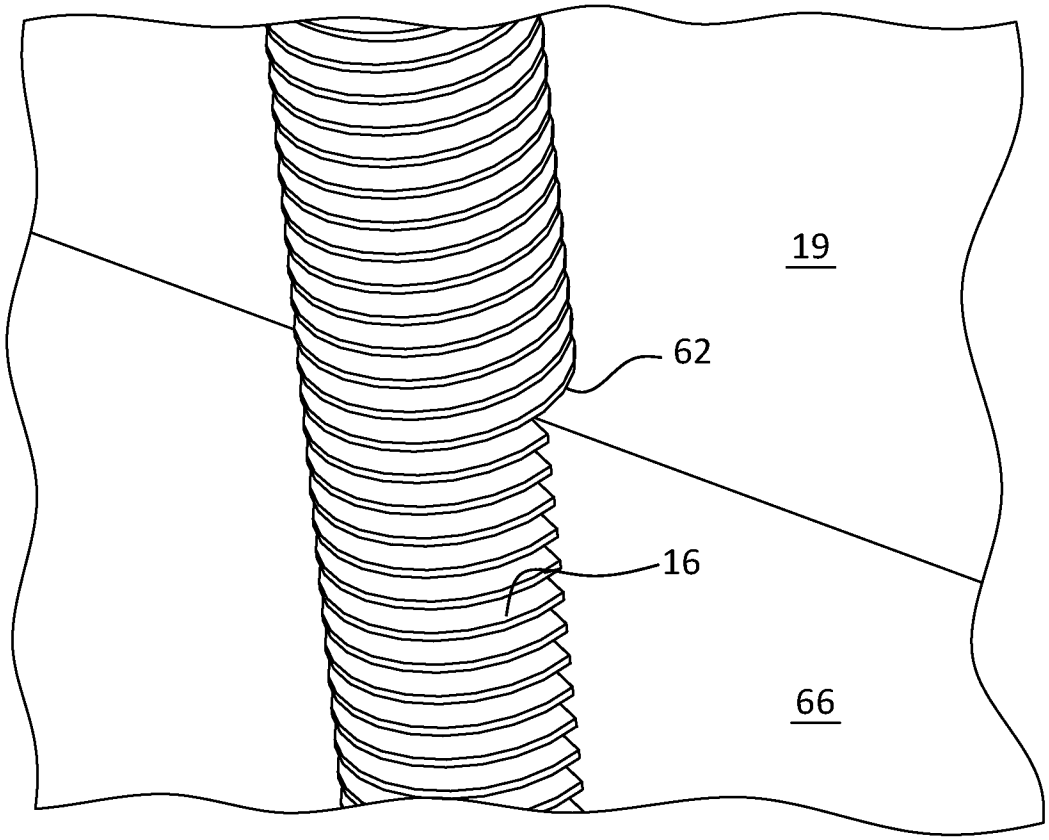

Referring to FIGS. 27A and 27B, the depth of the slot 62 shown in FIG. 26B is modified so that when the tie rod 16 is pressed into the slot 62 to create the thread impression 64 in the reinforcement member 18, the diameter of the tie rod 16 will extend out from the vertical surface or face 66 of the member 18. The slot 62 is sized for interference fit with the tie rod 16. The depth of the slot 62 is preferably such as to allow half or less of the outer diameter of the tie rod to extend out from the face 66. The interference fit of the tie rod 16 in the slot 62 and the mating of the tie rod thread in the thread impression 64 advantageously hold the tie rod in place. Adhesives may be used to bond the tie rod to the block 19.

Figure 28:
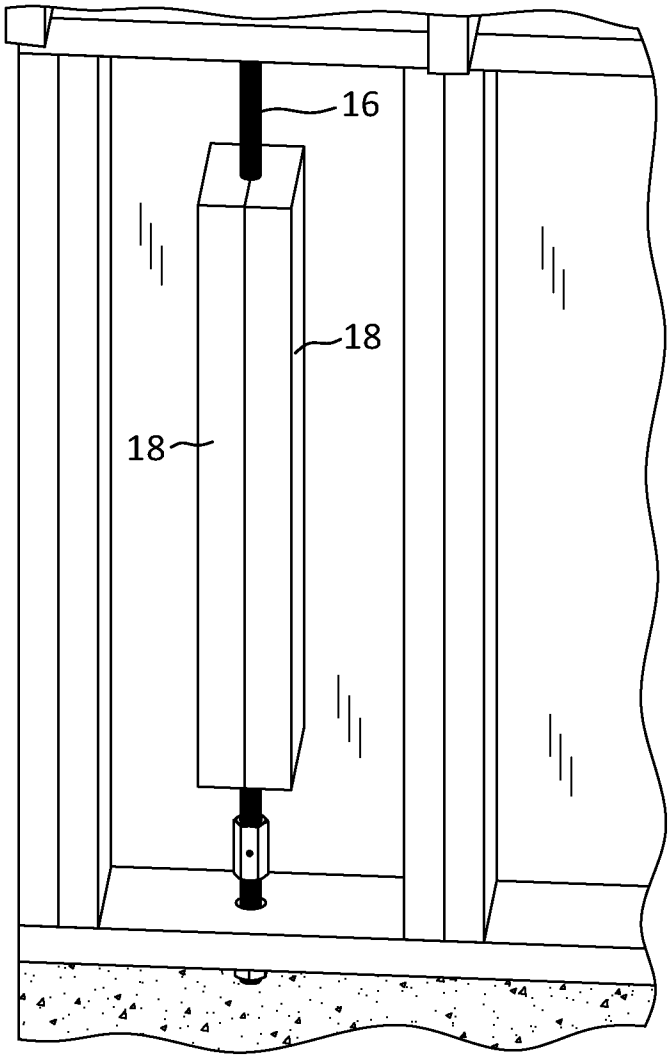
FIG. 28 shows two reinforcement members pressed together around the tie rod, creating thread impressions in the reinforcement members.

Referring to FIG. 28, the two members 18 are pressed together around the tie rod 16 to the create the thread impression 64 on each of the members 18. Each of the members may include the slot 62 shown in FIG. 27B.

Figure 29B:
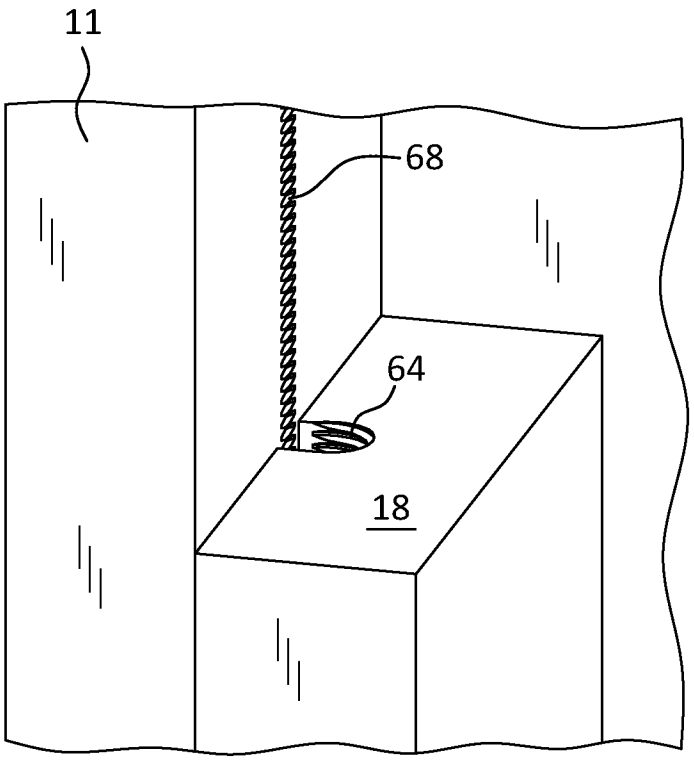
FIGS. 29A-29C show reinforcement members pressed against the tie rod and the respective studs in a multi-story building wall.
Figure 29A:
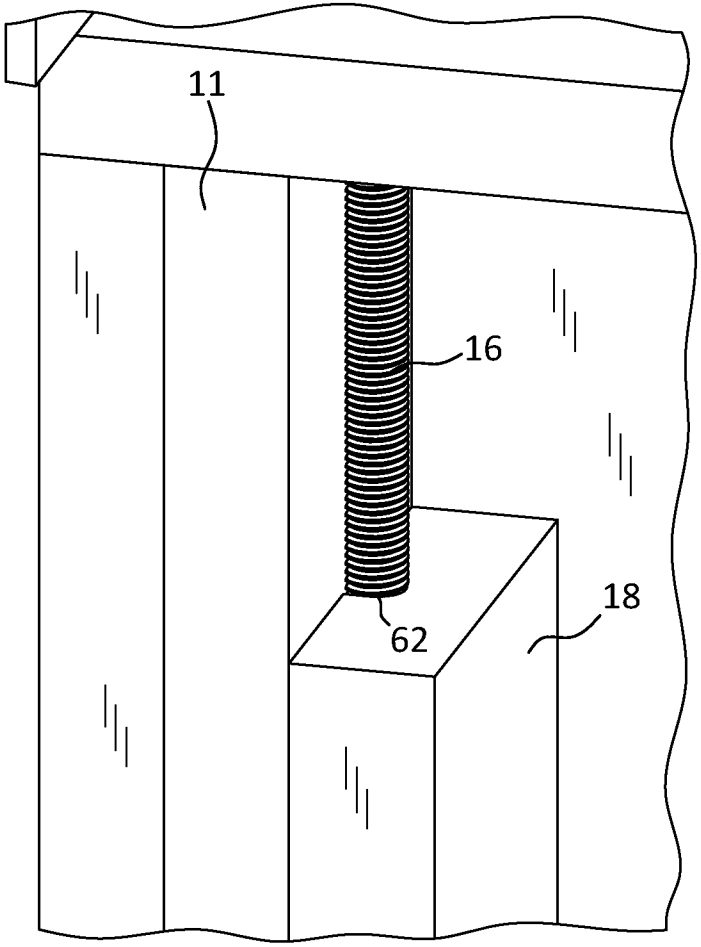
Figure 29C:
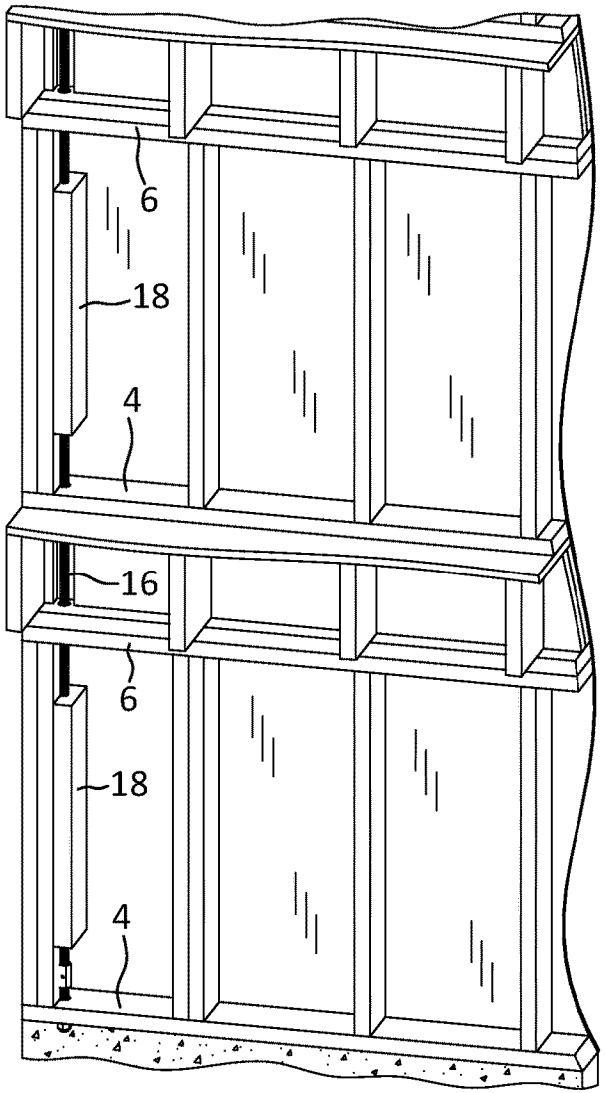

Referring to FIGS. 29A-29C, the slot 62 shown in FIG. 27B is made deeper so that the tie rod 16 extends out less than one half of the diameter of the tie rod 16. The member 18 is operably attached to the adjacent stud 11 and the wall sheathing 13 with nails and/or screws and/or adhesives and/or other standard means. The tie rod 16 is pressed against the adjacent stud 11 to create thread impression 68. The thread impression 68 advantageously provide additional contact areas between the adjacent stud 11 and the tie rod 16 for load sharing. The member 18 may also be installed in the upper floor, as shown in FIG. 29C.

Figure 30B:
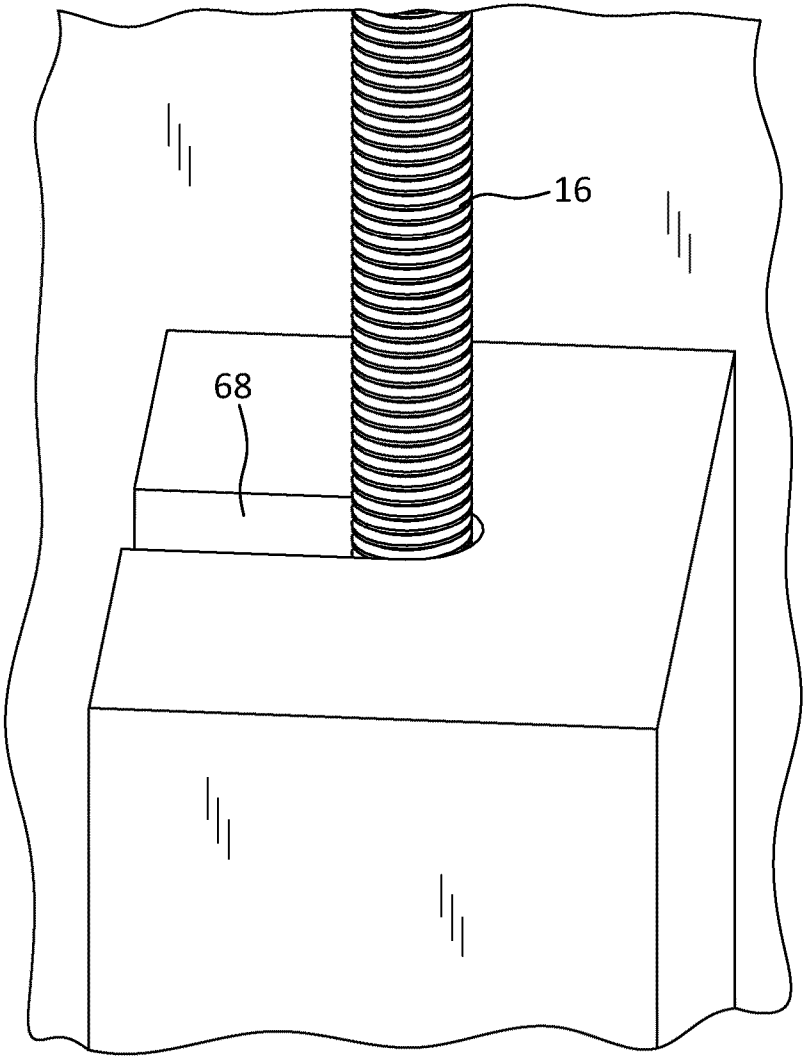
FIGS. 30A and 30B show a multi-story building wall with a lower reinforcement member installed in a lower wall and an upper reinforcement member in an upper wall, both reinforcement members being operably associated with the tie rod.
Figure 30A:
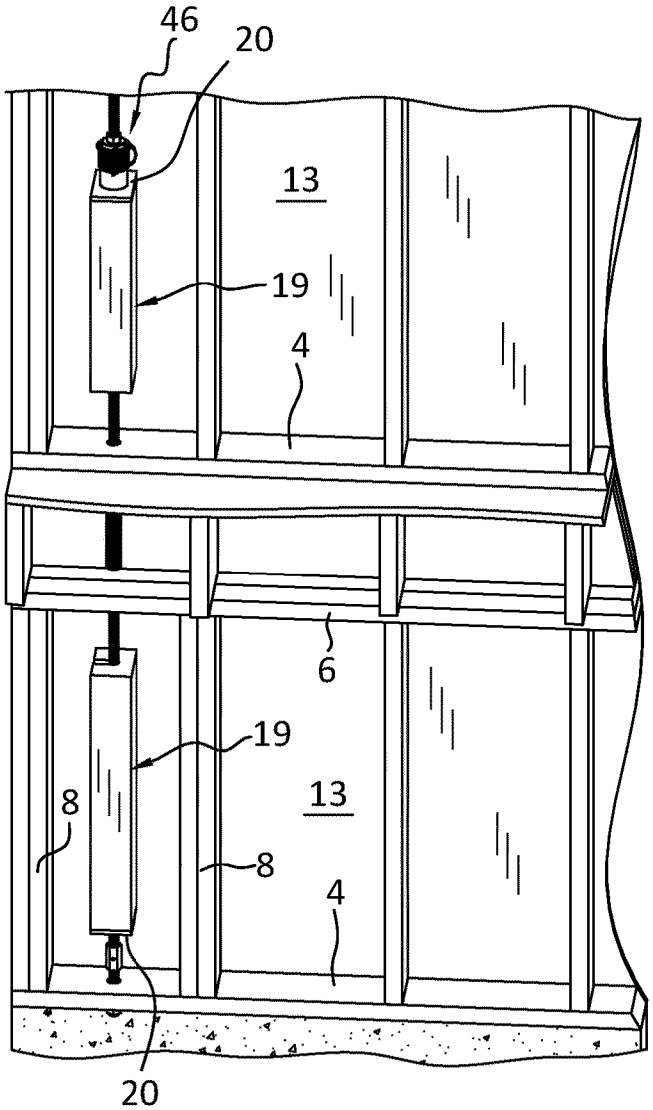

Referring to FIGS. 30A and 30B, a lower block 19 is shown installed in a lower wall and an upper block 19 in an upper wall. The tie rod 16 extends through the lower block 19 in a loose-fitting slot 68. A bearing plate 20 is operably attached to the tie rod 16 at the bottom end of the lower block 19. The lower block 19 is operably attached to the wall sheathing 13 with nails and/or screws and/or adhesives and/or other standard means. Compression loading from the wall sheathing 13 is advantageously transferred to the lower block 19 and thence to the lower bearing plate 20 and the lower portion of the tie rod 16 below the lower bearing plate 20.

A bearing plate 20 is operably attached to the tie rod 16 at the top end of the upper block 19. An expandable connector 46 is operably attached to the tie rod 16 to exert pressure on the bearing plate 20. The opening through the upper block 19 is preferably sized to allow the tie rod 16 to move relative to the block 19 in response to the expansion of the expandable connector 46. The upper block 19 is operably attached to the wall sheathing 13 with nails and/or screws and/or adhesives and/or other standard means.

It should be understood that the lower block 19 and the upper block 19, although shown as solid lumber, may also be made from the reinforcement members 18 joined together as a unit.

Figure 31B:
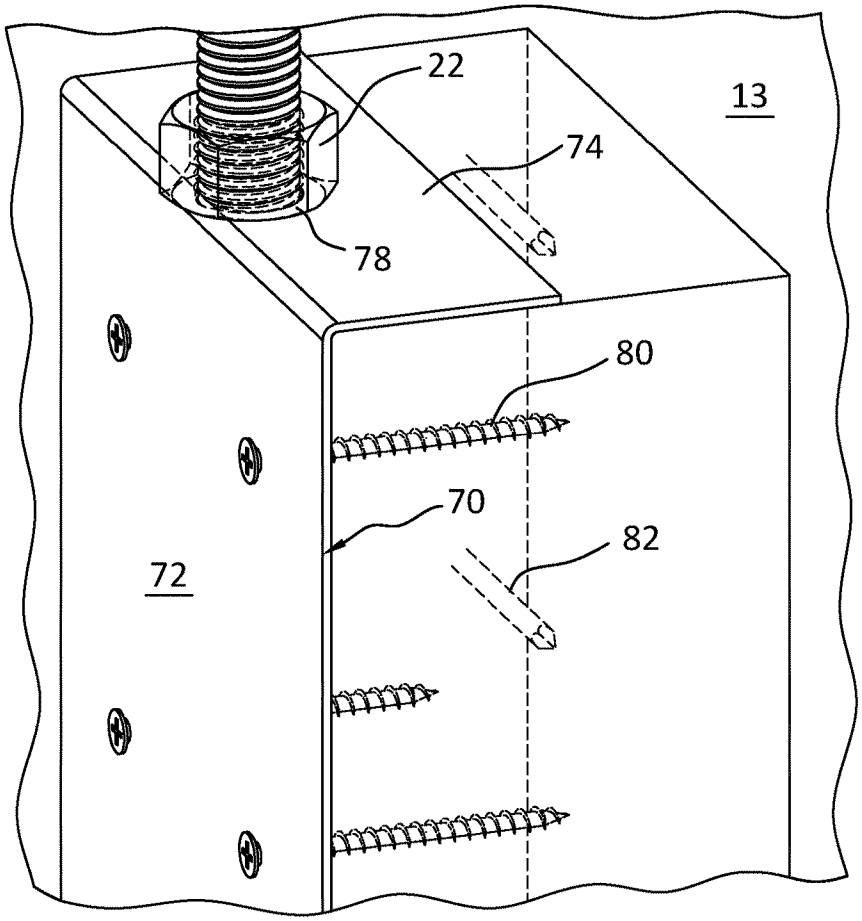
FIGS. 31A-33 show various ways for positioning the tie rod within the reinforcement member.
Figure 31A:
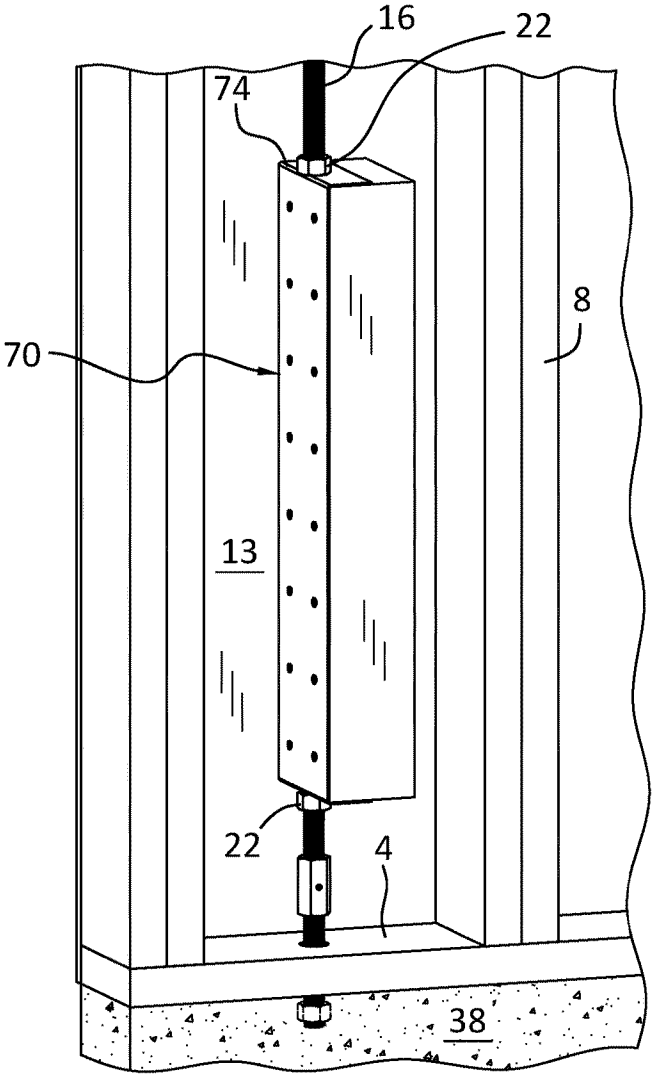
Figure 31E:
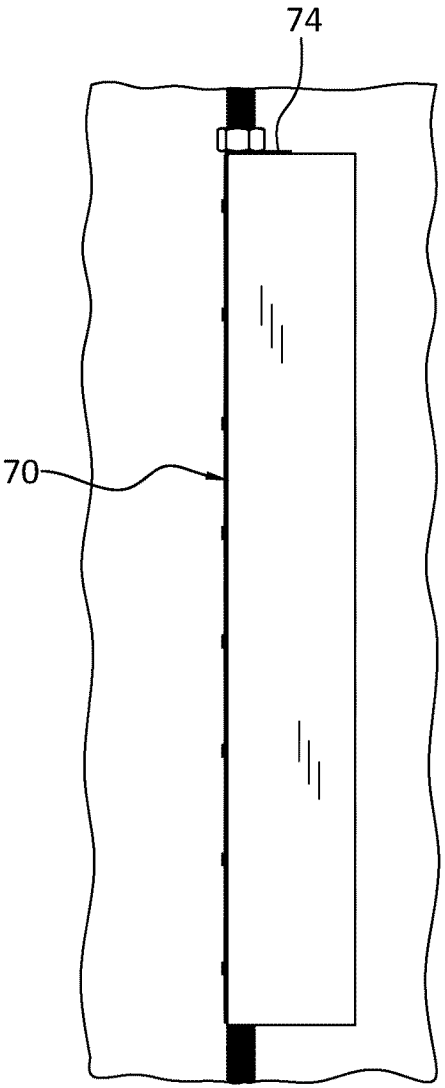
Figure 31D:
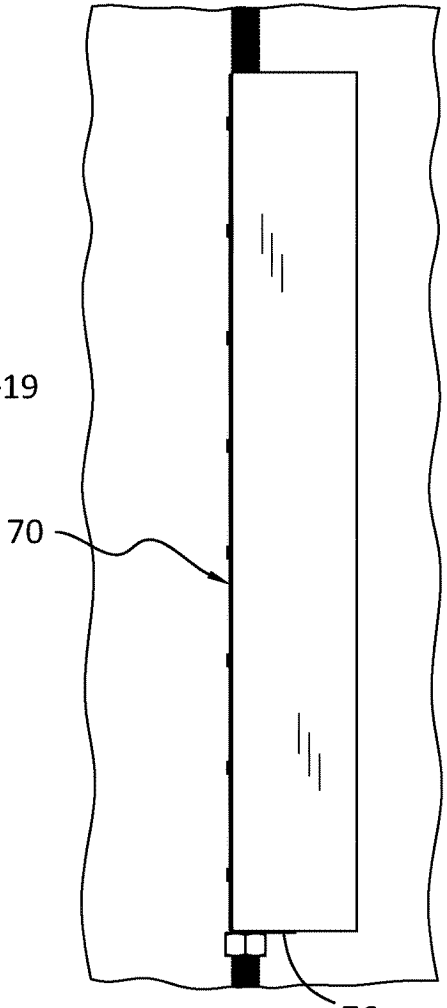
Figure 31C:
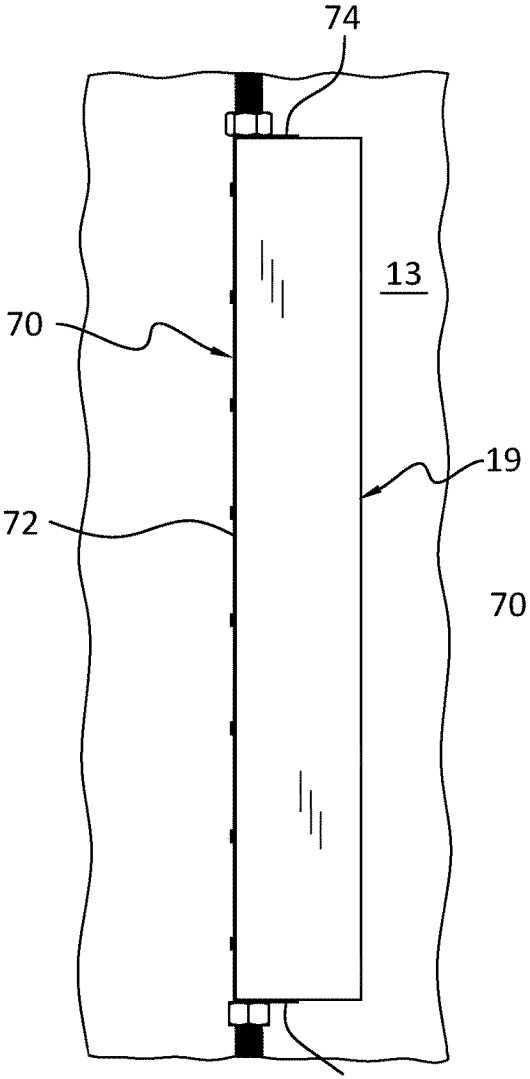

Referring to FIGS. 31A-31C, the configuration shown in FIG. 26A is modified with a bracket 70 with a faceplate portion 72 and a top bearing plate portion 74 and a bottom bearing plate portion 76. The bearing plate portions 74 and 76 have respective openings 78 to allow the tie rod 16 to extend through. Nuts 22 operably attach the bracket 70 to the tie rod 16. Screws 80 and/or nails operably attach the bracket 70 to the block 19. Nails 82 and/or screws operably attach the block 19 to the wall sheathing 13. The bracket 70 is U-shaped.

Referring to FIG. 31D, the top bearing plate portion 74 is not included with the bracket 70. Referring to FIG. 31E, the bottom bearing plate portion 76 is not used. In these configurations, the bracket 70 is L-shaped.

Figure 32B:
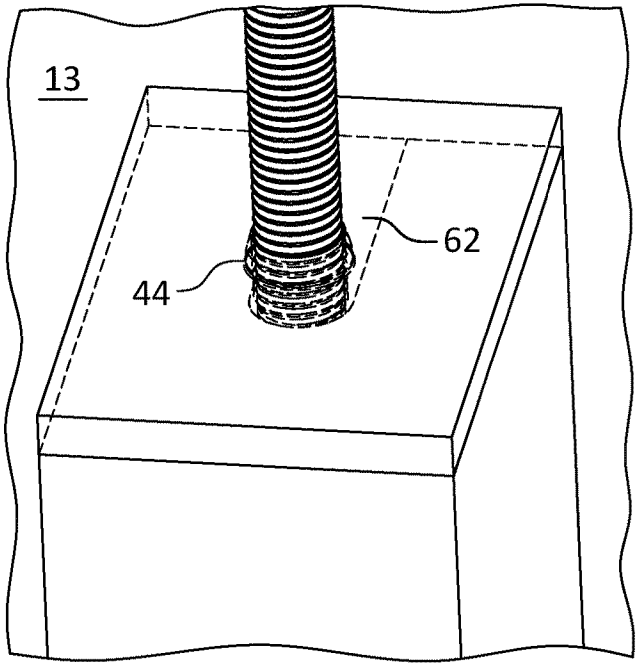
Figure 32A:
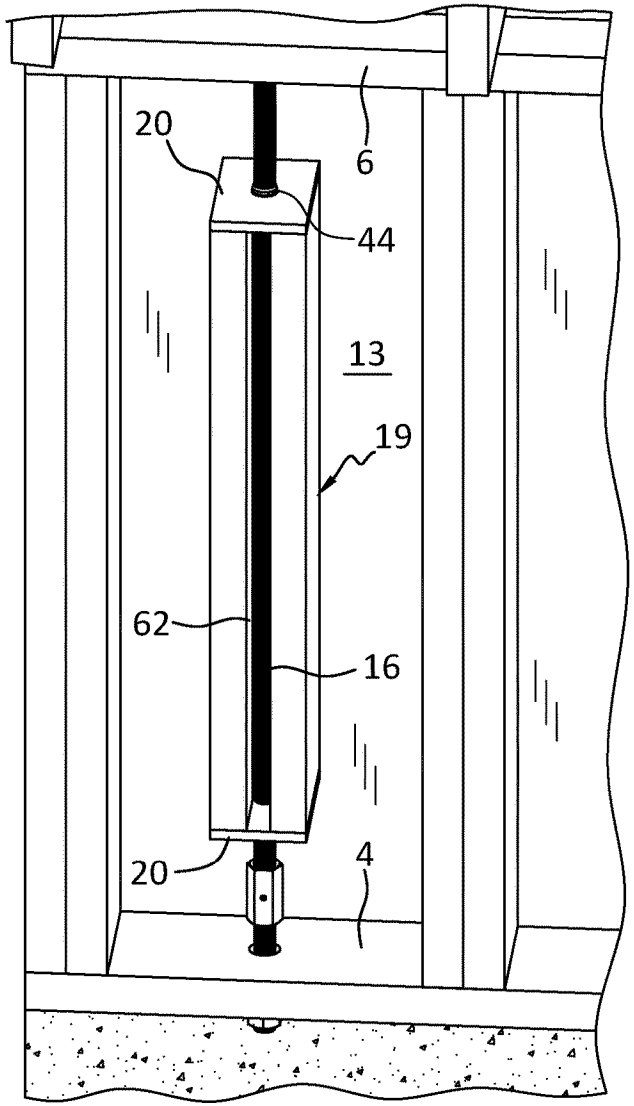

Referring to FIG. 32A, the block 19 has a slot 62 facing away from the wall sheathing 13 and bearing plates 20 threaded to the tie rod 16. Referring to FIG. 32B, the slot 62 is facing the wall sheathing 13. The block 19 is made of a single piece of lumber. The bearing plate 20 includes the threaded boss extension 44 shown in FIG. 20B.

Figure 33:
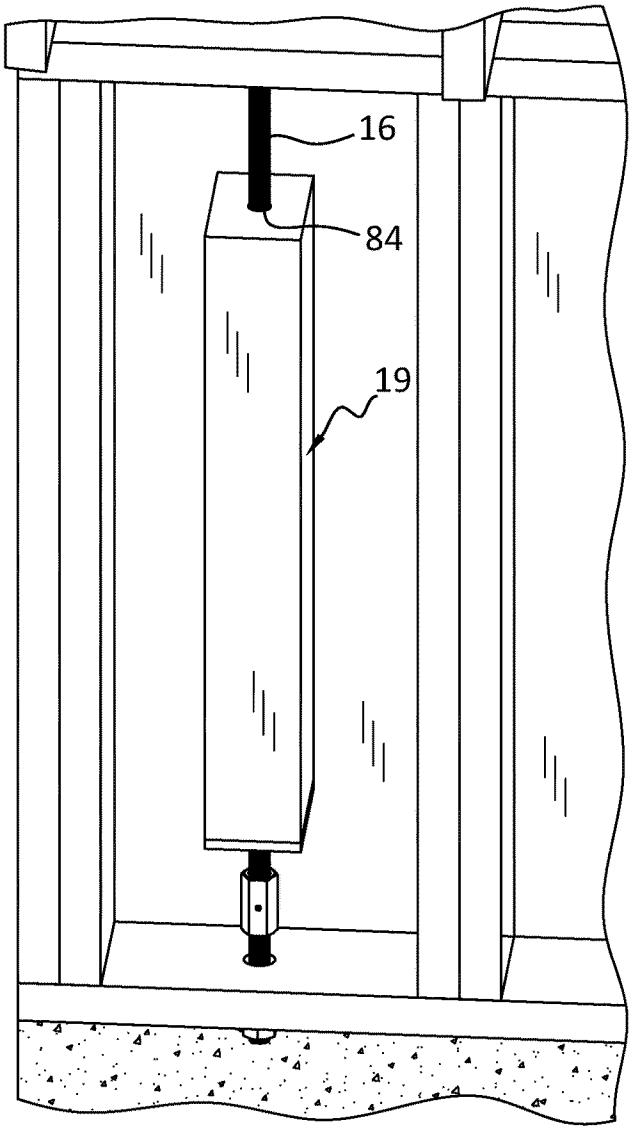

Referring to FIG. 33, the block 19 is made of a single piece of lumber with a through opening 84 to allow the tie rod 16 to extend through.

Figure 34B:
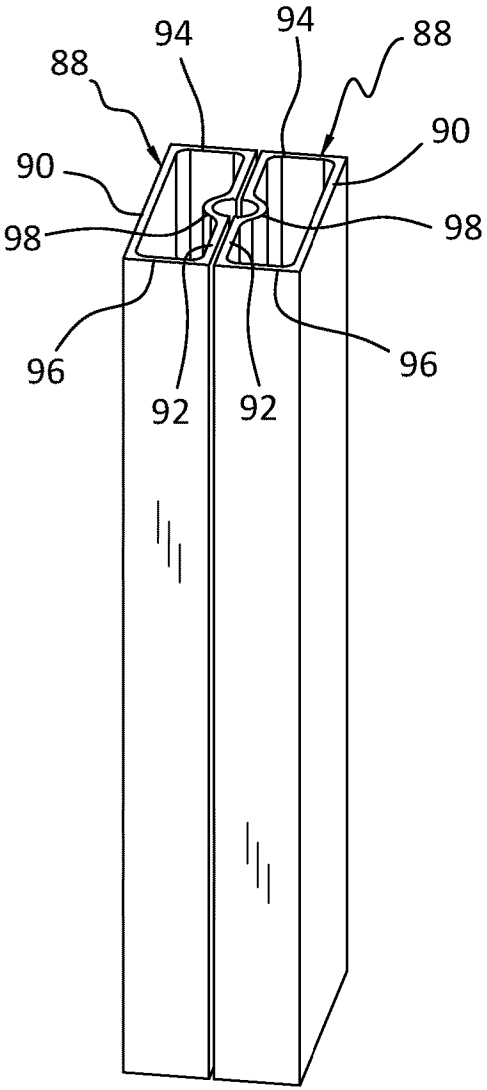
FIGS. 34A-36B show various configurations of the reinforcing member.
Figure 34A:
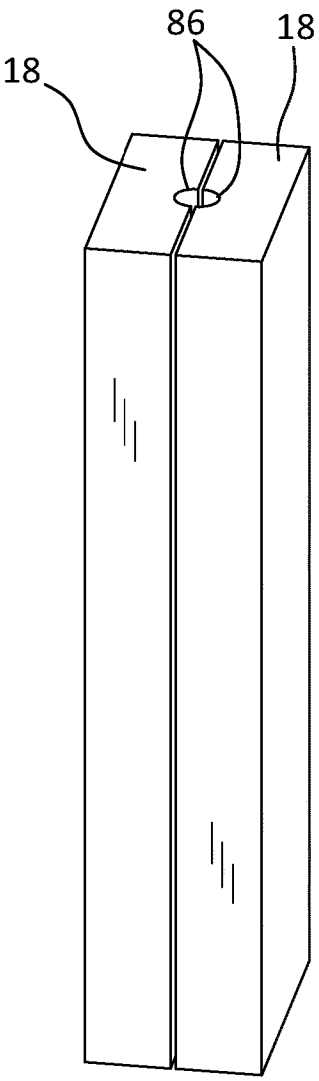

Referring to FIG. 34A, the members 18 may be made of solid wood, solid engineered lumber, solid plastic or solid metal. Each of the members 18 has a half-circular groove 86 that together makes up the opening 84 through which the tie rod 16 extends.

Referring to FIG. 34B, the members 18 may be made of hollow members 88, which may be made of metal or plastic. Each of the hollow members 88 is substantially rectangular in cross-section with opposites wide walls 90 and 92 and opposite narrow walls 94 and 96. Each of the walls 92 includes a half-circular trough 98 that together makes up the opening 84 through which the tie rod 16 extends. Each of the hollow member 88 is preferably a mirror image of the other.

Figure 35C:
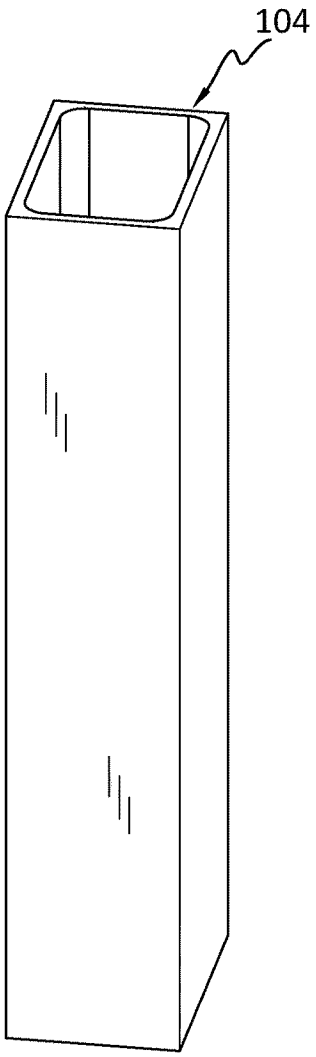
Figure 35B:
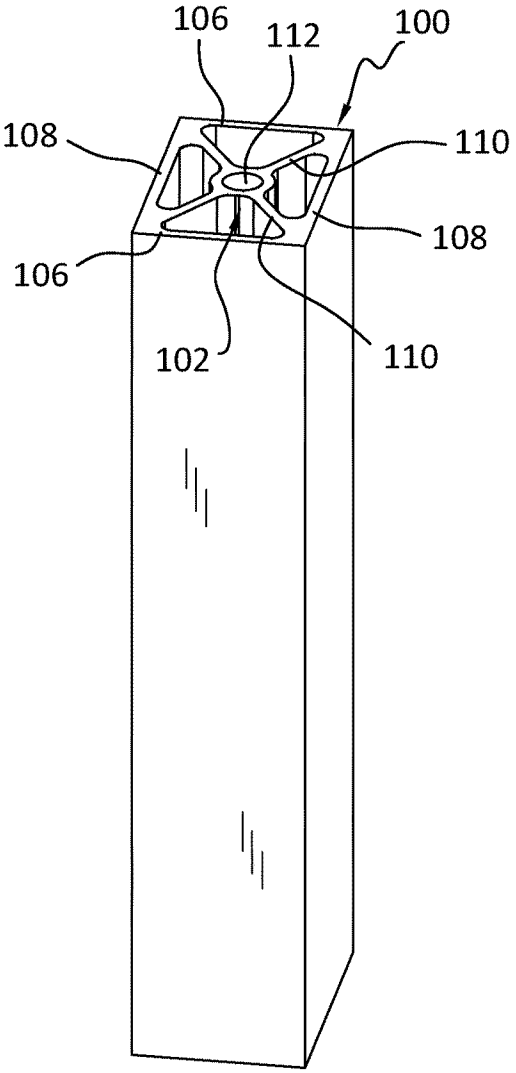
Figure 35A:
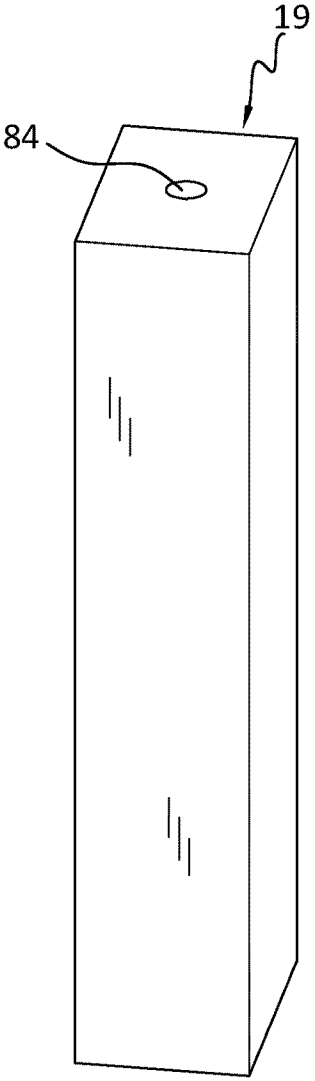

Referring to FIG. 35A, the block 19 is disclosed as a single piece of solid wood, metal or plastic with the through opening 84 through which the tie rod 16 extends.

Referring to FIGS. 35B and 35C, the block 19 may be made of a hollow member 100 with a tie rod guide 102 or a hollow member 104 without a tie rod guide. The member 100 is preferably square with opposite walls 106 and 108. Diagonal walls 110 position a tube 112 in the center of the hollow member 100. The tube 112 advantageously positions the tie rod 16 in the center of the hollow member 100. The members 100 and 104 may be made of metal or plastic.

Figure 36B:
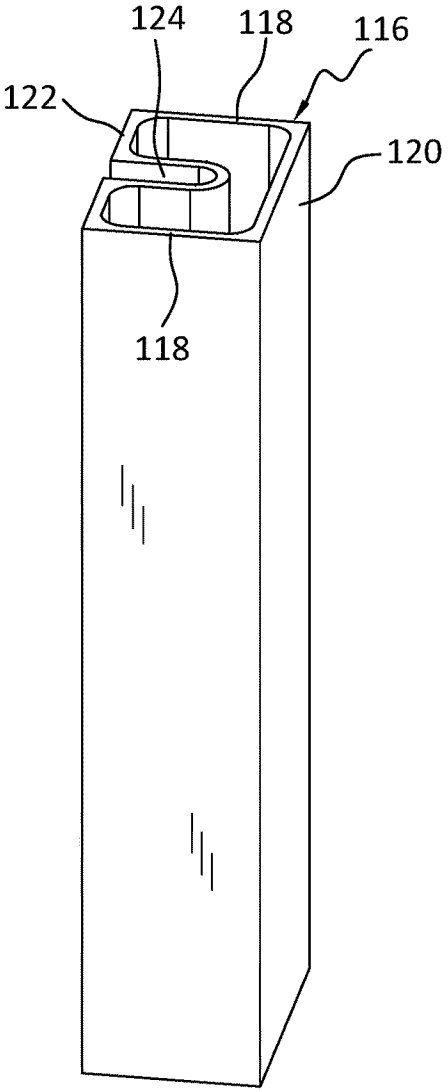
Figure 36A:
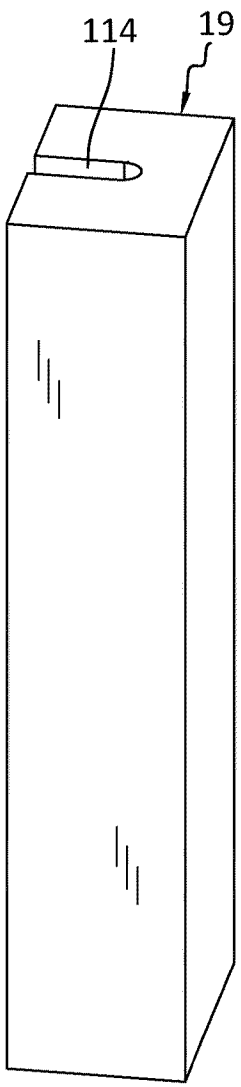

Referring to FIG. 36A, the opening 84 shown in FIG. 35A is modified as a slot 114, similar to the slot 62 shown in FIG. 25B, with or without the thread impressions shown in FIG. 25C. The block 19 may be solid wood, solid engineered lumber, solid plastic or solid metal.

Referring to FIG. 36B, the block 19 is modified as a hollow member 116, preferably square with opposite walls 118 and a base wall 120 between the opposite wall 118. A U-shaped wall 122 is opposite the wall 120 and between the walls 118. The U-shaped wall 122 provides a slot 124 for the tie rod 16 to extend through from the bottom to the top of the member 116. The member 116 may be made of metal or plastic.

Figure 37:
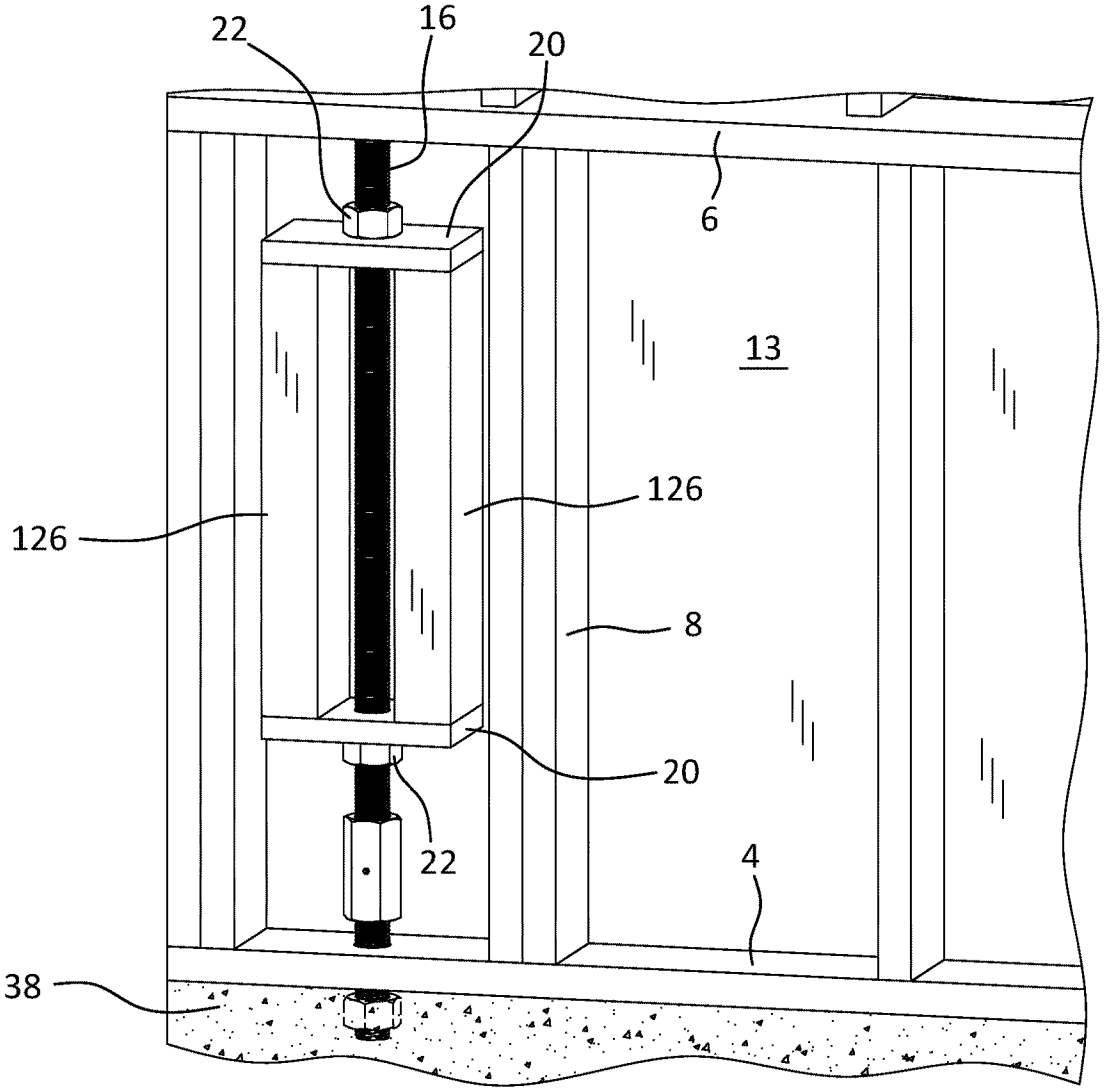
FIGS. 37-41B show various ways of attaching the reinforcement members to the tie rod without encasing the tie rod.

Referring to FIG. 37, the configuration shown in FIG. 1 is modified with reinforcement members 126 that do not include grooves to enclose the tie rod 16. The members 126 are disposed on opposite lateral sides of the tie rod 16. The members 126 may be spaced laterally from the tie rod 16. The members 126 may be spaced apart from the adjacent studs 8. The members 126 are preferably double thickness of a standard stud thickness. Bearing plates 20 are disposed on the bottom ends and the top ends of the members 126. The bearing plates 20 advantageously provide the added function of a cross-member, as in FIG. 3, to span the gap between the member 126. Nuts 22 secure the bearing plates 20 to the members 126 and the tie rod 16. The members 126 are operably attached to the wall sheathing 13 with nails and/or screws and/or adhesives and/or other standard means. Compression loading on the tie rod 16 is shared with members 126 and wall sheathing 13 to advantageously reduce the load on the length of the tie rod between the bearing plates 20, thereby reducing the tendency of tie rod to bow or bend under excessive load and thereby effectively transmitting the load from the upper walls to the foundation 38.

Figure 38:
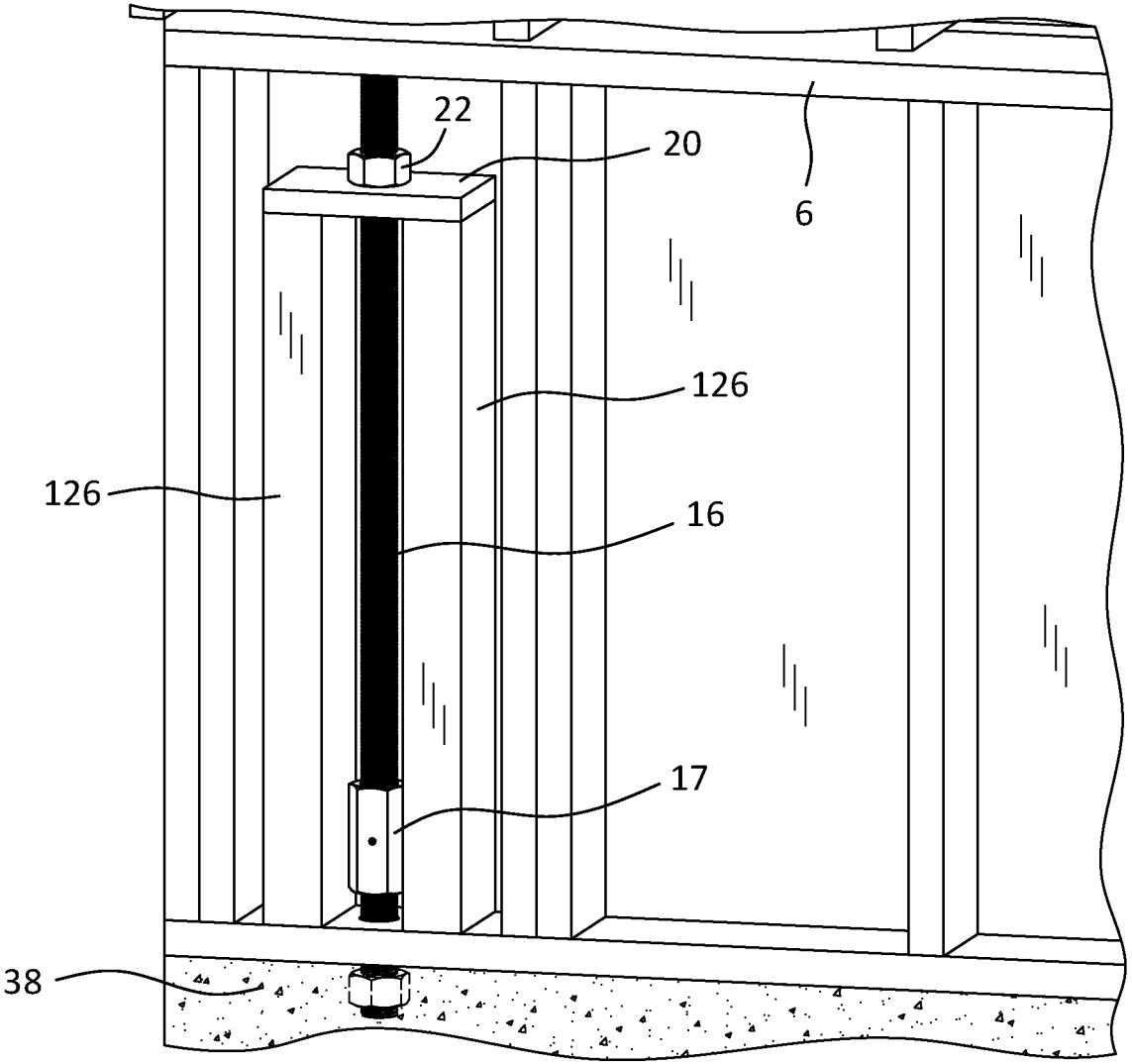

Referring to FIG. 38, the configuration shown in FIG. 37 is modified wherein the bottom bearing plate 20 is not used and the members 126 extend to and are supported by the bottom plate 4. The bottom ends of the members 126 operably bear down on the base plate 4 under compression loading.

Figure 39:
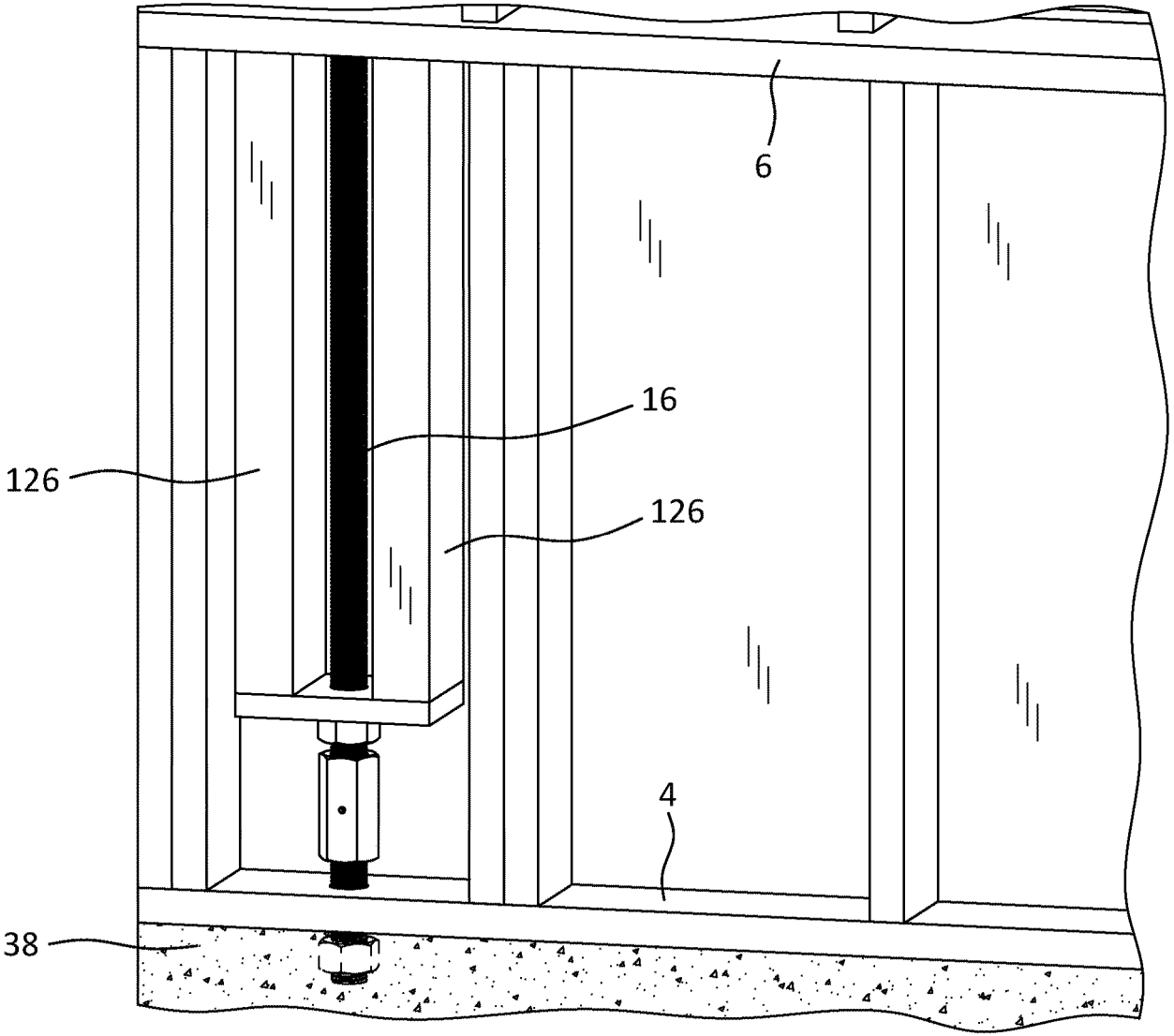

Referring to FIG. 39, the configuration shown in FIG. 37 is modified wherein the top bearing plate 20 is not used and the members 126 extend to and engage the top plate 6.

Figure 40:
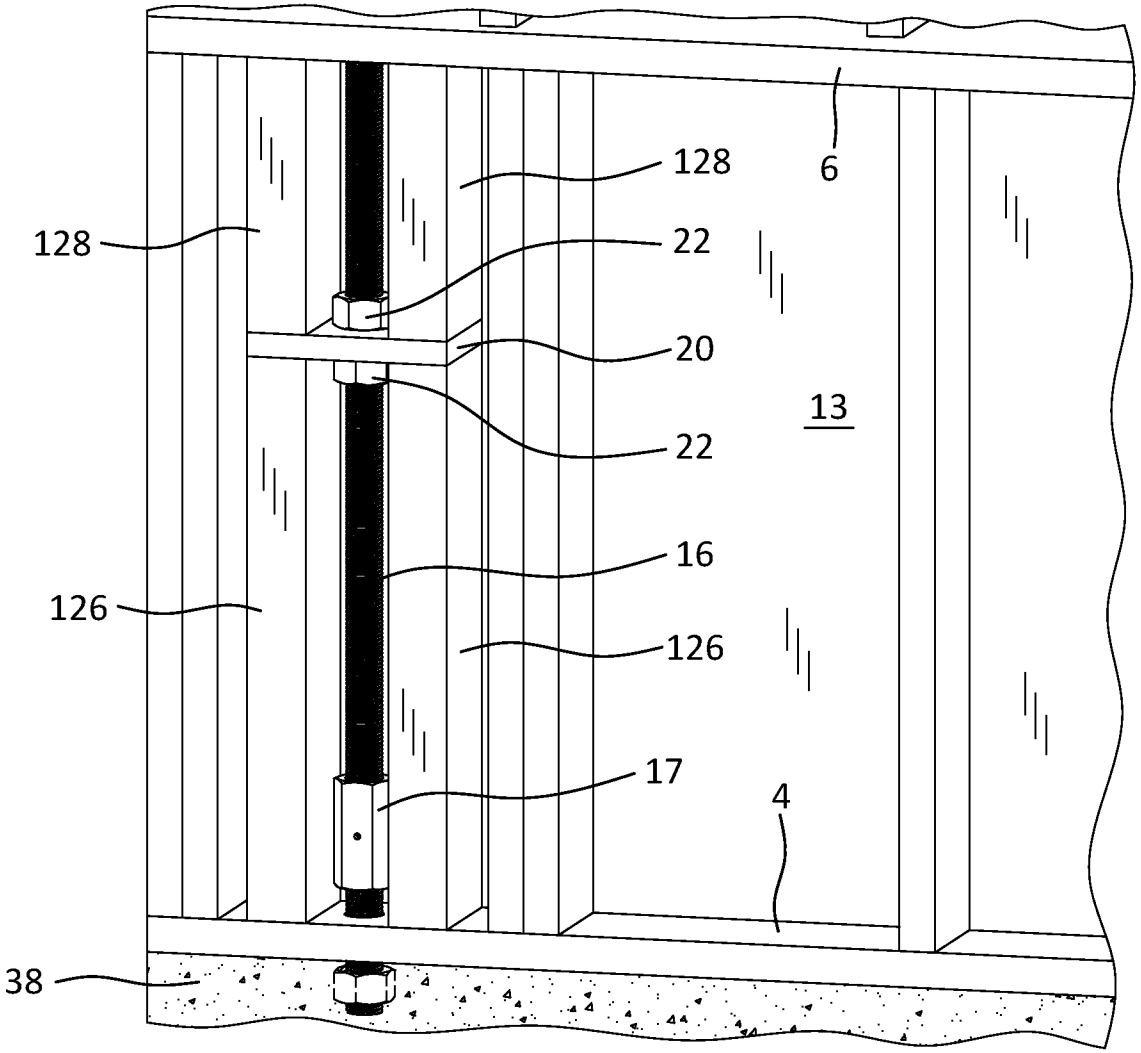

Referring to FIG. 40, the configuration shown in FIG. 38 is modified with the addition of reinforcement members 128 extending from the bearing plate 20 to the top plate 6. The members 128 are operably attached to the wall sheathing 13 with nails and/or screws and/or adhesive.

Figure 41A:
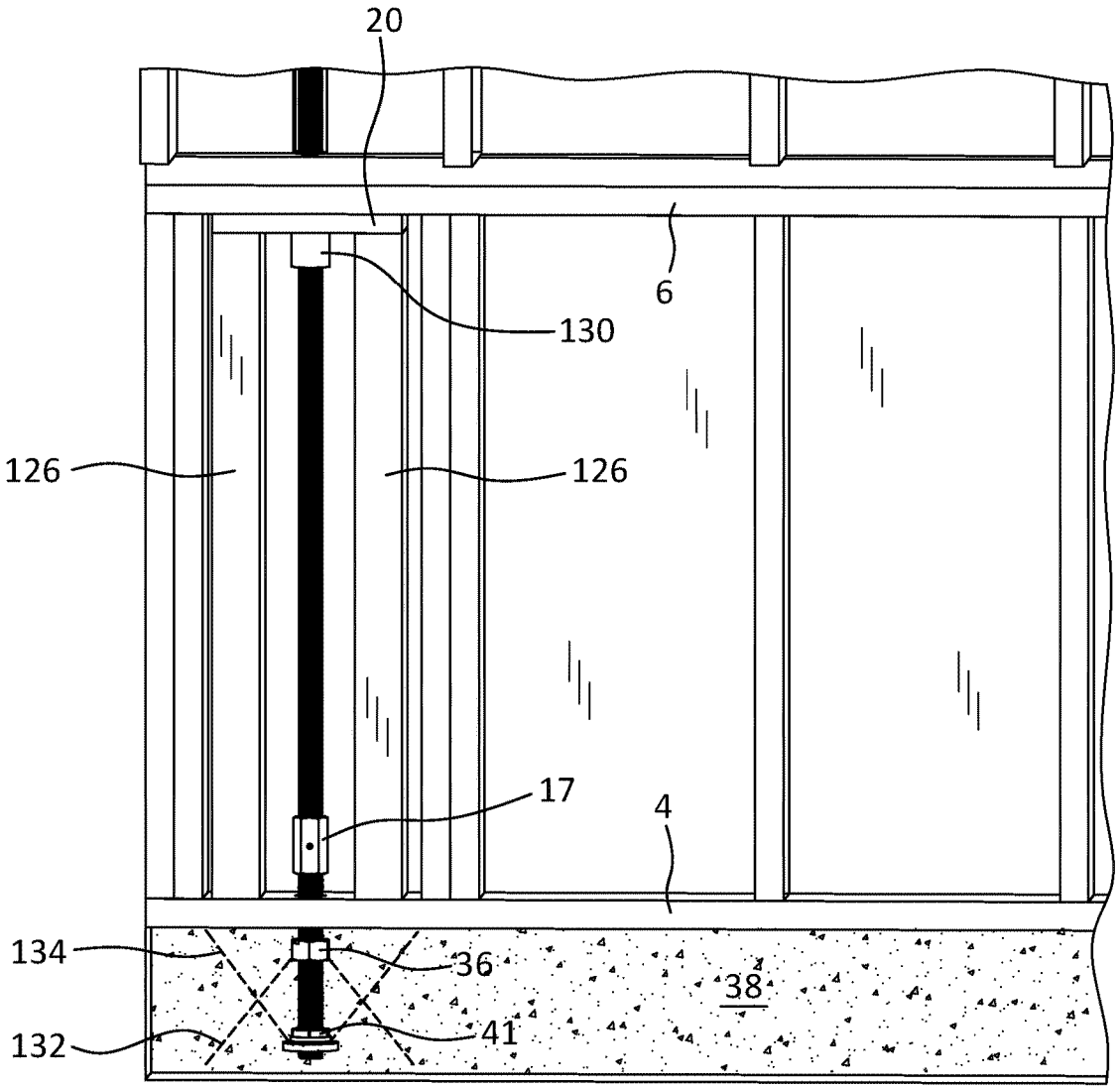

Referring to FIG. 41A, the configuration shown in FIG. 38 is modified by extending the members 126 toward the top plate 6 so that the bearing plate 20 engages the underside of the top plate 6. The nut 22 on the top side of the bearing plate 20 is replaced with a coupler 130 as will be explained below. The anchor 36 will generate an upright shear cone 132 in response to compression loading on the tie rod. The anchor 41 will generate an inverted shear cone 134 in response to tension loading on the tie rod.

Figure 41B:
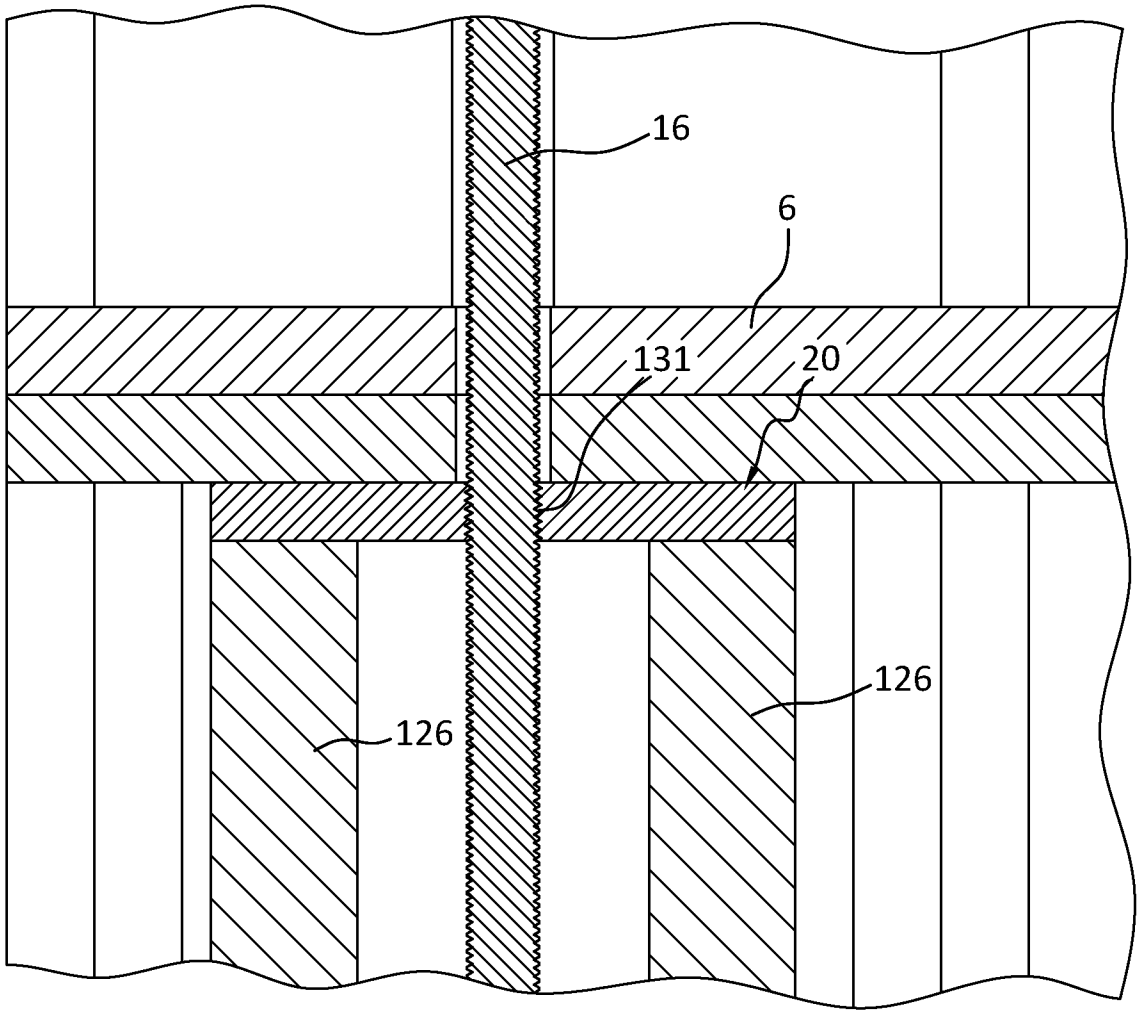

Referring to FIG. 41B, the bearing plate 20 is provided with a threaded hole 131 for threaded attachment to the tie rod 16. The threaded hole 131 replaces the coupler 130.

Figure 42B:
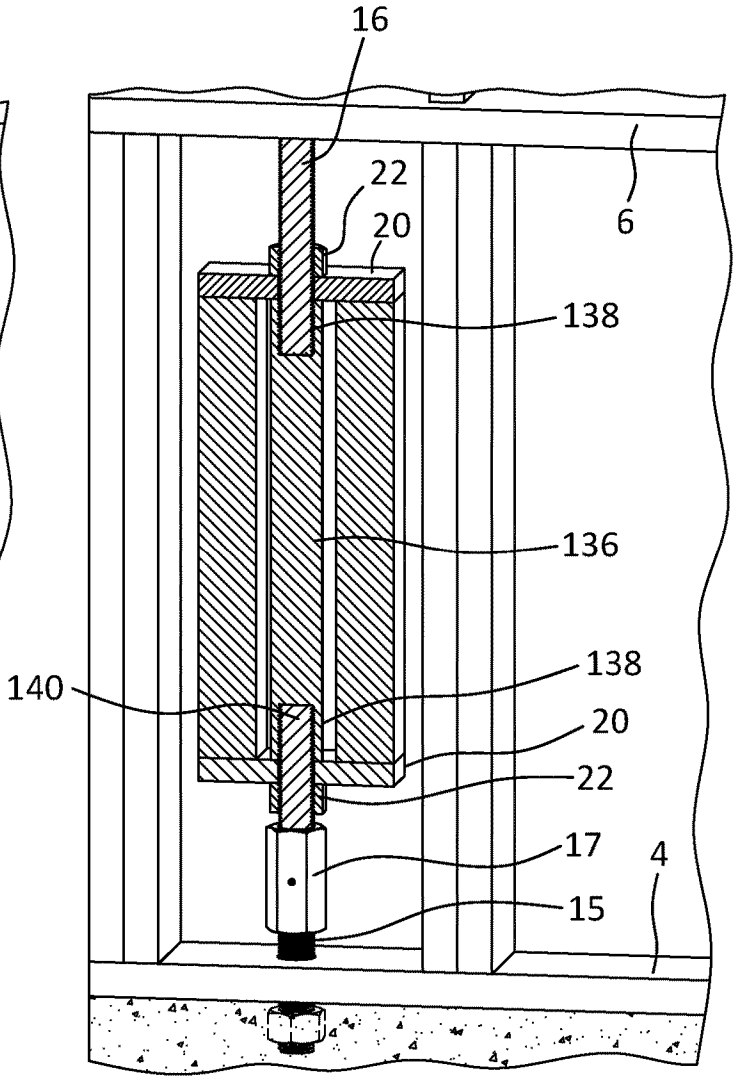
FIGS. 42A-54 show various modifications using a cylindrical member to the configuration shown in FIGS. 37-41.
Figure 42A:
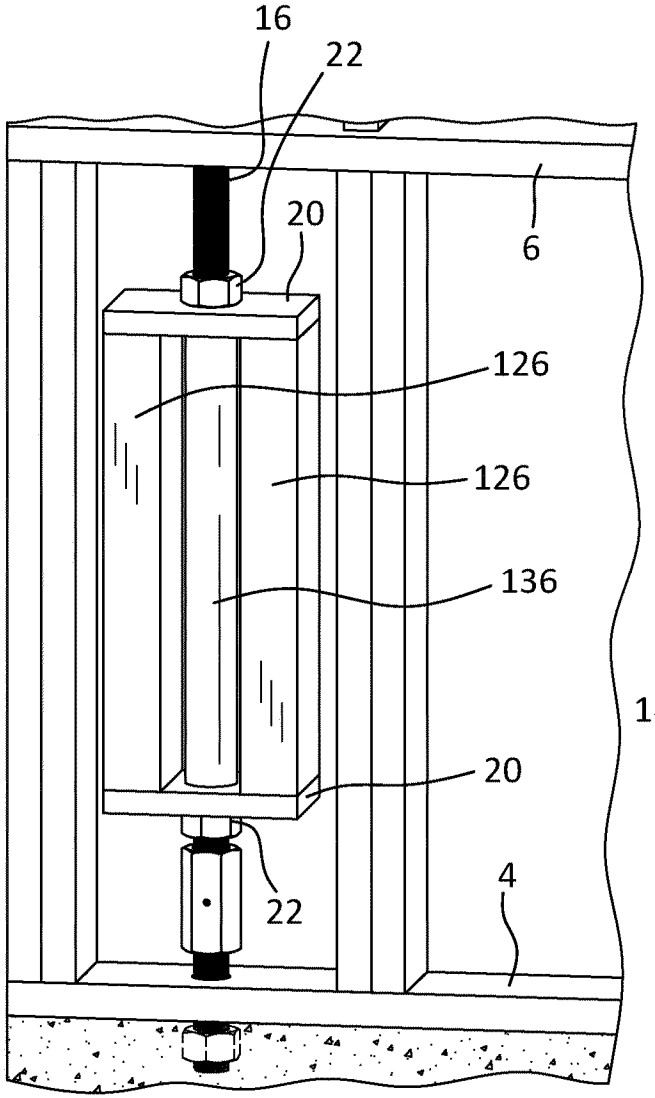

Referring to FIGS. 42A and 42B, the configuration shown in FIG. 37 is modified wherein the tie rod portion between the top and bottom bearing plates 20 is replaced with a cylindrical member 136 with threaded bores 138 at the top and bottom ends. The cylindrical member 136 advantageously provides additional compression load carrying capacity than the usual tie rod 16. A threaded rod 140 is attached to the bottom threaded bore 138 and coupled to the anchor rod 15 with the coupler 17. The tie rod 16 is threaded to the top end threaded bore 138.

Figure 42D:
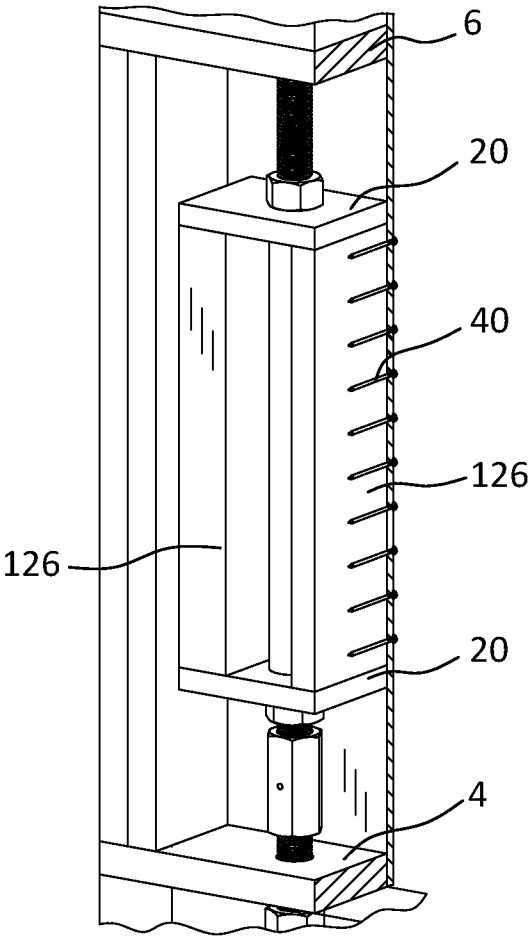
Figure 42C:
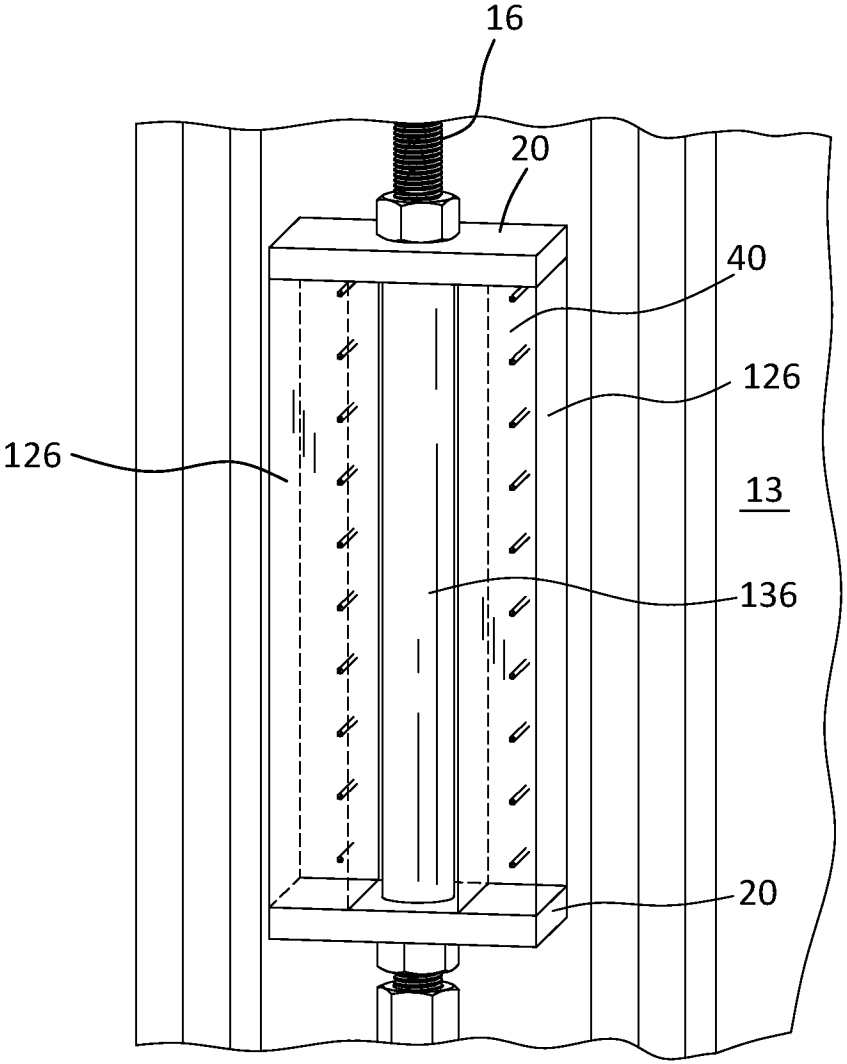

Referring to FIGS. 42C and 42D, the members 126 are operably attached to the wall sheathing 13 with screws and/or nails 40 and/or adhesives and/or other standard means.

Figure 42F:
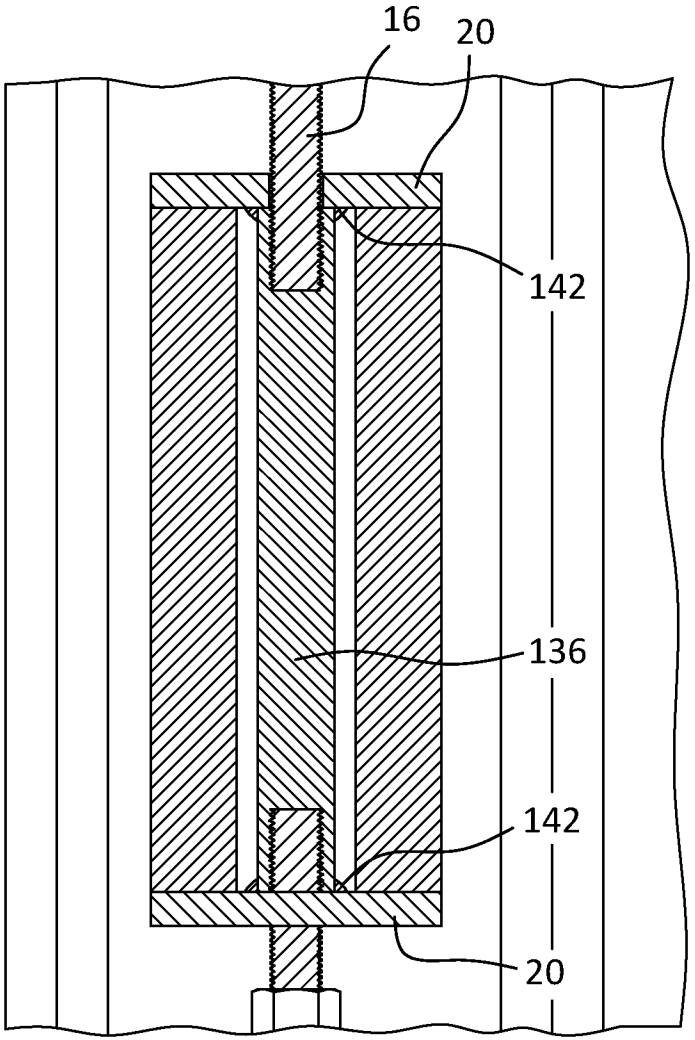
Figure 42E:
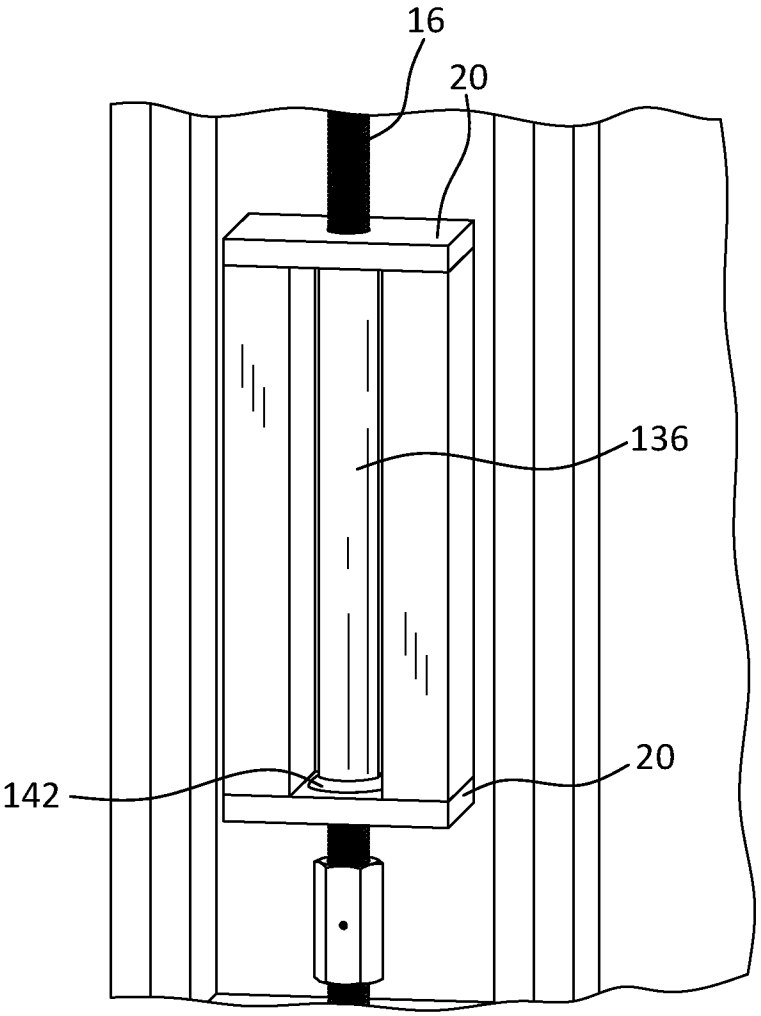

Referring to FIGS. 42E and 42F, the cylindrical member 136 is attached to the bearing plates 20 with welding 142 in lieu of the nuts 22.

Figure 43:
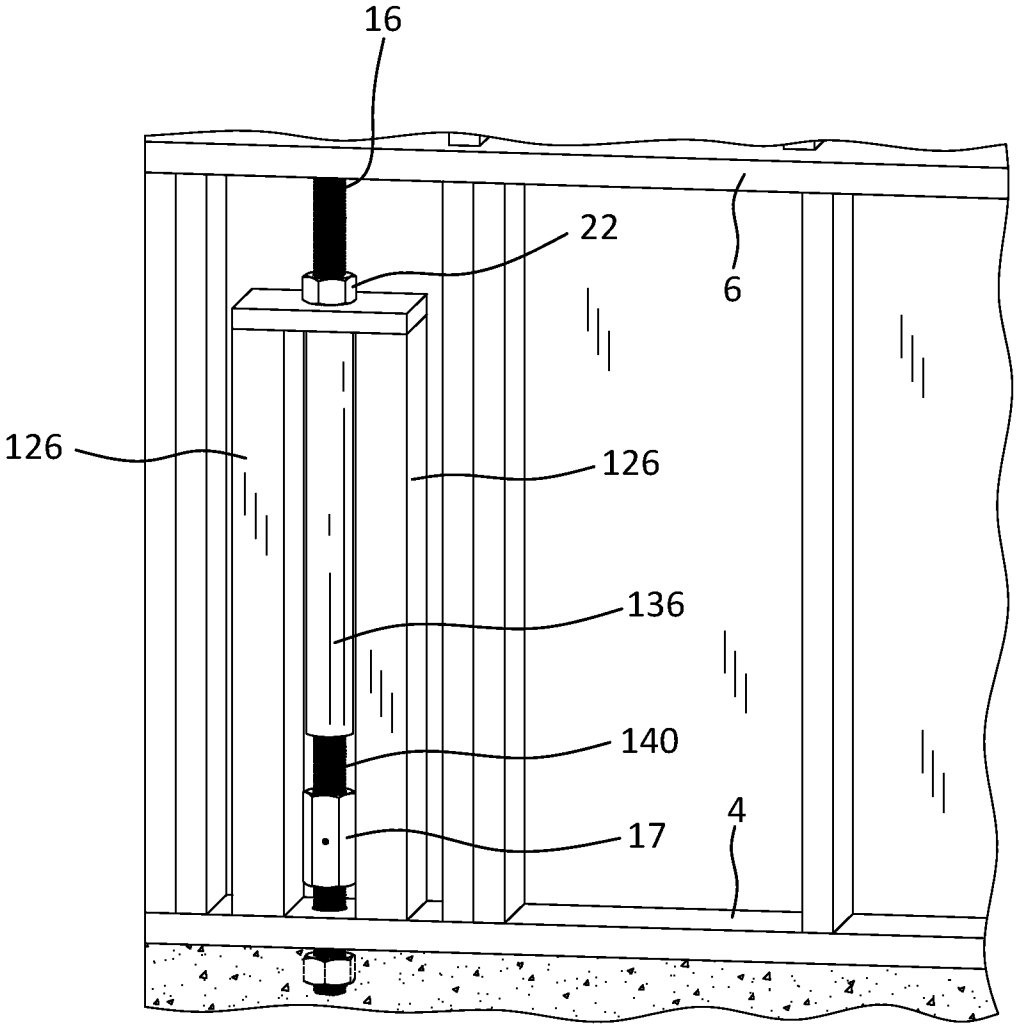

Referring to FIG. 43, the configuration shown in FIG. 38 is modified wherein the tie rod portion between the coupler 17 and the top bearing plate 20 is replaced with the cylindrical member 136 and the threaded rod 140.

Figure 44:
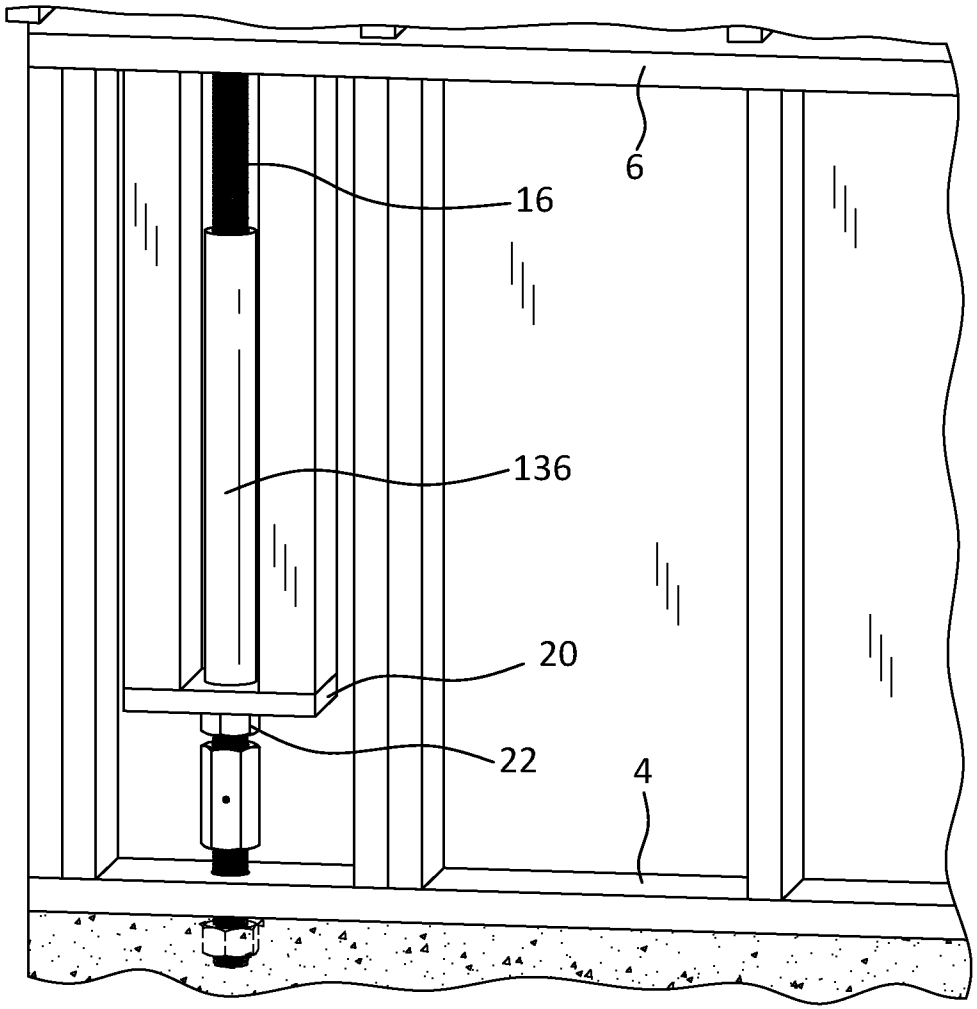

Referring to FIG. 44, the configuration shown in FIG. 39 is modified with the use of the cylindrical member 136 to replace a portion of the tie rod 16 between the lower bearing plate 20 and the top plate 6.

Figure 45:
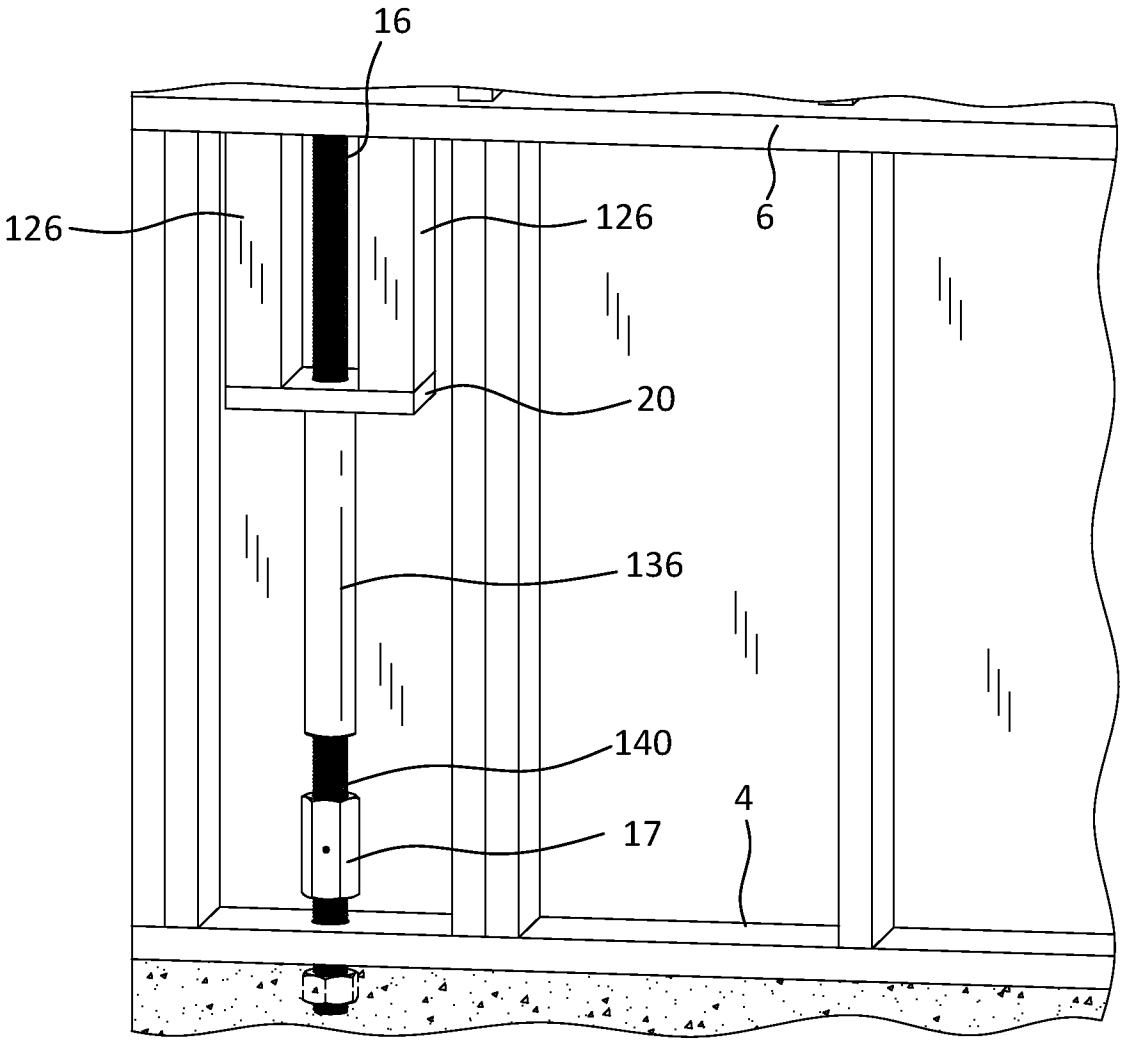

Referring to FIG. 45, the configuration shown in FIG. 44 is modified by placing the cylindrical member 136 below the lower bearing plate 20. The nut 22 is replaced by the cylindrical member 136.

Figure 46:
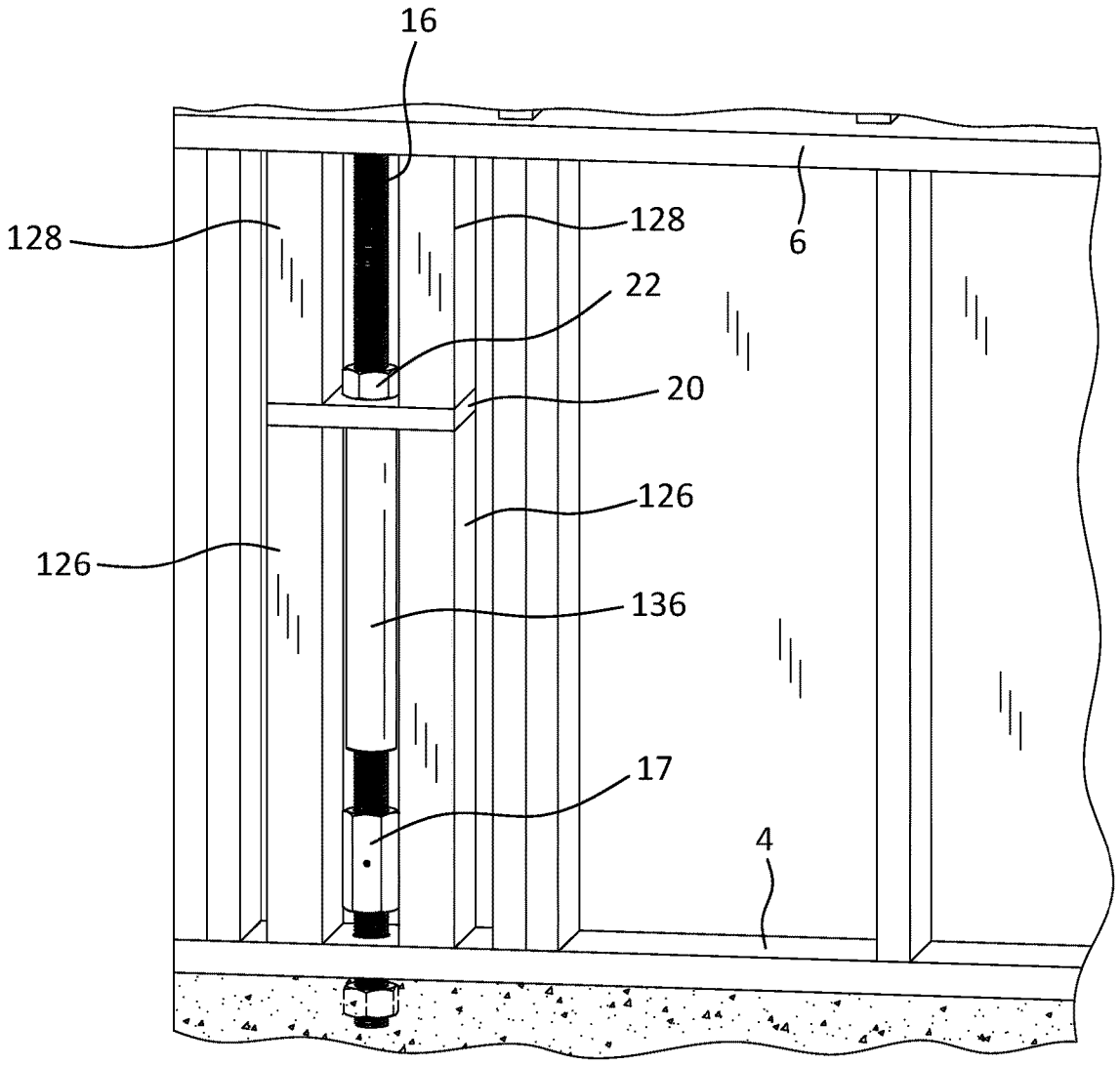

Referring to FIG. 46, the configuration shown in FIG. 40 is modified with the use of the cylindrical member 136 to replace a portion of the tie rod 16 between the bearing plate 20 and the coupler 17. The cylindrical member 136 also replaces the nut 22 underneath the bearing plate 20.

Figure 47:
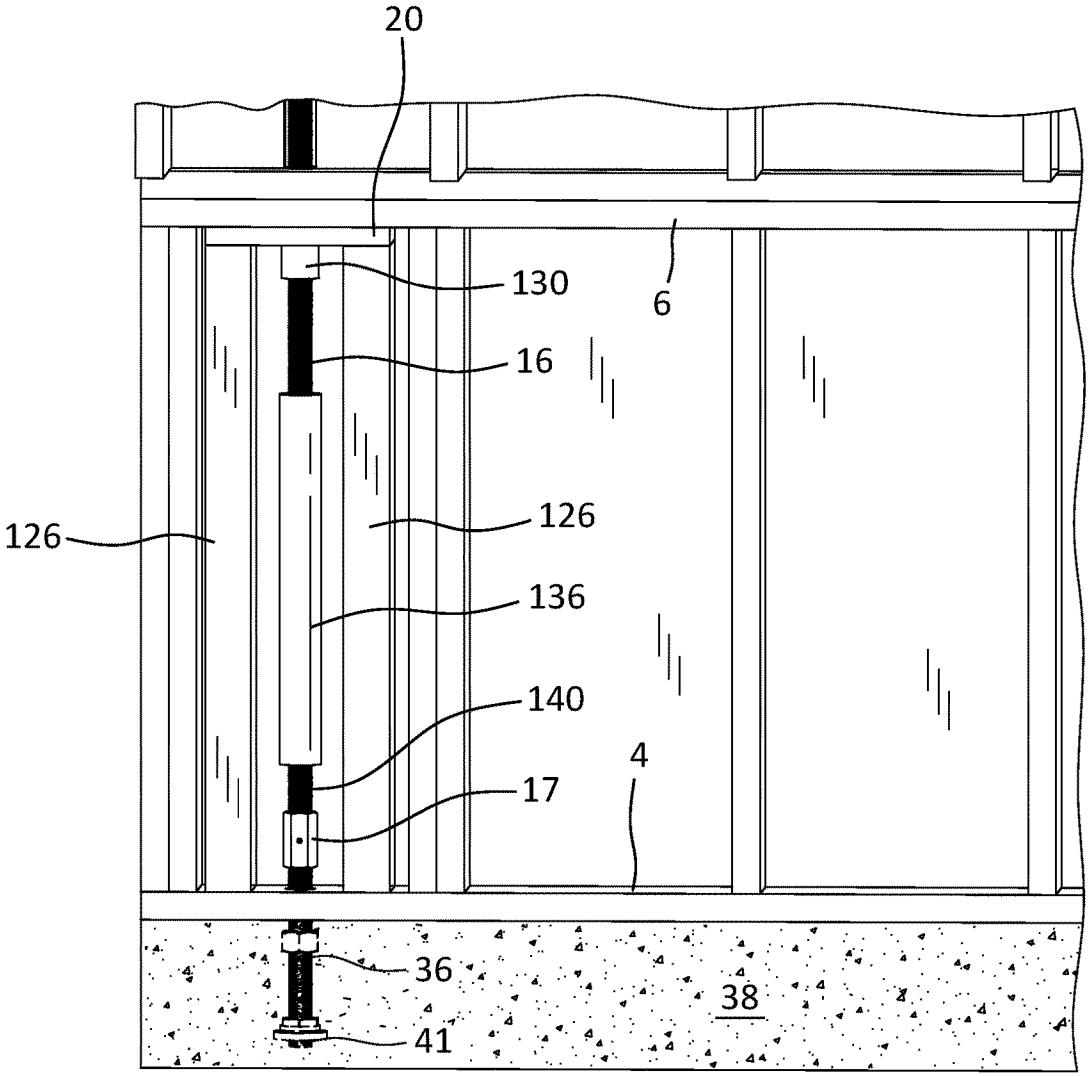

Referring to FIG. 47, the configuration shown in FIG. 41 is modified with the use of the cylindrical member 136 replacing a portion of the tie rod 16 between the couplers 130 and 17. The cylindrical member 136 advantageously provides additional compression load carrying capacity than the tie rod portion.

Figure 48B:
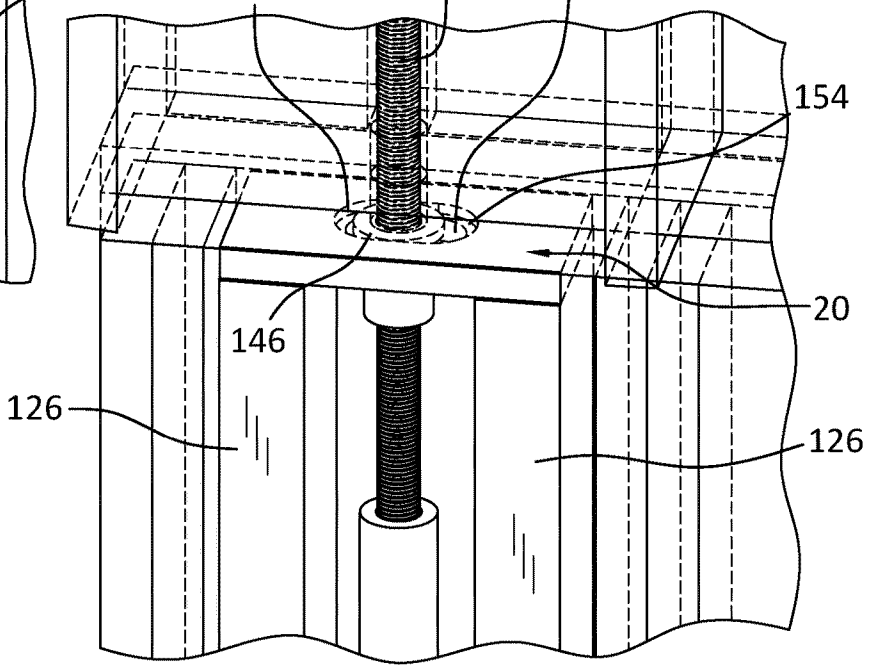
Figure 48A:
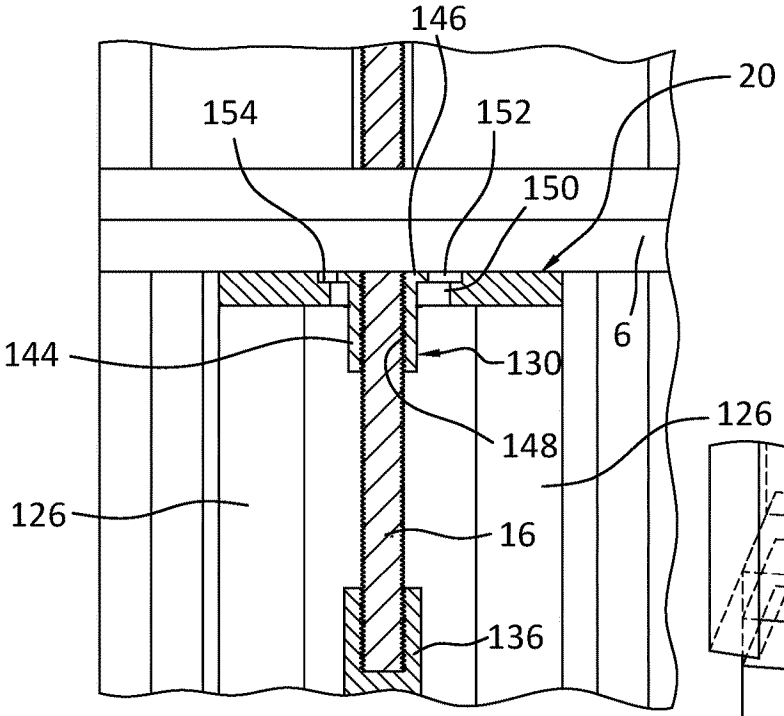

Referring to FIGS. 48A and 48B, the coupler 130 includes a cylindrical portion 144 and a flange portion 146. The coupler 130 includes a threaded opening 148 for threaded attachment to the tie rod 16. The bearing plate 20 has a slotted opening 150 and a recess 152. The recess 152 provides a shoulder 154 around the slotted opening 150 for supporting the flange portion 146. The flange portion 146 provides the function of a nut 22 bearing on top of the bearing plate 20 as for example shown in FIG. 46. The slotted opening 150 advantageously allows some leeway for the tie rod 16 to extend through the bearing plate 20 even when the tie rod 16 is off-center or off-vertical.

Figure 49A:
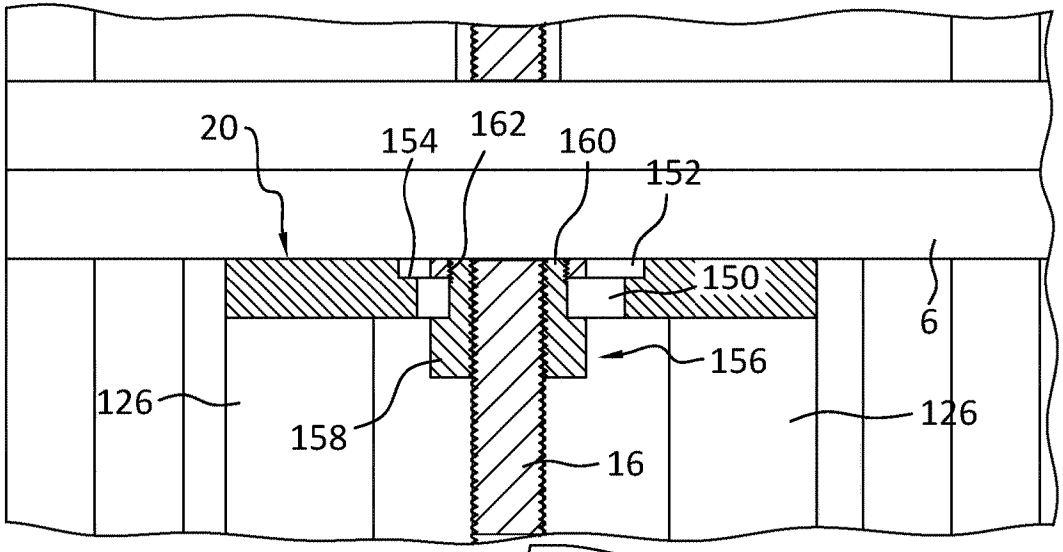
Figure 49B:
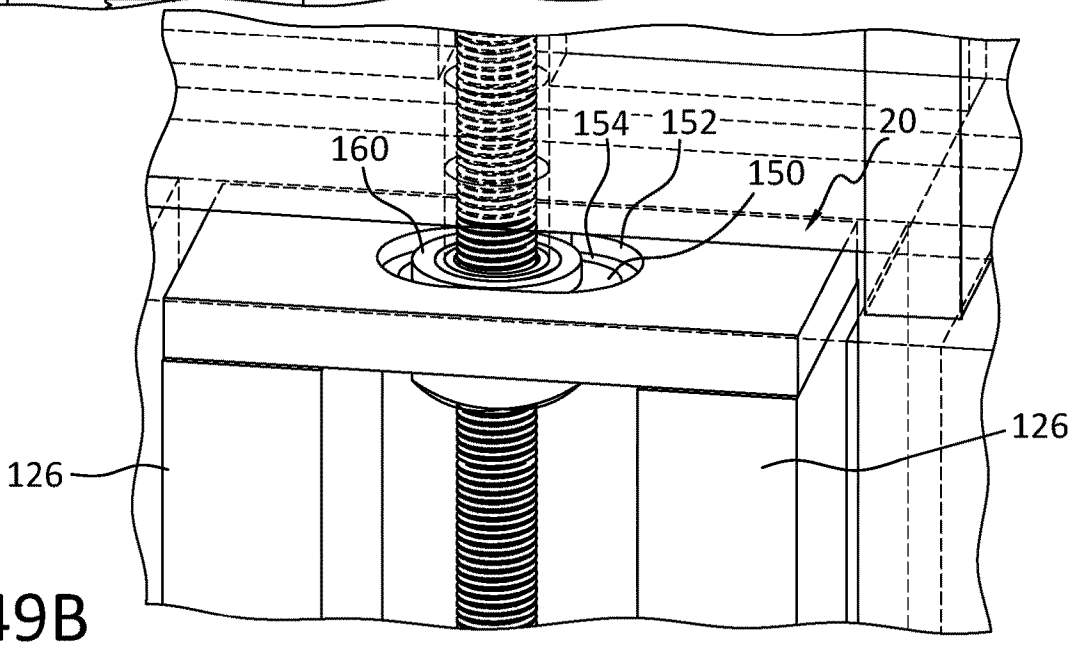

Referring to FIGS. 49A and 49B, the coupler 130 is modified as coupler 156 with a flange portion 158 and threaded ring 160. The coupler has a threaded end 162 to which the ring 160 is threaded. The ring 160 replaces the flange portion 146 of the coupler 130. The ring 160 bears down on the shoulder 154. The flange 158 engages the bearing plate 20 around the edge of the slotted opening 150.

Figure 50A:
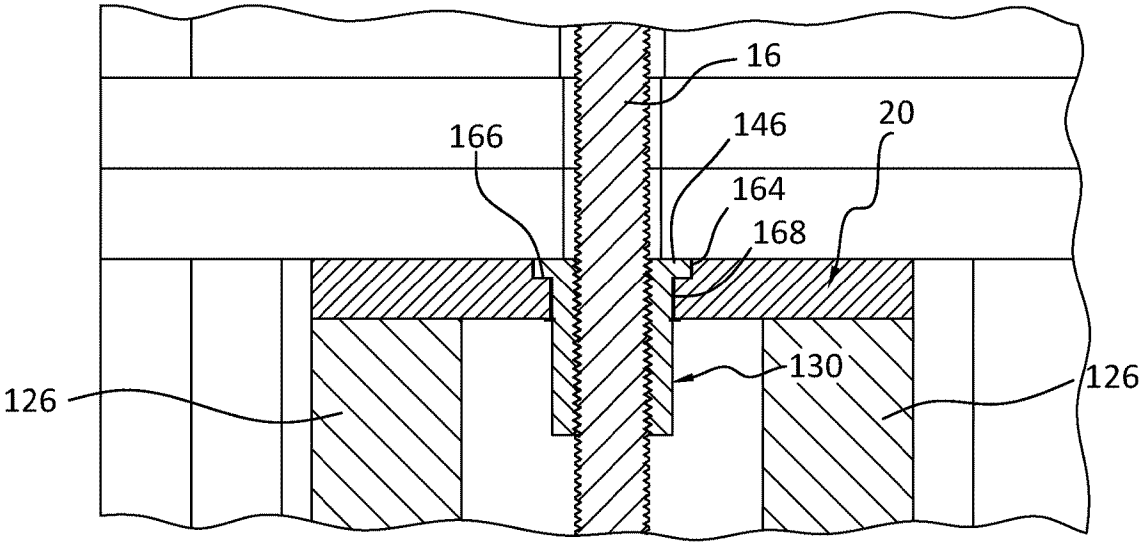
Figure 50B:
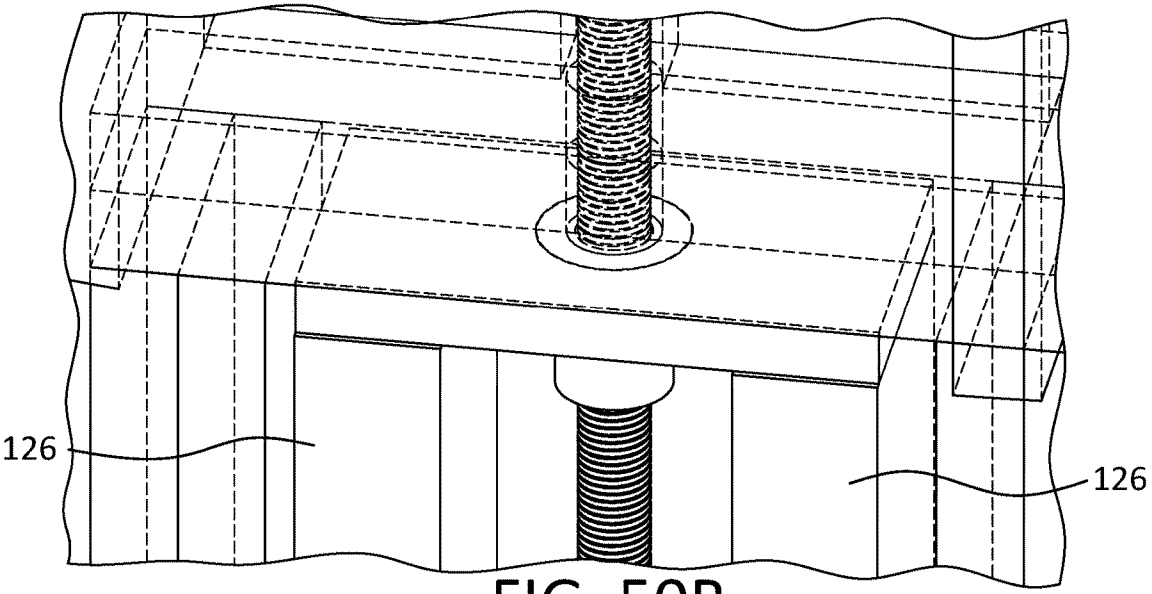

Referring to FIGS. 50A and 50B, the flange portion 146 of the coupler 130 is received within a counter-bored hole 164, creating a shoulder 166 around the opening 168. The flange portion 146 bears down on the shoulder 166.

Figure 51B:
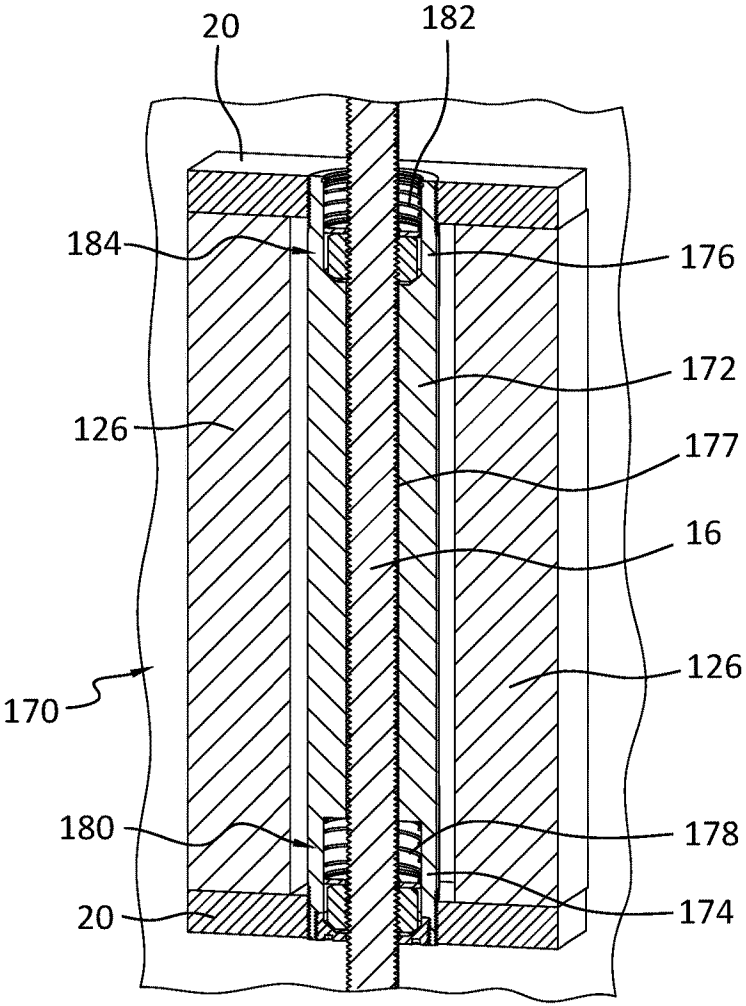
Figure 51A:
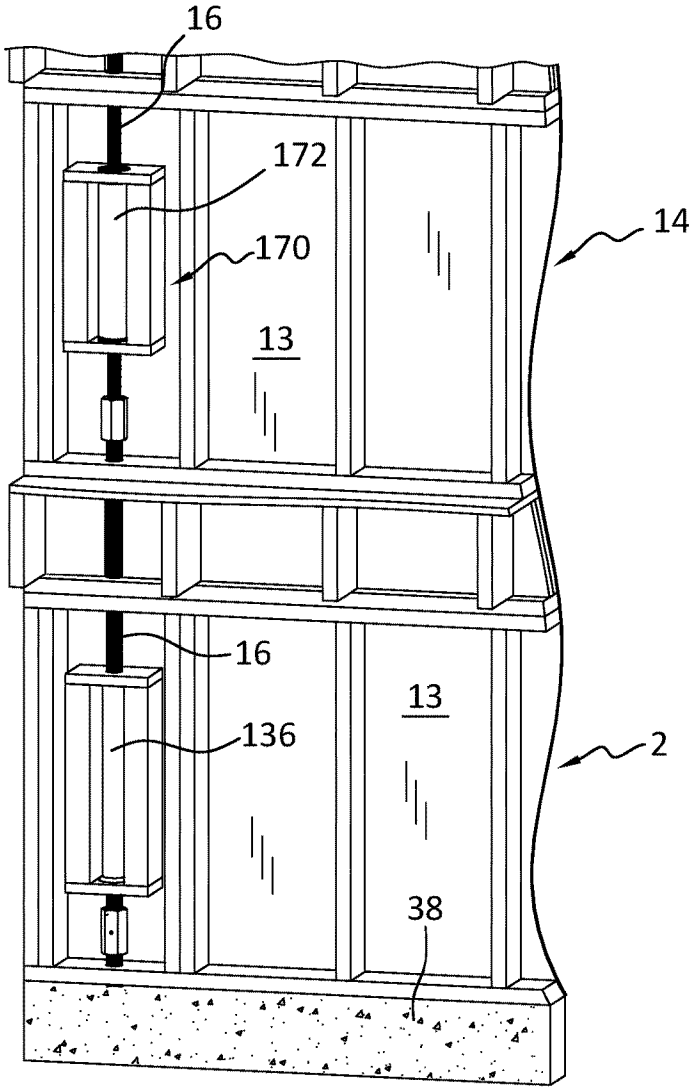
Figure 51C:
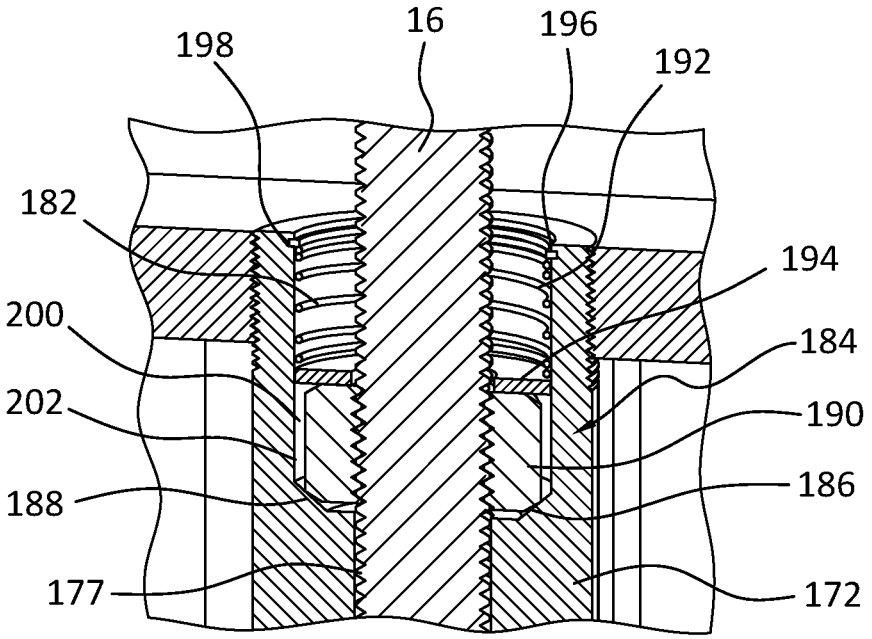

Referring to FIGS. 51A-51C, the configuration shown in FIG. 42E is installed in the lower wall 2 disposed on the foundation 38. The configuration shown in FIG. 42E is modified as assembly 170 and installed in the upper wall 14. The assembly 170 travels with the wall down the stationary tie rod 16 and resists uplift forces on the wall. The assembly 170 transfers tension forces to the tie rod 16. Compression forces on the wall allows the assembly 170 to move down with the wall relative to the tie rod 16. The assembly 170 advantageously functions to take up slack in the tie rod 16 when the walls settle down and resist tension forces when the walls are uplifted. The assembly 170 may also function as a coupler for connecting two tie rods together in the manner shown in FIG. 52.

Referring to FIG. 51B, the assembly 170 includes a cylindrical member 172 with threaded lower end 174 and a threaded upper end 176. The lower end 174 and the upper end 176 are threaded to the respective bearing plates 20. The members 126 are sandwiched by the bearing plates 20 and are operably attached to the wall sheathing 13 with nails and/or screws and/or adhesives and/or other standard means. The cylindrical member 172 includes a through opening 177 through which the tie rod 16 extends. The lower end 174 includes a cavity 178 that houses a split nut assembly 180. The upper end 176 also includes a cavity 182 that houses another split nut assembly 184. The opening 177 may be made of two blind holes (see FIG. 52), in which case the tie rod 16 is in two section, one section entering from below and the other section entering from above and both sections are joined together via the assembly 170.

Referring to FIG. 51C, the split nut assembly 184 is disclosed in U.S. Pat. No. 9,303,399, incorporated herein by reference. The cavity 182 has a circumferential ramp surface 186 around the opening on which a lower surface 188 of the threaded split body 190 rests. The split body 190 is preferably a standard nut split radially from the center into two or more pieces. A spring 192 presses on a washer 194 to press the split body 190 down the ramp surface 186, thereby causing the thread of the split body 190 to mate with the thread of the tie rod 16. A spring clip 196 disposed inside a circumferential groove 198 holds the spring 192 inside the cavity 182. The split nut assembly 184 allows the tie rod 16 to move up relative to the cylindrical member 172 but prevents the tie rod 16 to move down. Space 200 between the cavity wall 202 and the split body 190 allows the split 190 to spread out and disengage from the thread of the tie rod 16 when the tie rod 16 moves upwardly.

Figure 51D:
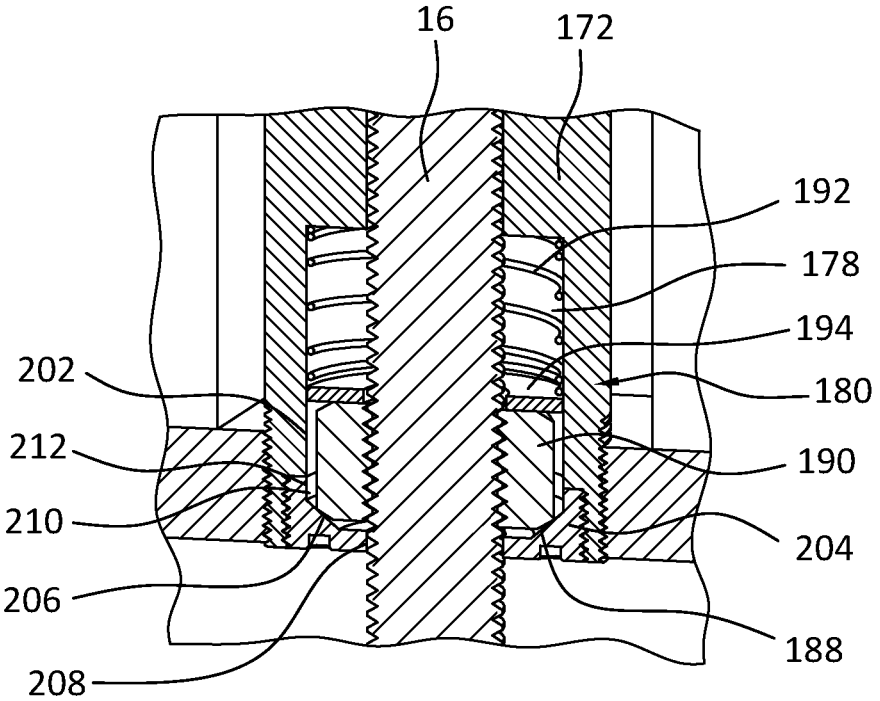

Referring to FIG. 51D, the entrance to the cavity 178 is closed off by a ring 204 threadedly attached to the cylindrical member 172. The ring 204 has a circumferential ramp surface 206 around the opening 208 on which the lower surface 188 of the threaded split body 190 rests. The split body 190 is preferably a standard nut split radially from the center into two or more pieces. The spring 192 presses on the washer 194 to press the split body 190 down the ramp surface 206, thereby causing the thread of the split body 190 to mate with the thread of the tie rod 16. The split nut assembly 184 allows the tie rod 16 to move up relative to the cylindrical member 172 but prevents the tie rod 16 to move down. Space 210 between the split body 190 and the cavity wall 202 and the ring wall 212 allows the split 190 to spread out and disengage from the thread of the tie rod 16 when the tie rod 16 moves upwardly.

Figure 52:
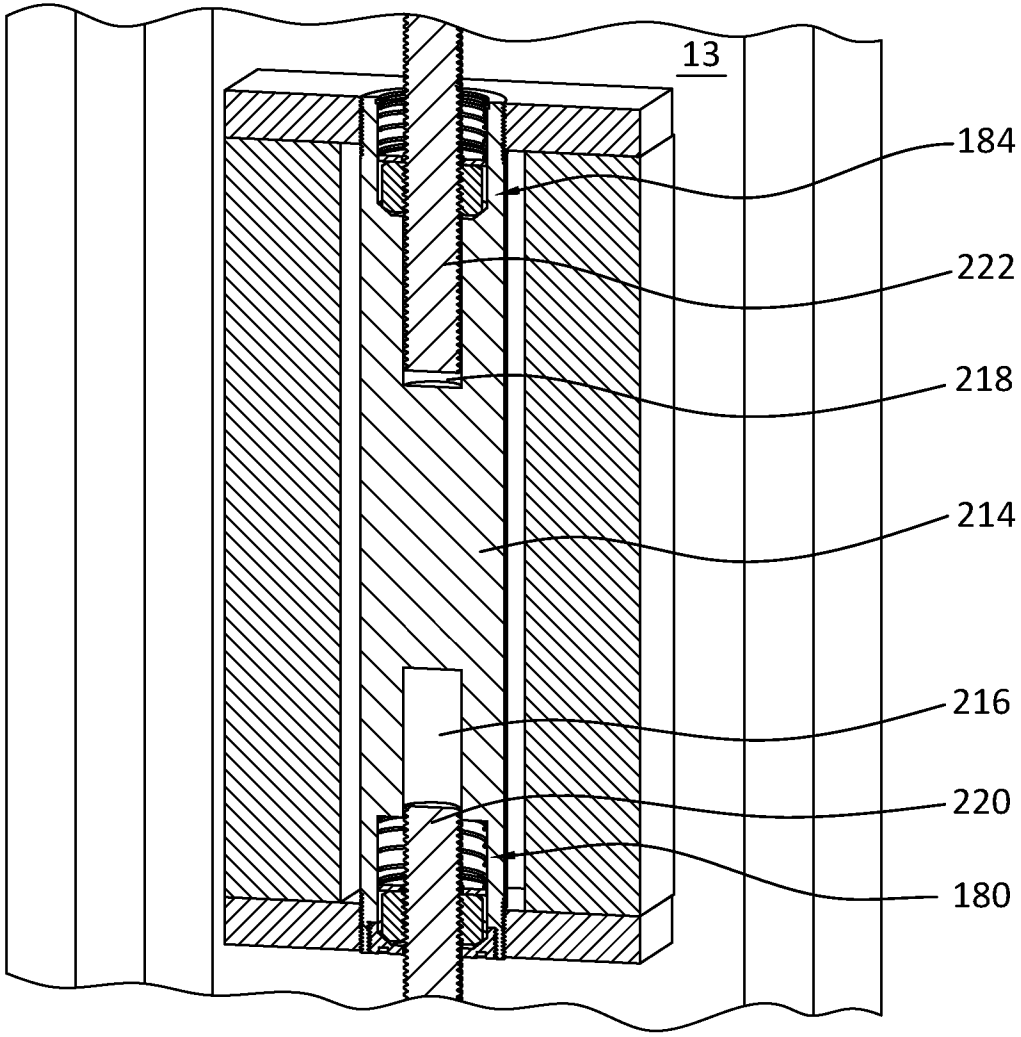

Referring to FIG. 52, the cylindrical member 172 is modified as cylindrical member 214. The cylindrical member 214 is provided with blind holes 216 and 218 at the lower end 174 and the upper end 176, respectively. A lower tie rod 220 is connected to an upper tie rod 220 via the cylindrical member 214. Split nut assemblies 180 and 184, as described in FIGS. 51D and 51C, provide for upward movement of the tie rods 220 and 222 relative to the cylindrical member 214 but prevent downward movement. The blind holes 216 and 218 provide sufficient depth to provide space for the movement of the tie rods 220 and 222. The blind holes 216 and 218 may be joined into one through opening (see FIG. 51B).

Figure 53:
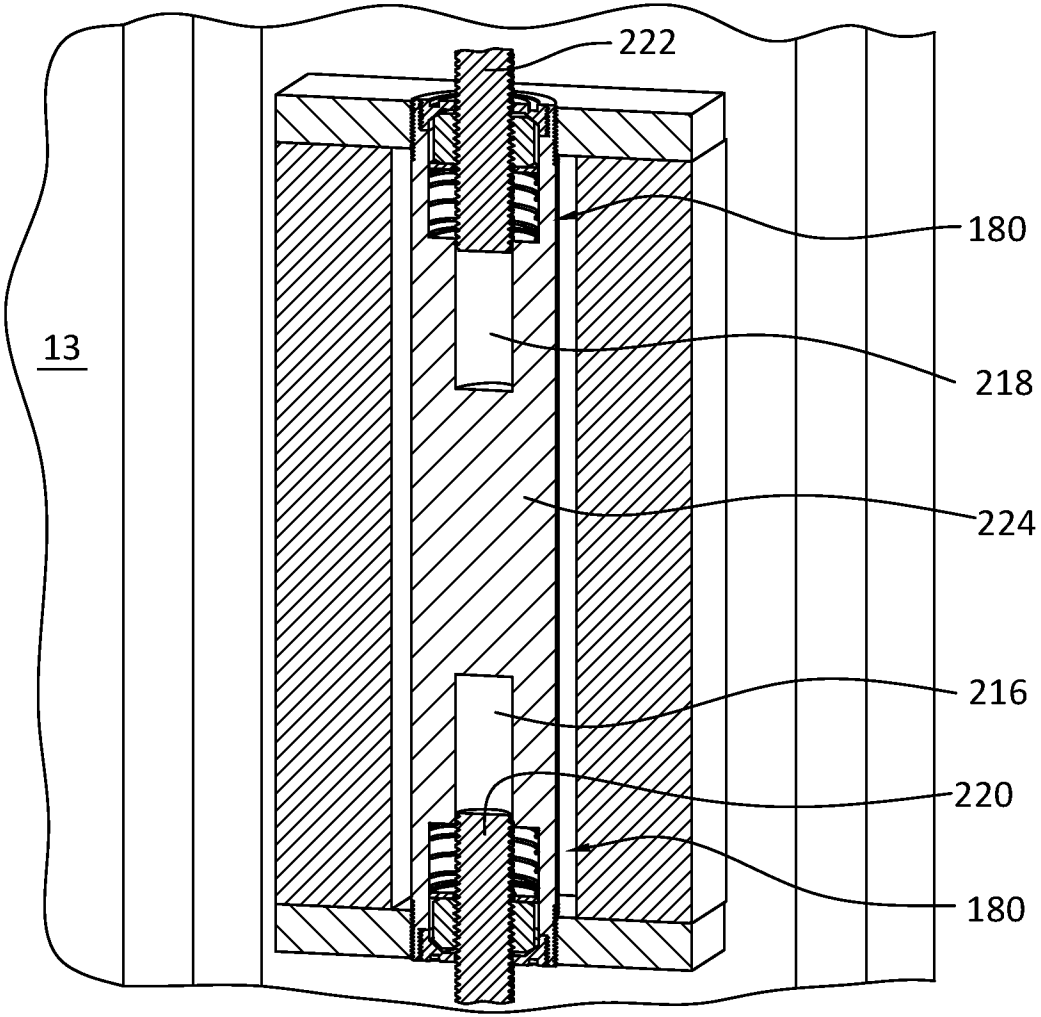

Referring to FIG. 53, the cylindrical member 214 shown in FIG. 52 is modified as cylindrical member 224 to accommodate replacing the split nut assembly 184 with another of the split nut assembly 180. With this arrangement, the lower tie rod 220 is able to move up relative to the cylindrical member 224 but not in the downward direction. Similarly, the upper tie rod 222 is able to move down relative to the cylindrical member 224 but not in the upward direction. In this manner, slack that develops in either the lower tie rod 220 or the upper tie rod 222 are advantageously absorbed independently by the respective split nut assemblies 180.

Figure 54:
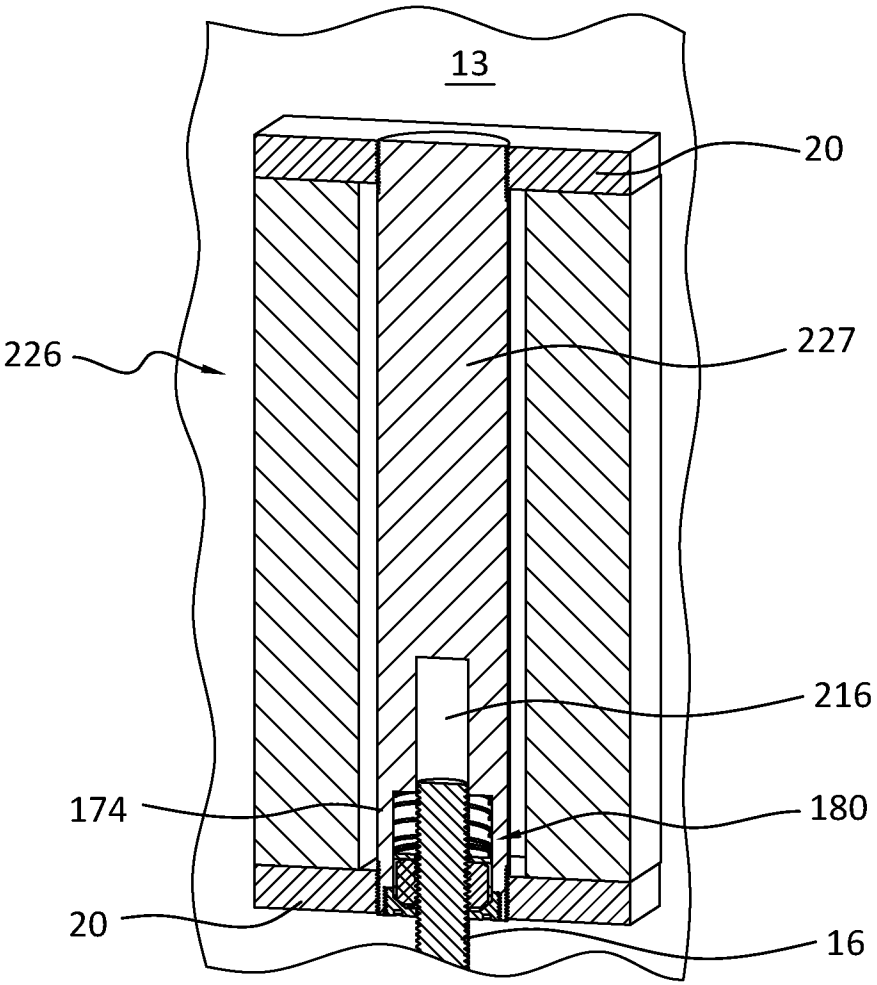

Referring to FIG. 54, an assembly 226 includes the cylindrical member 214 shown in FIG. 52 that is modified as cylindrical member 227 with only the lower end 174 being provided with the split nut assembly 180. The tie rod 16 is able to move up relative to the cylindrical member 227 but not in the downward direction. The blind hole 216 provides space for the tie rod 16 to move into the cylindrical member 227. The assembly 226 may be installed in an upper wall to hold the wall against uplift forces and will take up any slack that develops in the tie rod 16 due to settlement.

It should be understood that the cylindrical member 172 and its various modifications can have other cross-sectional shapes, such as hexagonal, square, etc.

Figure 55B:
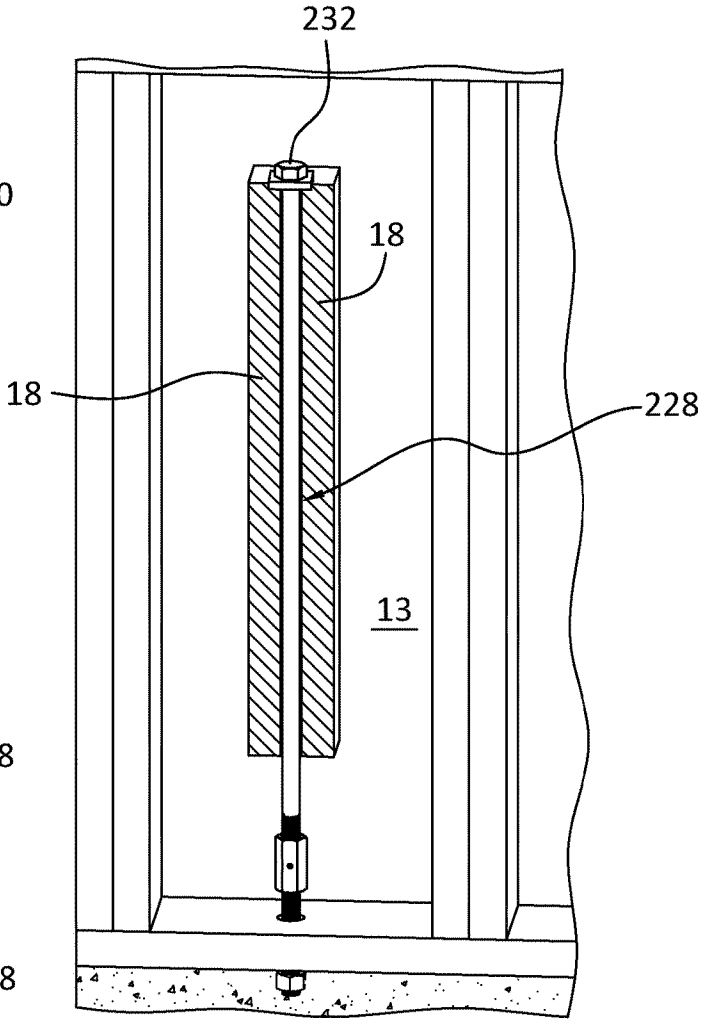
FIGS. 55A-69C show a reinforced building wall using a bolt or threaded rod with reinforcement members.
Figure 55A:
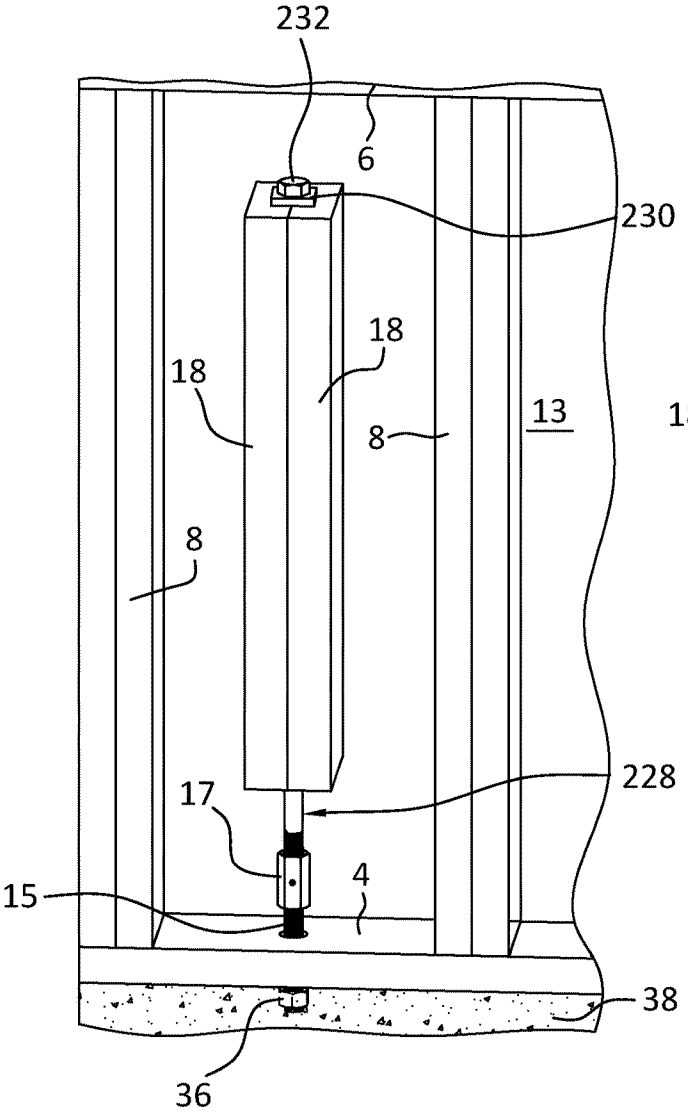

Referring to FIGS. 55A and 55B, a bolt 228 is encased by the members 18. A washer 230 advantageously spreads the load from the bolt head portion 232 to a larger area. The washer 230 may be square or rectangular. The members 18 are operably attached to the wall sheathing 13 with nails and/or screws and/or adhesives and/or other standard means. The bolt 228 is attached to the anchor rod 15 with the coupler 17. The bolt 228 and the members 18 advantageously transfer tension loading (uplift forces) from the wall sheathing 13 to the foundation 38.

Figure 56C:
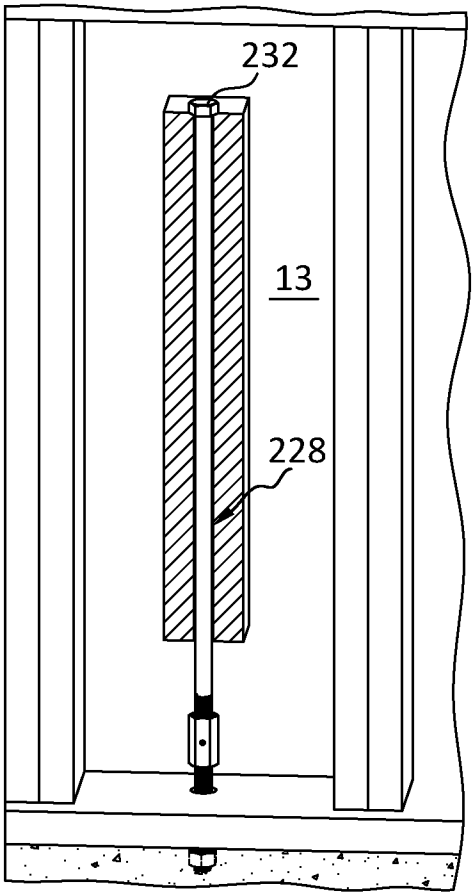
Figure 56B:
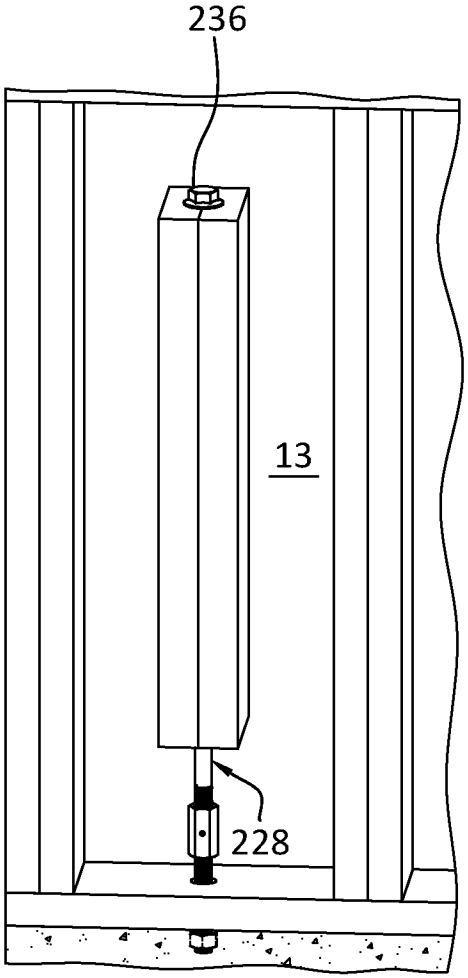
Figure 56A:
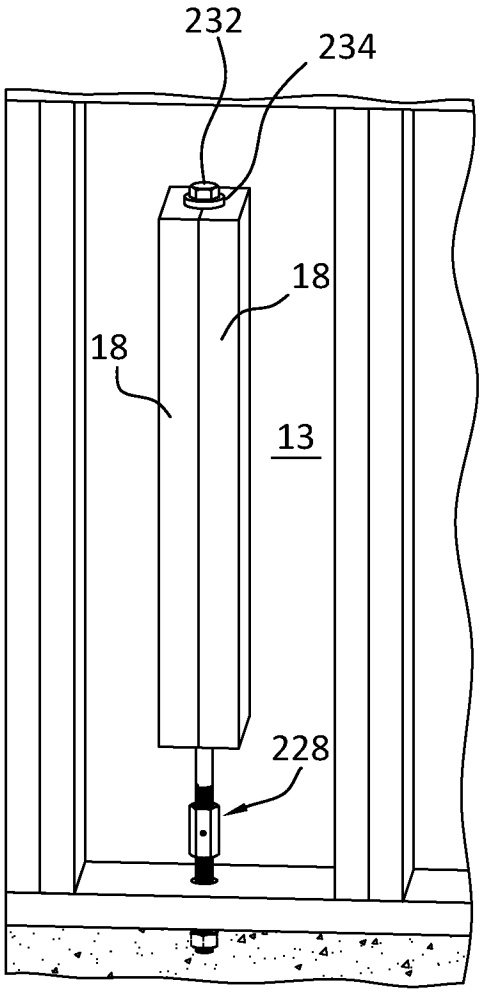

Referring to FIGS. 56A-56C, the washer 230 shown in FIG. 55A may be a round washer 234, as shown in FIG. 56A. The washer 234 may be integrated with the head portion 232 as flange head portion 236 as shown in FIG. 56B. The bolt 228 may be used without the washer 230, 234 or the flange head portion 236 as shown in FIG. 56C.

Figure 57B:
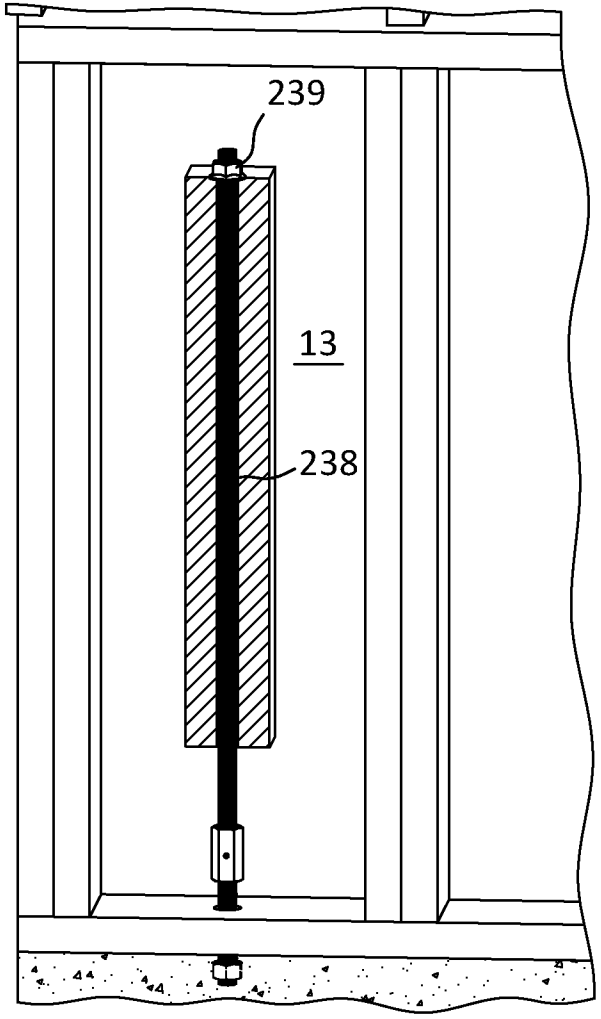
Figure 57A:
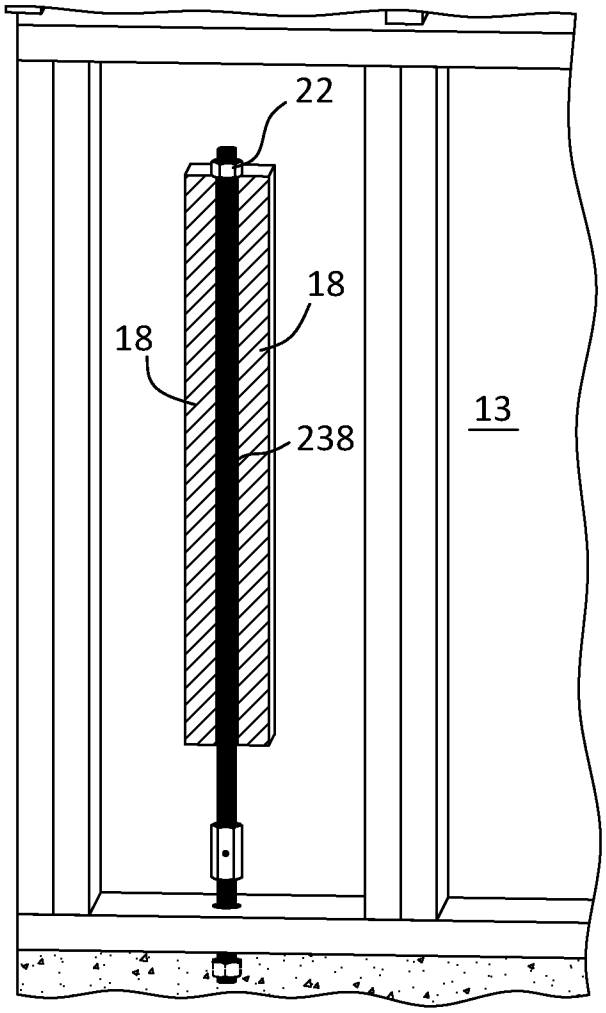

Referring to FIGS. 57A and 57B, a threaded rod 238 is operably attached to the members 18. The members 18 are operably attached to the wall sheathing 13 with nails and/or screws and/or adhesives and/or other standard means so that uplift forces on the wall is transferred to the rod 238 via the nut 22 or a flange nut 239.

Figure 58B:
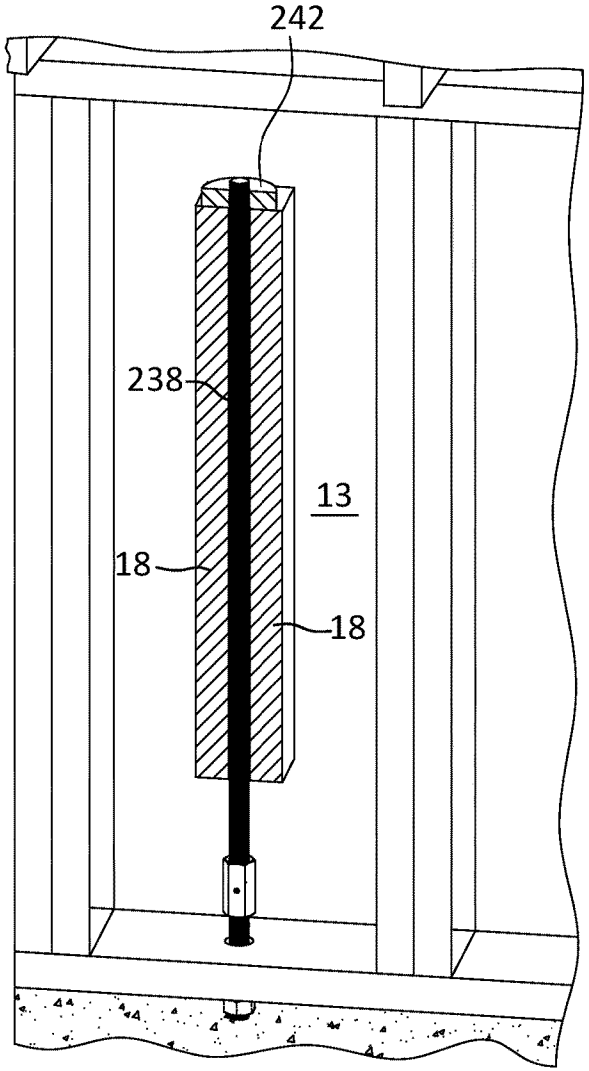
Figure 58A:
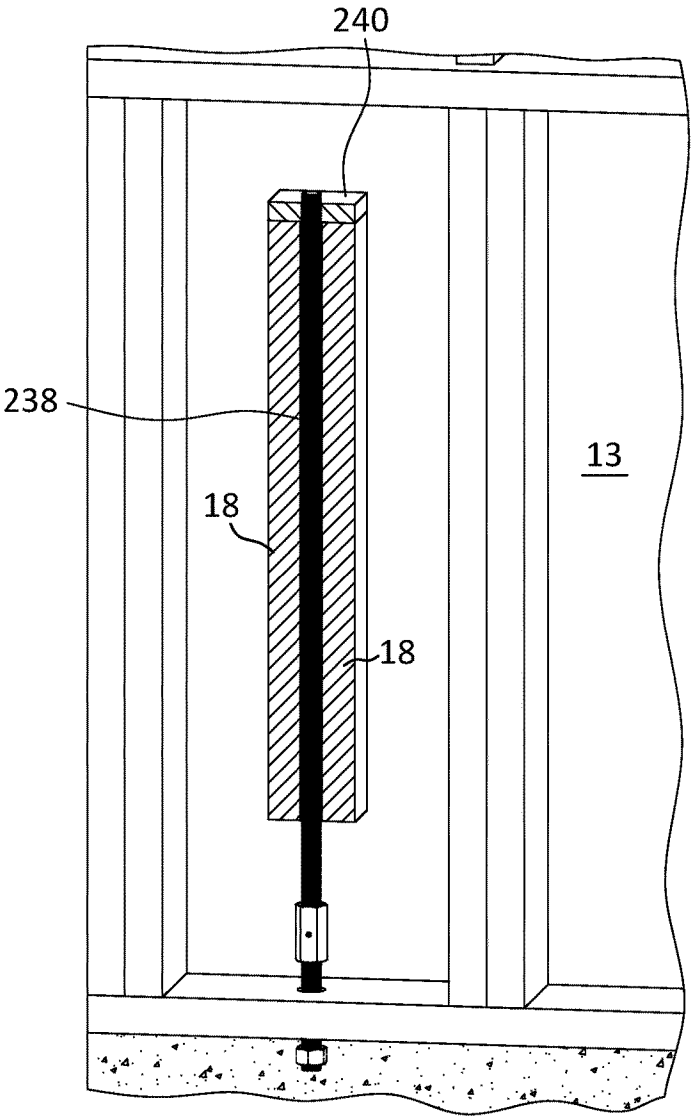

Referring to FIGS. 58A and 58B, the nut 22, 239 in FIGS. 57A and 57B is replaced with a threaded rectangular bearing plate 240 or a threaded round bearing plate 242. The bearing plate 240 or 242 is threaded to the rod 238. The members 18 are operably attached to the wall sheathing 13 so that uplift forces on the wall is transferred to the rod 238 via the bearing plate 240 or 242.

Figure 59B:
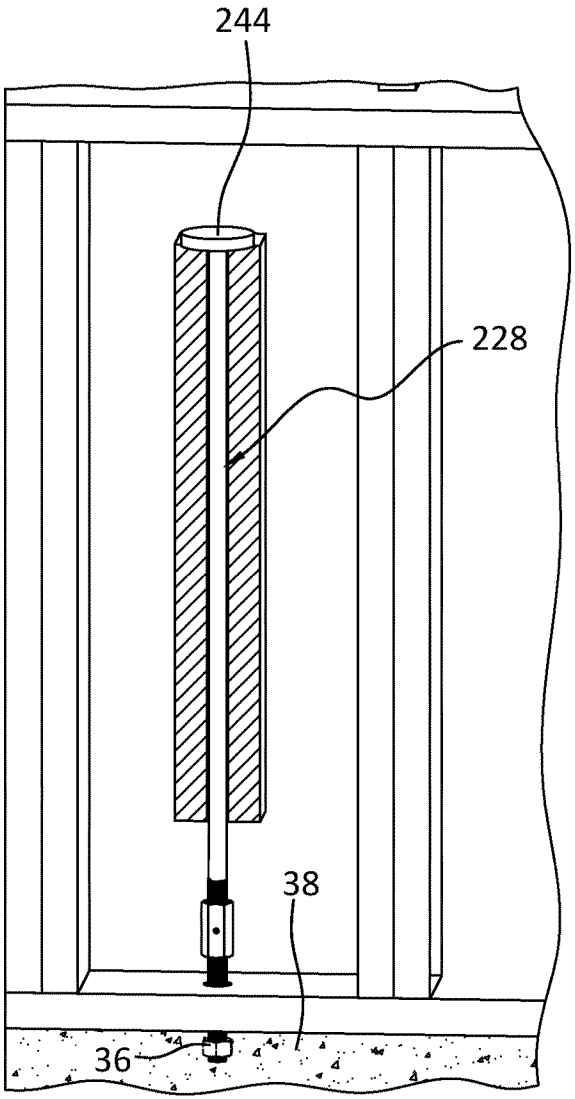
Figure 59A:
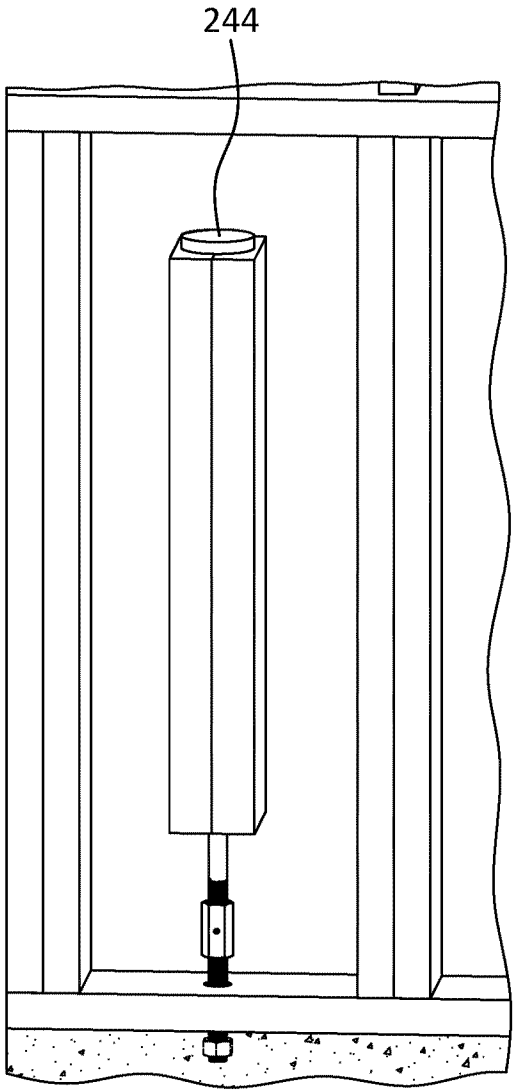

Referring to FIGS. 59A and 59B, the head portion 232 of the bolt 228 shown in FIG. 56E is modified as head portion 244 to incorporate the round bearing plate 242 shown in FIG. 58B. The head portion 244 is integral with the rest of the bolt 228. The head portion 244, acting as a bearing plate, advantageously transfers the uplift load from the wall to the bolt 228 and thence to the foundation 38 via the anchor 36.

Figure 60B:
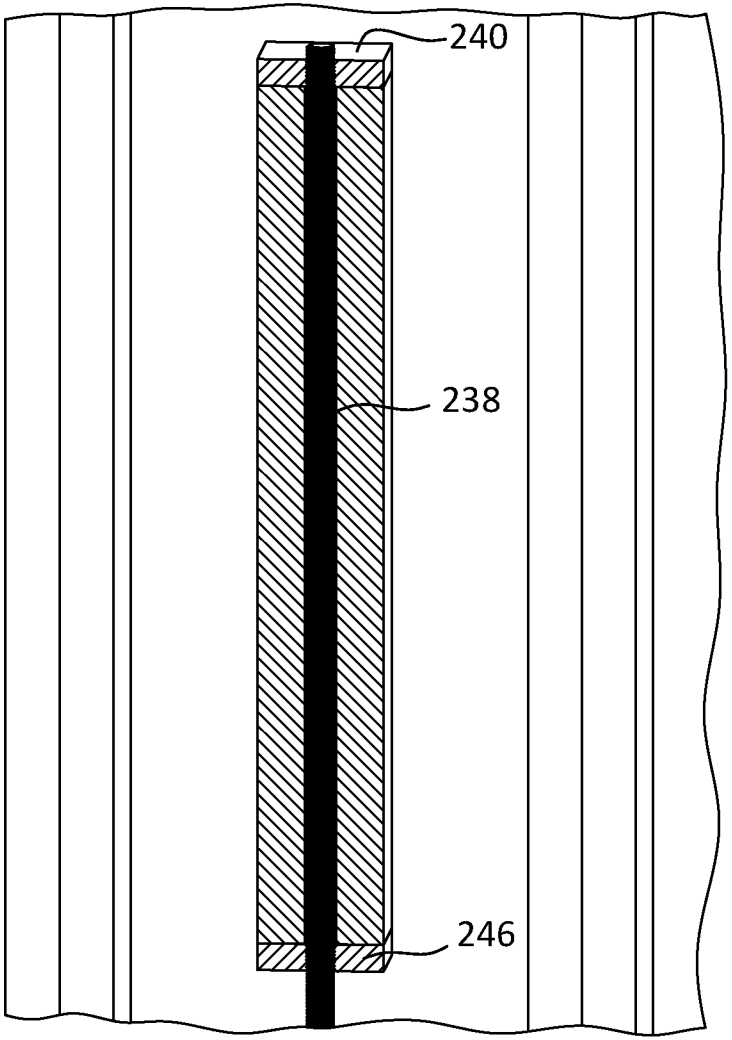
Figure 60A:
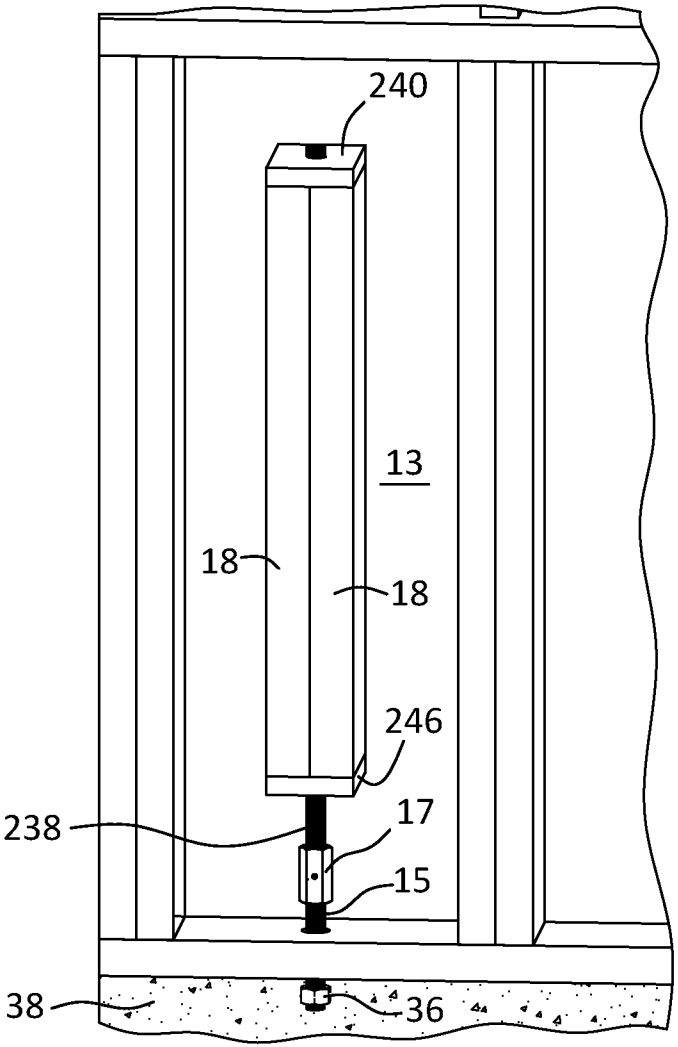

Referring to FIGS. 60A and 60B, the configuration shown in FIGS. 58A and 58B is modified with the addition of another bearing plate 246 disposed at the bottom of the members 18. The bearing plate 246 is threaded to the threaded rod 238. The bearing plate 246 advantageously transfers downward loading (compression loading) from the wall sheathing 13 to the members 18 and to the threaded rod 238, from which the compression loading is transferred to the anchor 36 and the concrete foundation 38. The bearing plate 240 remains for transferring tension loading (uplift loading) to the threaded rod 238 from the wall via the wall sheathing 13 attached to the members 18. The members 18 are operably attached to the wall sheathing by nails and/or screws and/or adhesive.

Figure 61:
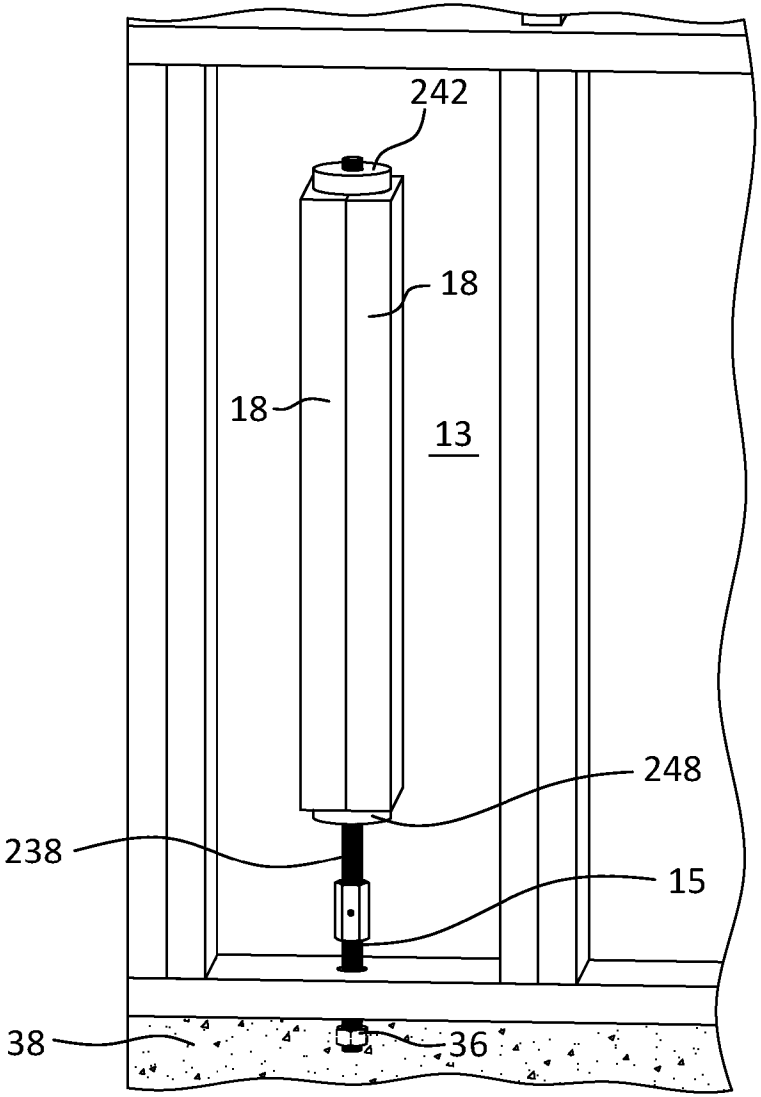

Referring to FIG. 61, the configuration of FIG. 58B is modified with the addition of another round threaded bearing plate 248 disposed at the bottom of the members 18. The bearing plate 248 is threaded to the threaded rod 238. The bearing plate 248 advantageously transfers downward loading (compression loading) from the wall sheathing 13 to the members 18 and to the threaded rod 238, from which the compression loading is transferred to the anchor 36 and the concrete foundation 38.

It should be understood that the bearing plate 246 may be replaced by the bearing plate 248. Similarly, the bearing plate 240 may be replaced by the bearing plate 242.

Figure 62B:
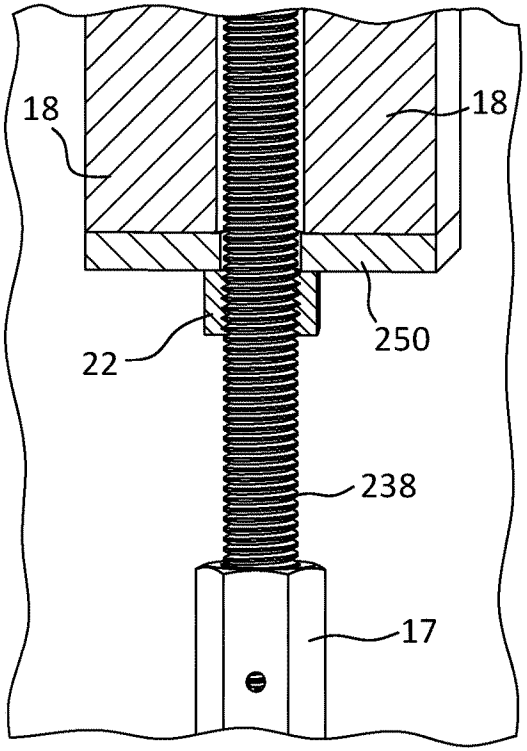
Figure 62A:
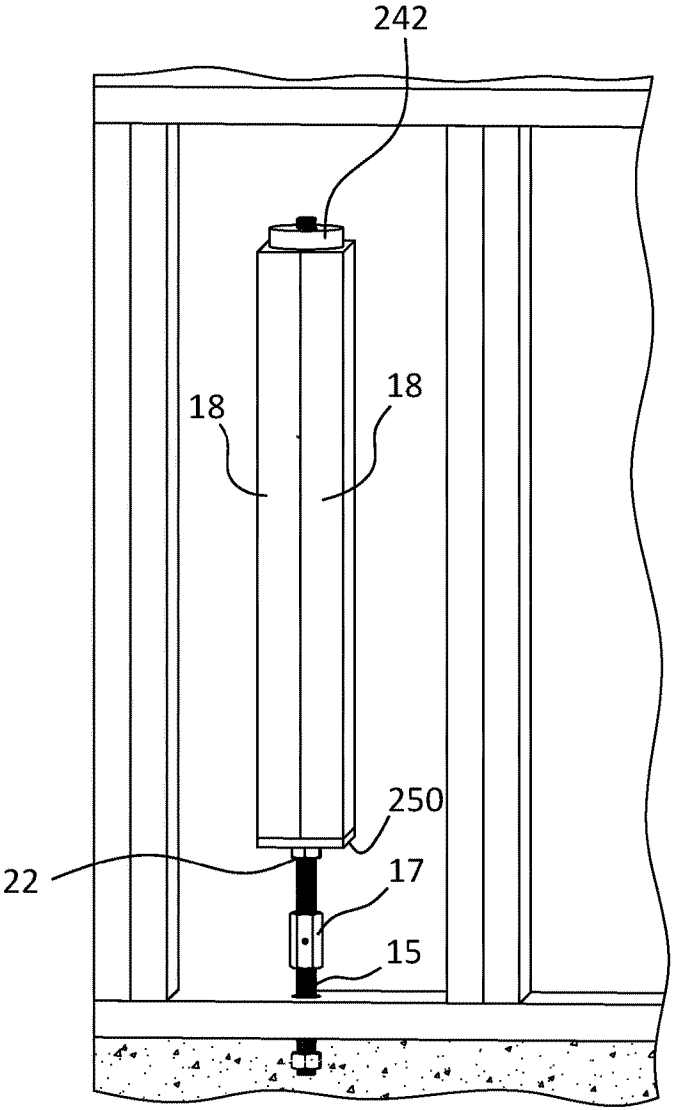

Referring to FIGS. 62A and 62B, the lower bearing plate 250 is not threaded to the rod 238. A nut 22 attaches the bearing plate 250 to the rod 238 and the bottom of the members 18. The bearing plate 250 may also be round.

Figure 63B:
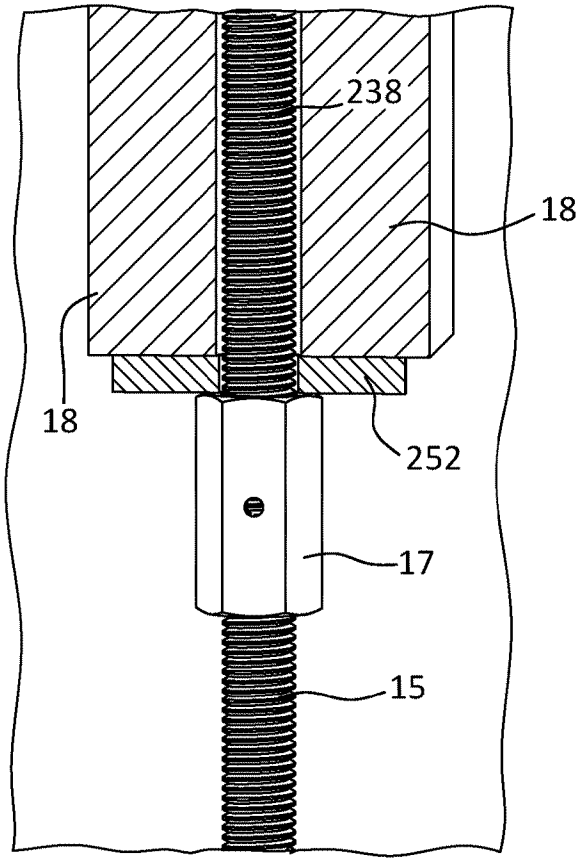
Figure 63A:
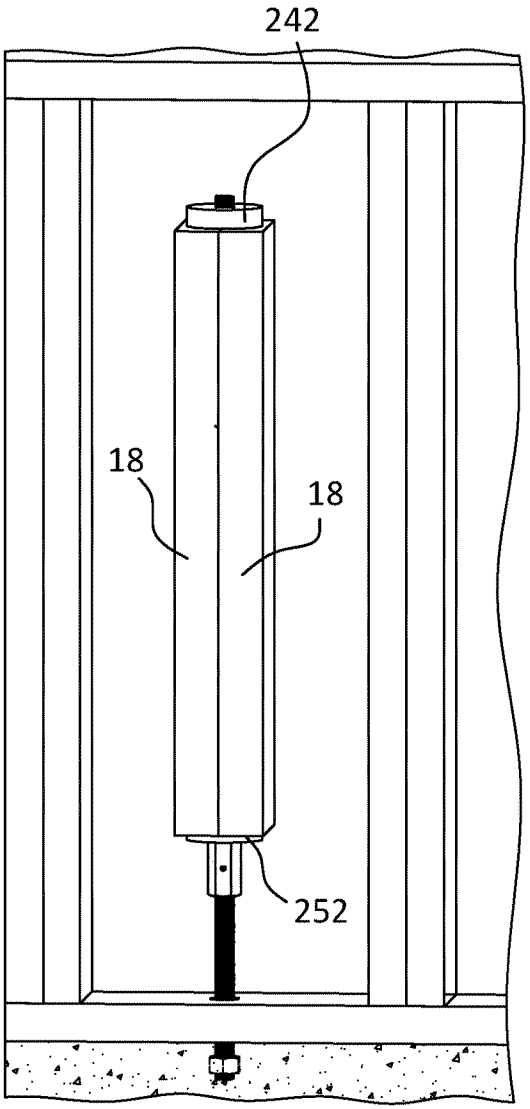

Referring to FIGS. 63A and 63B, the round lower bearing plate 252 is not threaded to the rod 238. The coupler 17 is used to attach the bearing plate 252 to the rod 238 and the bottom of the members 18. The bearing plate 252 may also be square or rectangular.

Figure 64C:
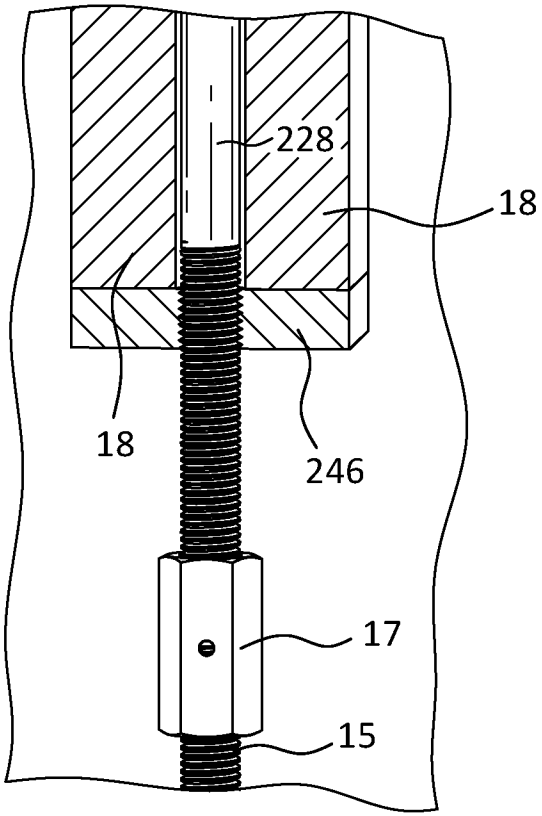
Figure 64B:
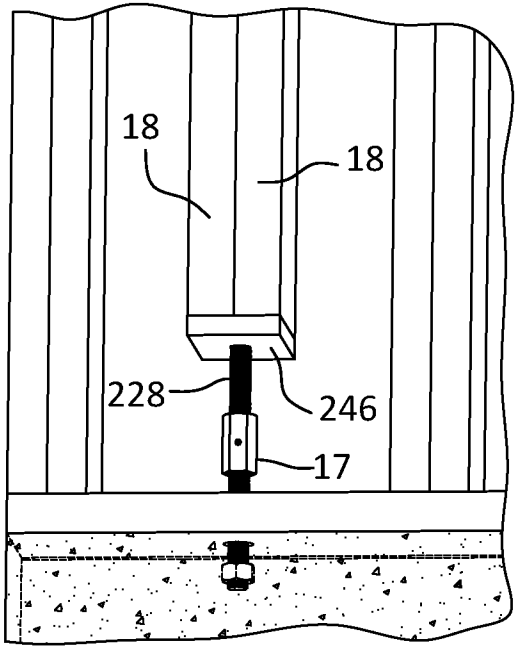
Figure 64A:
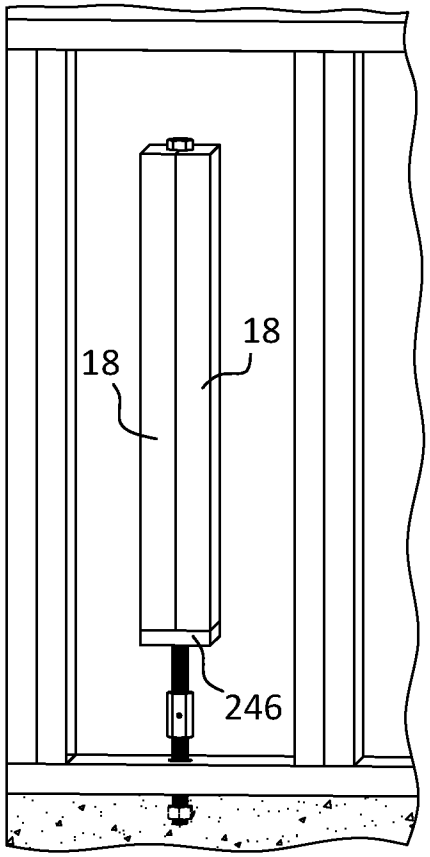

Referring to FIG. 64A-64C, the configurations shown in FIGS. 56A-56E and 59A-59B are modified with the addition of the lower bearing plate 246, which is threaded to the bolt 228. The bolt 228 may be threaded only where required to attach the bearing plate 246 to the bolt 228.

Figure 65B:
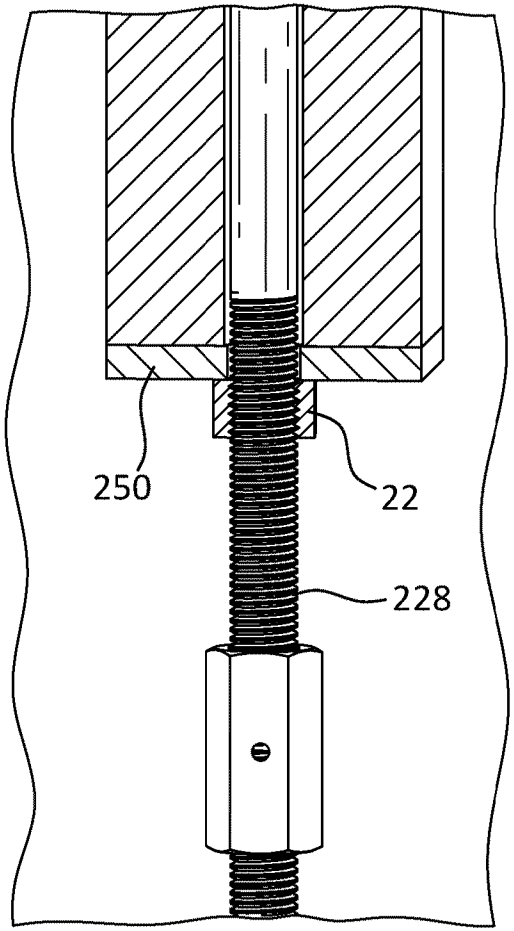
Figure 65A:
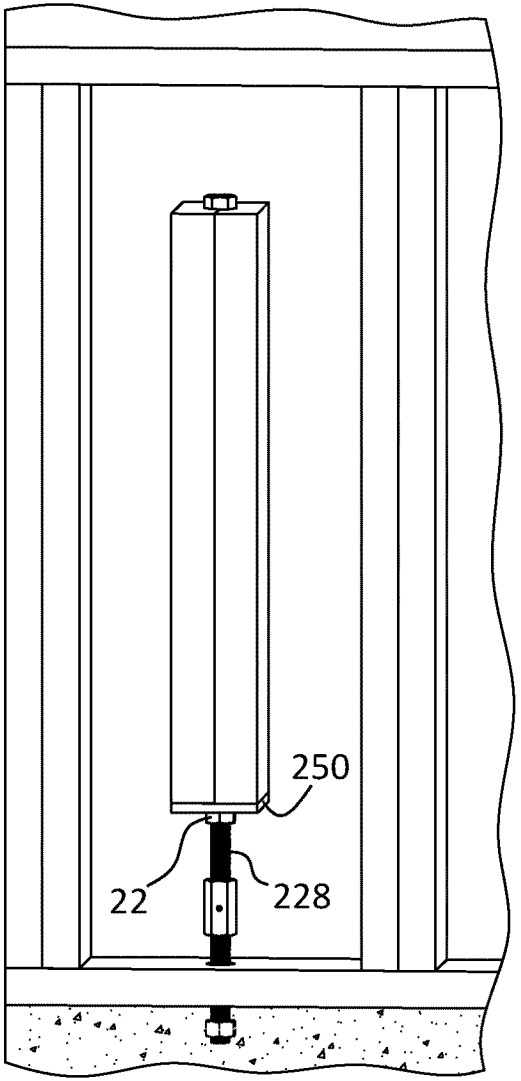

Referring to FIGS. 65A and 65B, the configurations shown in FIGS. 56A-56E and 59A-59B are modified with the addition of the lower bearing plate 250, which is not threaded to the bolt 228. A nut 22 attaches the bearing plate 250 to the rod 238 and the bottom of the members 18. The bearing plate 250 may also be round.

Figure 66C:
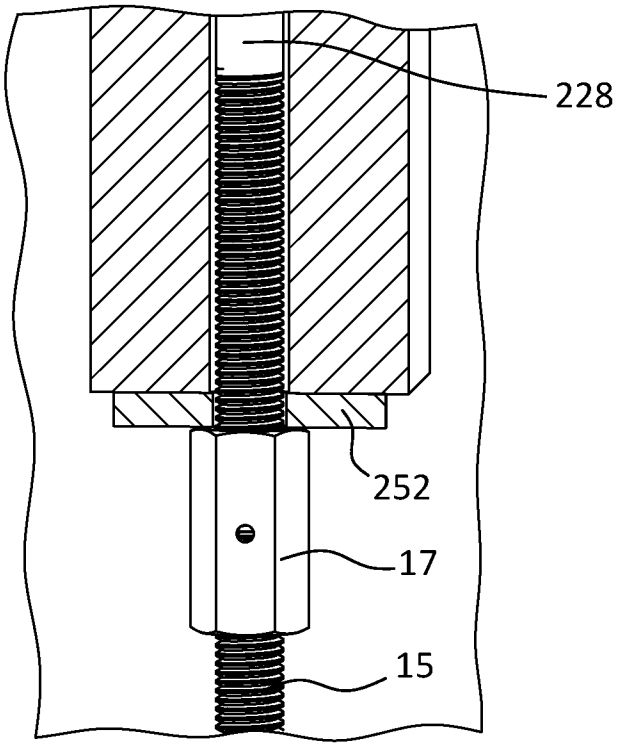
Figure 66B:
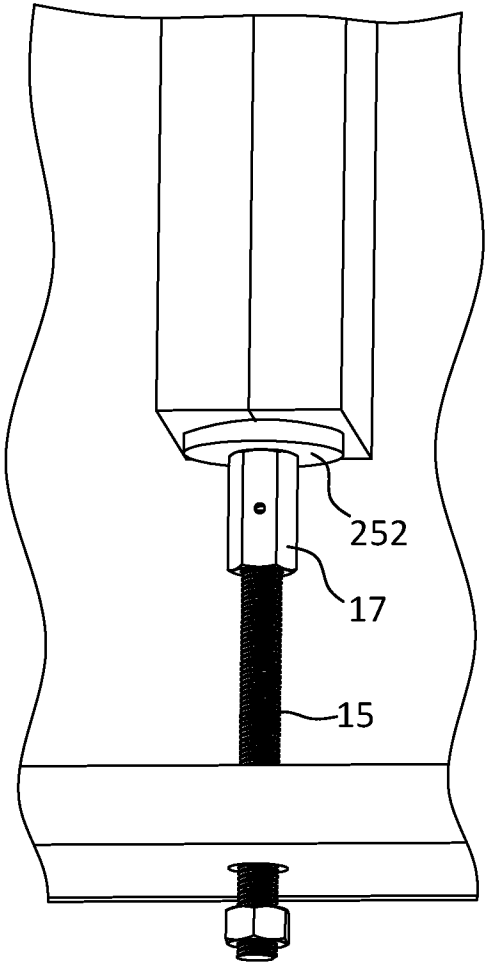
Figure 66A:
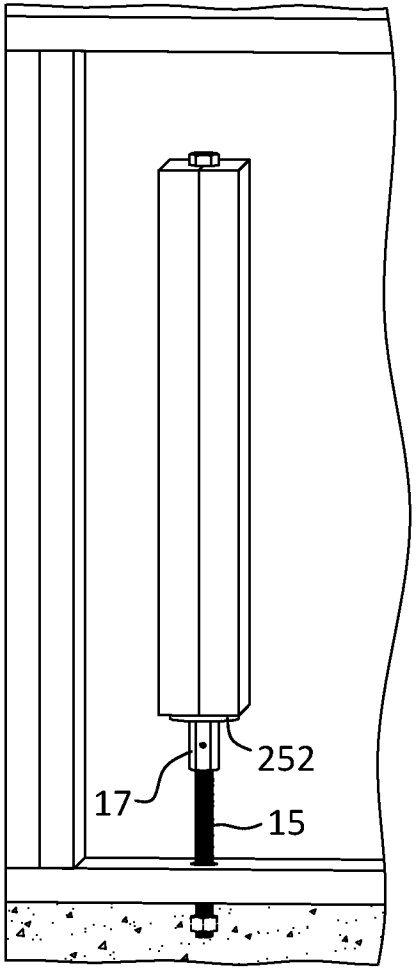

Referring to FIGS. 66A-66C, the configurations shown in FIGS. 56A-56E and 59A-59B are modified with the addition of the lower bearing plate 252, which is not threaded to the bolt 228. The coupler 17 is used to attach the bearing plate 252 to the bolt 228 and the bottom of the members 18. The bearing plate 252 may also be square or rectangular.

Figure 67C:
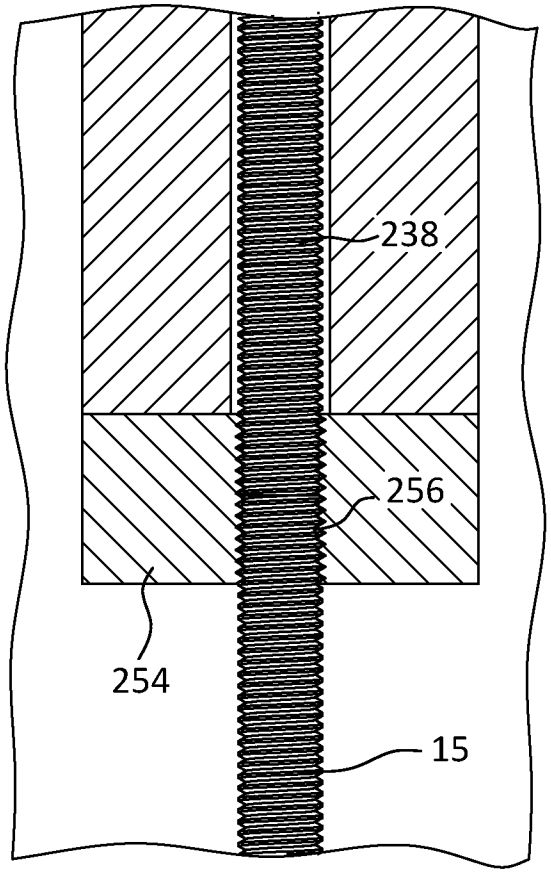
Figure 67B:
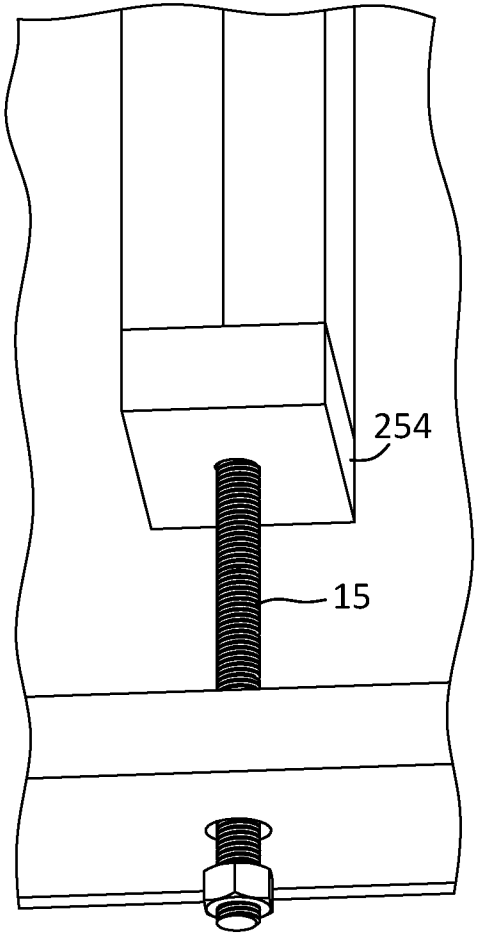
Figure 67A:
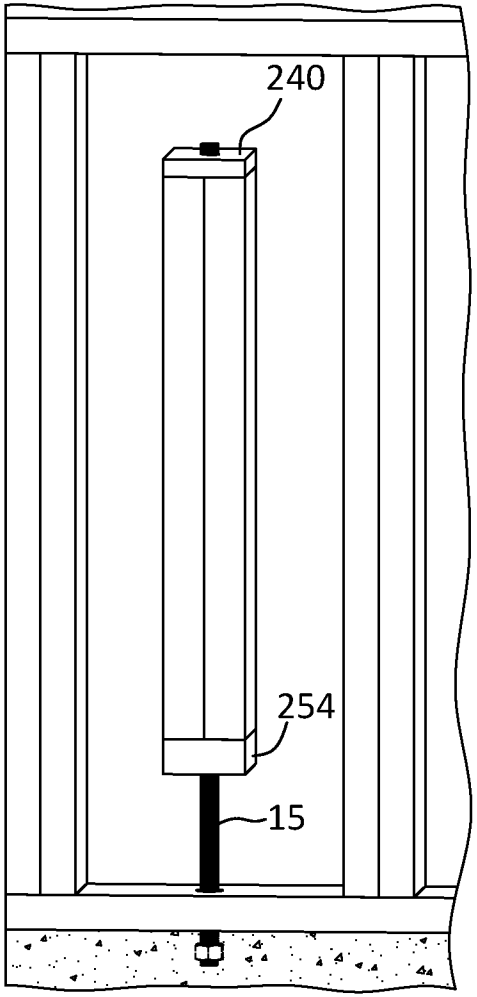

Referring to FIGS. 67A-67C, the configuration of FIGS. 60A-60B is modified to combine the bearing plate 246 and the coupler 17 with a bearing plate 254 with a threaded opening 256 with sufficient depth to threadedly attach to the anchor rod 15 and the threaded rod 238. The bearing plate 254 advantageously provides the function of the coupler 17 for joining two rods together. The bearing plate 254 may also be round.

Figure 68C:
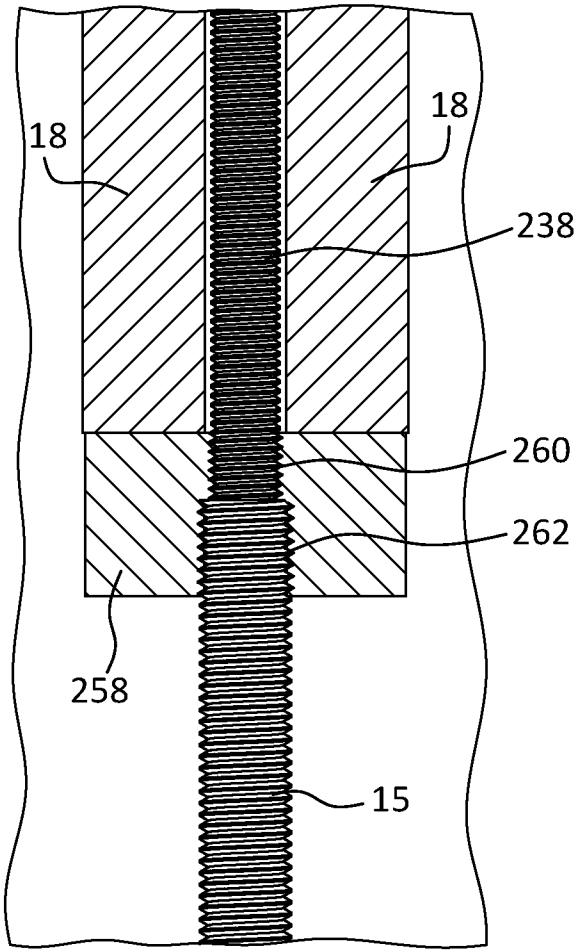
Figure 68B:
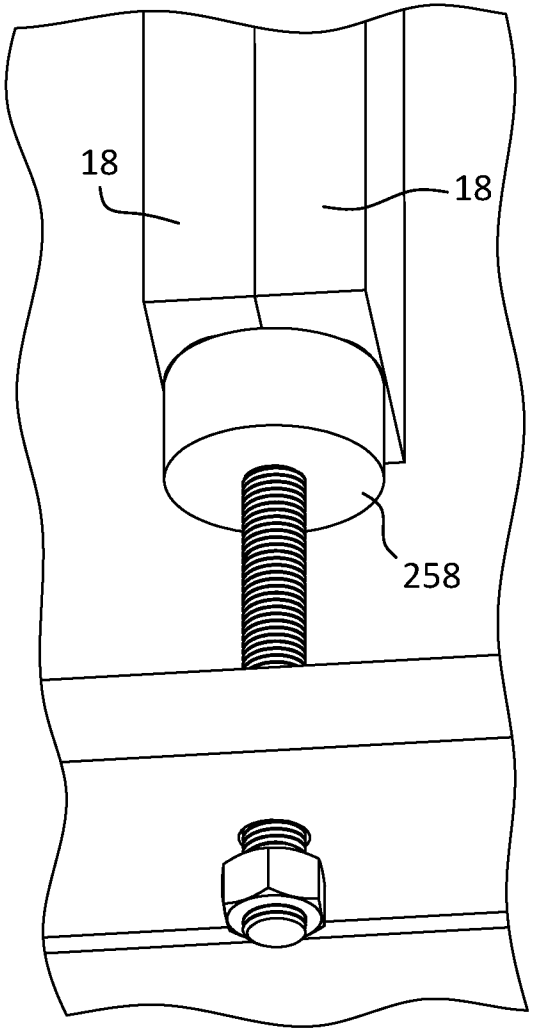
Figure 68A:
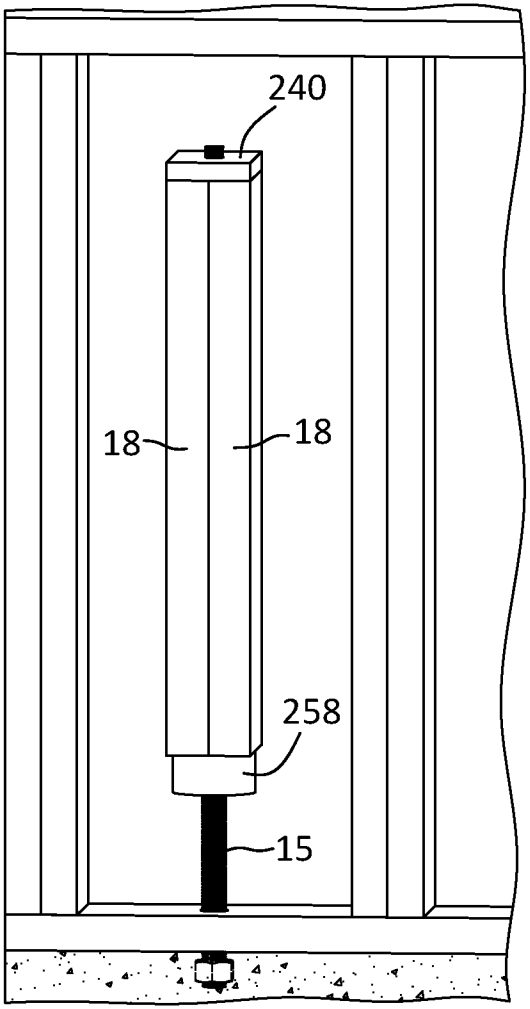

Referring to FIGS. 68A-68C, the bearing plate 254 is modified as a round threaded bearing plate 258 with multi-diameter threaded openings 260 and 262. The opening 260 is smaller in diameter than the opening 262. The opening 260 may also be larger in diameter than the opening 262. The bearing plate 258 may also be square, rectangular or hexagonal.

Figure 69C:
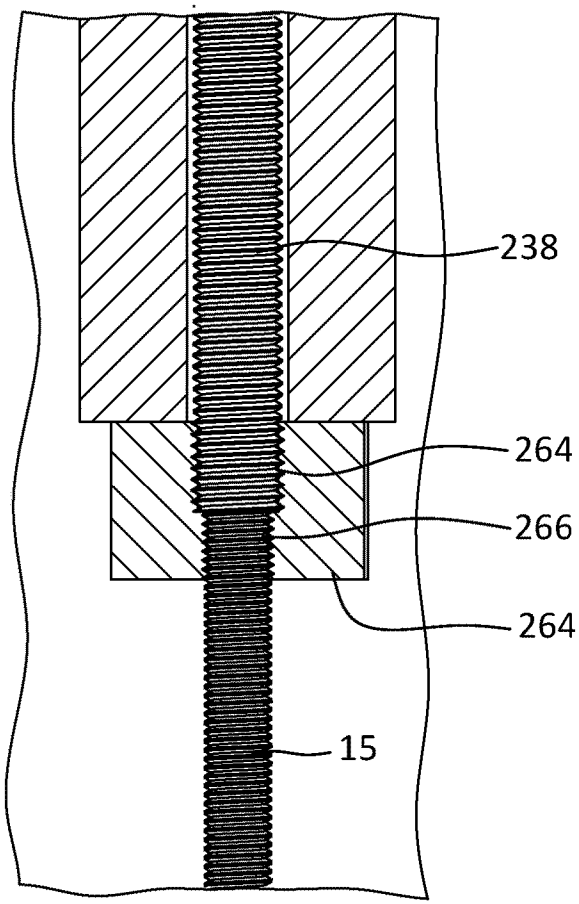
Figure 69B:
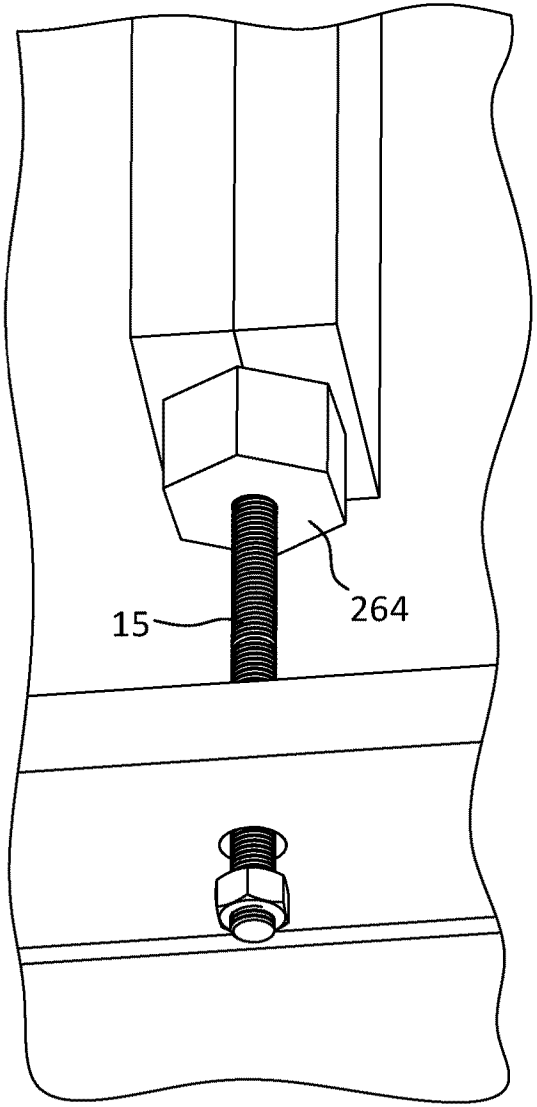
Figure 69A:
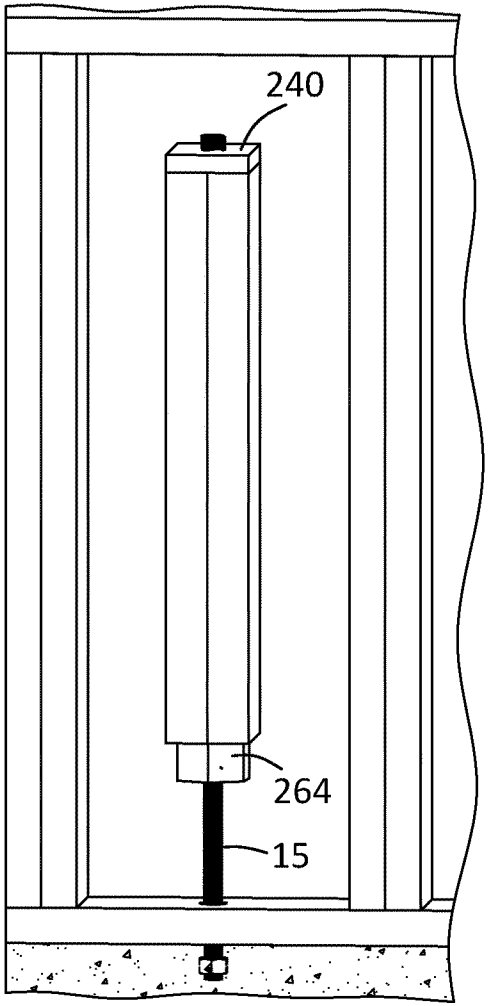

Referring to FIGS. 69A-69C, the bearing plate 258 is modified as a hexagonal bearing plate 264 with multi-diameter threaded openings 264 and 266. The opening 264 is larger in diameter than the opening 266. The opening 264 may also be smaller in diameter than the opening 266.

The bearing plats 240 and 242 (see FIGS. 58A and 58B) and the head portion 244 (see FIGS. 59A and 59B) may be modified to include the thickness and threaded openings of the bearing plates 254, 258 and 264 so that the threaded rod 238 or the bolt 228 may be extended to the upper wall with a tie rod.

The members 18 advantageously provide reinforcement to the bolt 228 or the rod 238. The members 18 may also be replaced with a single member 19 as shown, for example, in FIGS. 25A and 35A-36B.

Figure 70B:
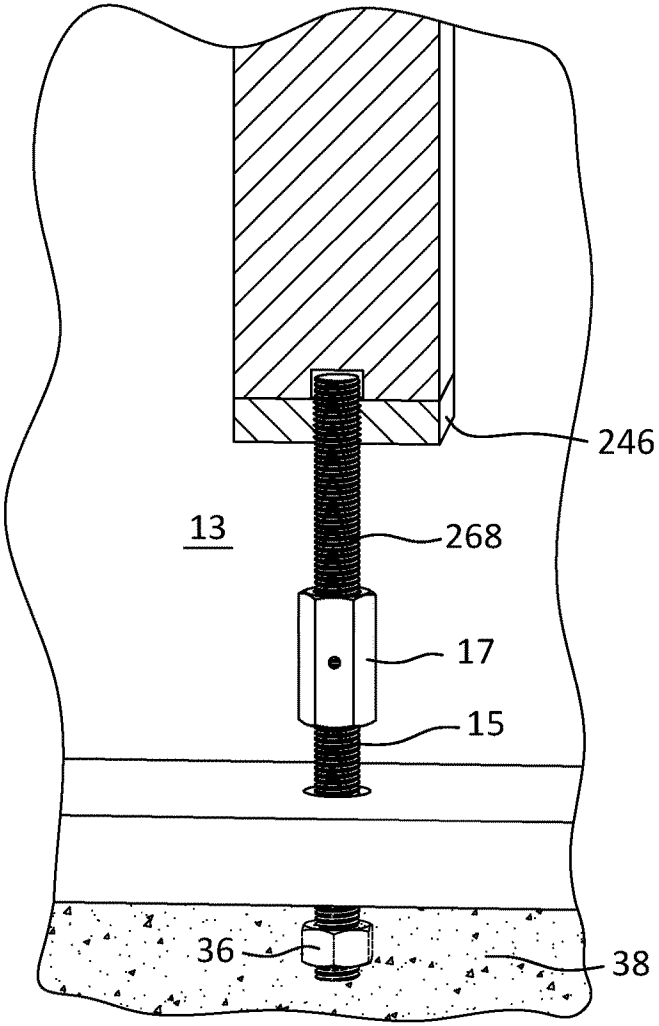
FIGS. 70A-72B show a reinforced building wall using reinforcement members without a tie rod.
Figure 70A:
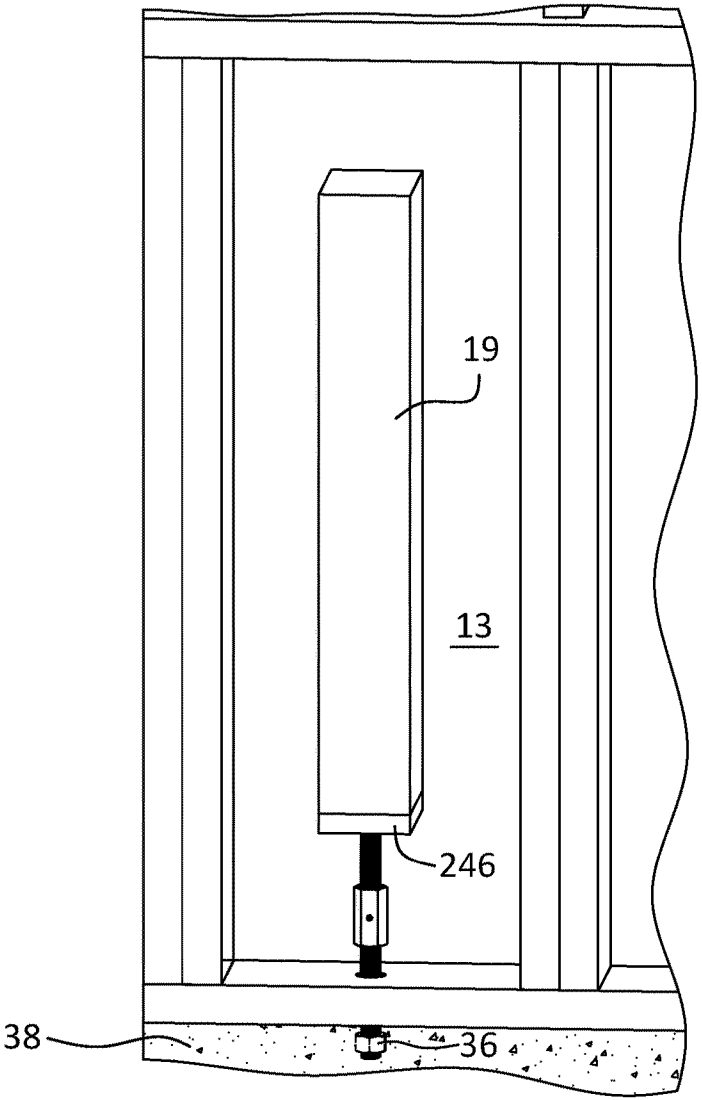

Referring to FIGS. 70A and 70B, the unitary block 19 made of a single block of wood is used. The block 19 is operably attached to the wall sheathing 13 with nails and/or screws and/or adhesives and/or other standard means. A short-threaded rod 268 is threaded to the coupling 17 and the bearing plate 246. The rod 268 extends through the bearing plate 246 and into the bottom of the block 19. Compression loading from the wall sheathing 13 is transferred to the bearing plate 246 through the block 19. The compression loading is then transferred to the rod 268 and the anchor rod 15 and absorbed by the concrete foundation 38 via the anchor 36.

Figure 71B:
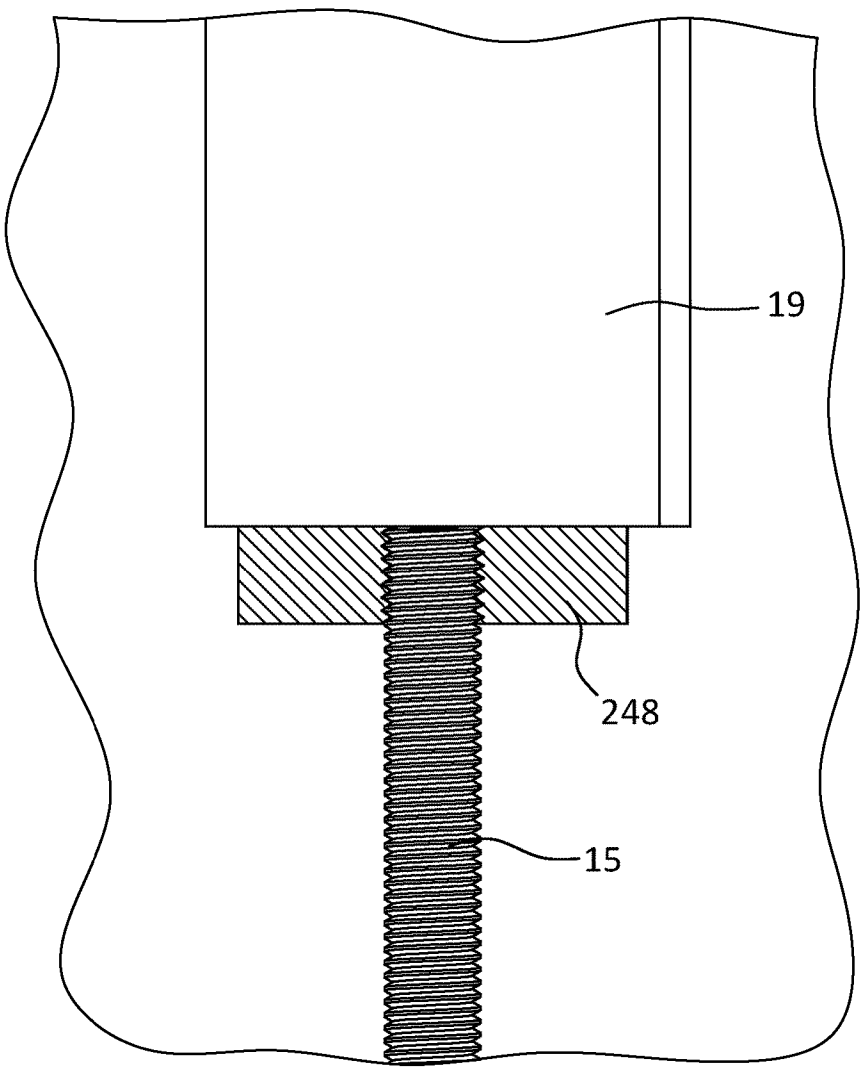
Figure 71A:
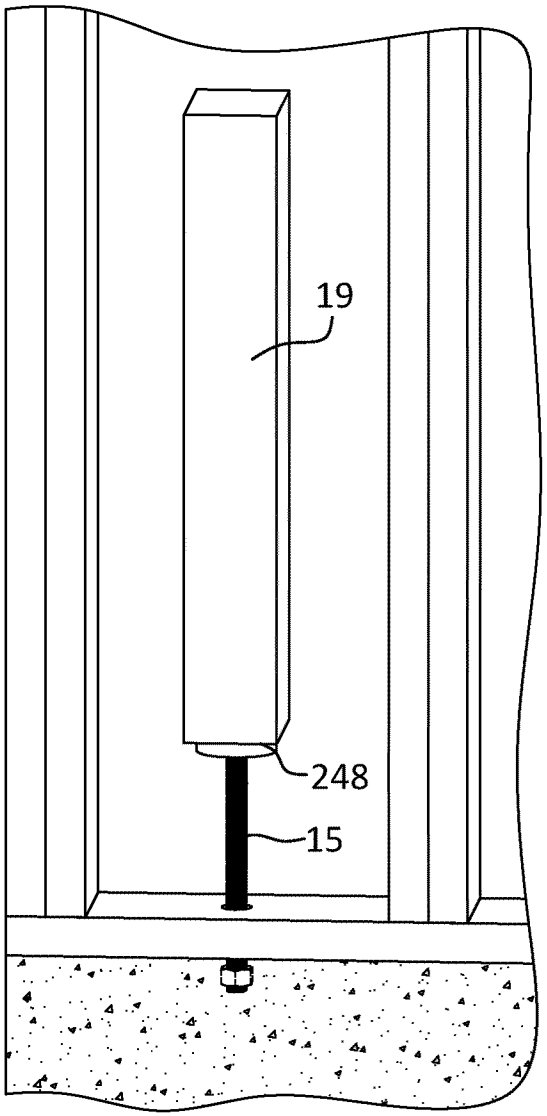

Referring to FIGS. 71A and 71B, the anchor rod 15 is threaded directly to the bearing plate 248, advantageously eliminating the coupling 17. The anchor rod 15 is shown as not extending into the bottom of the block 19 but it may also extend into the block, as in the manner shown in FIG. 70B. The bearing plate 248 may also be rectangular or square.

Figure 72B:
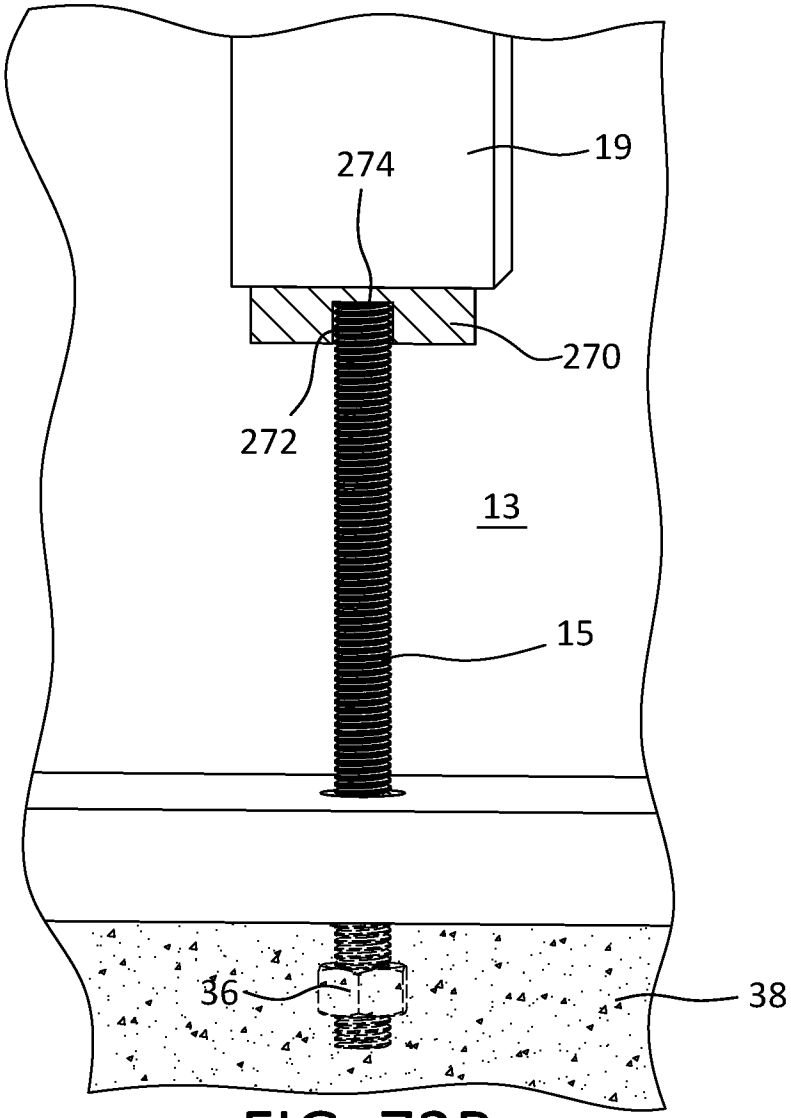
Figure 72A:
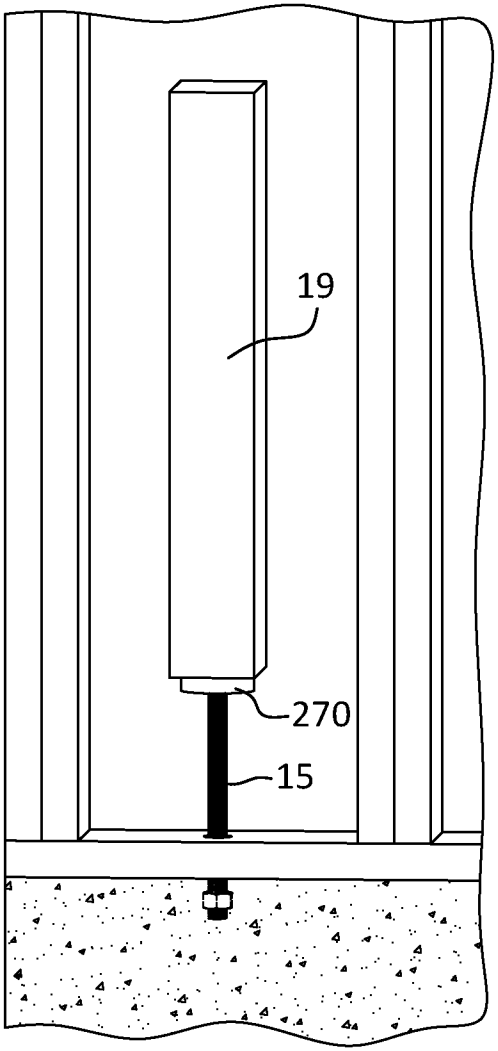

Referring to FIGS. 72A and 72B, a bearing plate 270 with a blind hole 272 is supported by the anchor rod 15. The bearing plate 270 is not threaded to the anchor rod. Downward loading from the wall sheathing 13 is transferred to the bearing plate 270 through the block 19. The top wall 274 of the blind hole 272 bears down on the top end of the anchor rod 15, thus transferring the downward loading to the anchor rod 15 and to the concrete foundation 38 via the anchor 36.

It should be understood that the various components shown in a particular configuration of a wall may be interchanged with other components shown in another configuration of the wall to arrive at a different configuration to provide a wall reinforced for tension and/or compression forces generated by wind or seismic loads.

While this invention has been described as having preferred design, it is understood that it is capable of further modifications, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A building wall, comprising:

a) a stud wall including a wall sheathing;

b) a tie rod including a first end portion operably anchored to a foundation;

c) a longitudinal member directly attached to the wall sheathing, the longitudinal member being disposed vertically, the longitudinal member including a top end and a bottom end, the tie rod including a portion extending vertically through the longitudinal member from the bottom end to the top end; and d) a first bearing member operably attached to the tie rod and engaging the top end to transfer tension loading from the wall sheathing and the longitudinal member to the tie rod.

2. The building wall as in claim 1, wherein:

a) the longitudinal member comprises a first member and a second member joined to each other; and b) the portion of the tie rod is disposed between the first member and the second member.

3. The building wall as in claim 1, wherein the first bearing member includes a threaded hole threaded to the tie rod.

4. The building wall as in claim 1, and further comprising a first nut threaded to the tie rod and operably bearing on the first bearing member.

5. The building wall as in claim 1, and further comprising:

a) a second bearing member engaging the bottom end; and b) the second bearing member is operably attached to the tie rod to transfer compression loading from the wall sheathing and the longitudinal member to the tie rod.

6. The building wall as in claim 5, and further comprising a second nut threaded to the tie rod and operably bearing on an underside of the second bearing member.

7. The building wall as in claim 5, wherein the second bearing member includes a threaded hole threaded to the tie rod.

8. The building wall as in claim 5, wherein the first bearing member engages a bottom surface of a top plate of the stud wall.

9. The building wall as in claim 1, and further comprising:

a) a cross-member operably attached to a vertical wall member; and b) the bottom end is disposed on top of the cross-member.

10. The building wall as in claim 1, wherein the longitudinal member is directly attached to a vertical wall member extending between a bottom plate and a top plate of the stud wall.

11. The building wall as in claim 10, wherein the longitudinal member is directly attached to another vertical wall member extending between the bottom plate and the top plate.

12. The building wall as in claim 5, and further comprising:

a) a third bearing member operably attached to the tie rod; and b) the third bearing member engages a bottom surface of a top plate of the stud wall.

13. The building wall as in claim 1, wherein an expandable connector is operably attached to the tie rod, the expandable connector bears on the first bearing member.

14. The building wall as in claim 1, wherein the first bearing member is integral and forms a part of the tie rod.

15. The building wall as in claim 1, wherein the longitudinal member is solid.

16. The building wall as in claim 1, wherein the longitudinal member is hollow.

17. The building wall as in claim 16, wherein the longitudinal member includes a tie rod guide.

18. The building wall as in claim 2, wherein the first member and the second member are solid.

19. The building wall as in claim 2, wherein the first member and the second member are hollow.

20. The building wall as in claim 1, wherein the longitudinal member includes a longitudinal slot and the portion of the tie rod extending from the bottom end to the top end is disposed in the longitudinal slot.

21. The building wall as in claim 20, wherein:

a) the portion of the tie rod includes a thread; and b) a bottom surface of the longitudinal slot includes an impression of the thread to engage the thread of the portion of the tie rod.

22. The building wall as in claim 20, and further comprising a plate disposed over the longitudinal slot.

23. The building wall as in claim 20, wherein the longitudinal slot is configured for interference fit of the portion of the tie rod.

24. The building wall as in claim 20, wherein the longitudinal slot includes a depth configured to position the portion of the tie rod to be flush with an outside surface of the longitudinal member.

25. The building wall as in claim 20, wherein the longitudinal slot includes a depth configured to position a diameter of the portion of the tie rod to protrude beyond an outside surface of the longitudinal member.

26. The building wall as in claim 25, wherein the longitudinal member is directly attached to a vertical wall member to sandwich the portion of the tie rod between the longitudinal member and the vertical wall member.

27. The building wall as in claim 1, wherein the bottom end is disposed a distance above a bottom plate of the stud wall.

28. A building wall, comprising:

a) a stud wall including a wall sheathing;

b) a tie rod including a first end portion operably anchored to a foundation;

c) a longitudinal member directly attached to the wall sheathing, the longitudinal member being disposed vertically, the longitudinal member including a top end and a bottom end, the tie rod extending vertically through the longitudinal member from the bottom end to the top end; and d) a bearing member being operably attached to the tie rod and engaging the bottom end to transfer compression loading from the wall sheathing and the longitudinal member to the tie rod.

29. A building wall, comprising:

a) a stud wall including a wall sheathing;

b) a vertical longitudinal member directly attached to the wall sheathing with screws and/or nails, the longitudinal member having a top end and a bottom end; and c) a tie rod operably anchored to a foundation, the tie rod including a portion extending vertically through the longitudinal member from the bottom end to the top end, the portion of the tie rod being encased in the longitudinal member to provide lateral support to the portion during compression loading of the tie rod.

* * * * *